US009433288B2

(12) United States Patent
Voigt et al.

(10) Patent No.: US 9,433,288 B2
(45) **Date of Patent: *Sep. 6, 2016**

(54) ERGONOMIC PRODUCTIVITY WORKSTATION HAVING COORDINATED AND HARMONIZED MOVEMENT OF HEAD REST, BACKREST, SEAT, LEG REST, ARM RESTS, MONITOR SUPPORT, AND WORK TRAYS THROUGH SITTING, STANDING, AND RECLINING CONFIGURATIONS

(71) Applicant: SV TOOL CORPORATION, Santa Rosa, CA (US)

(72) Inventors: Che Voigt, Santa Rosa, CA (US); John M. Speicher, Geyserville, CA (US)

(73) Assignee: SV TOOL CORPORATION, Santa Rosa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/605,797

(22) Filed: Jan. 26, 2015

(65) Prior Publication Data

US 2015/0216302 A1 Aug. 6, 2015

Related U.S. Application Data

(63) Continuation of application No. 14/216,426, filed on Mar. 17, 2014, now Pat. No. 8,939,500.

(60) Provisional application No. 61/800,457, filed on Mar. 15, 2013.

(51) Int. Cl.
*A47B 39/00* (2006.01)
*A47B 39/02* (2006.01)
(Continued)

(52) U.S. Cl.
CPC ..... *A47B 83/02* (2013.01); *A47C 1/00* (2013.01); *A47C 1/024* (2013.01); *A47C 1/0242* (2013.01);
(Continued)

(58) Field of Classification Search
CPC A47B 83/02; A47B 2083/025; A47C 1/036; A47C 1/037; A47C 1/024; A47C 1/0242; A47C 7/004; A47C 7/006; A47C 7/70; A47C 7/72; A47C 1/00
USPC ..... 297/217.3, 161, 170, 172, 173
See application file for complete search history.

(56) References Cited

U.S. PATENT DOCUMENTS 4,779,922 A * 10/1988 Cooper ..... A47B 21/03 297/171 X
4,915,450 A * 4/1990 Cooper ..... F16M 11/10 297/217.3 X (Continued)

FOREIGN PATENT DOCUMENTS

KR WO 2012153920 A2 * 11/2012 ..... G09B 9/02
MX WO 9922624 A1 * 5/1999 ..... A47C 7/68
MX WO 2011016707 A2 * 2/2011 ..... A47C 1/0355

OTHER PUBLICATIONS http://gravitonus.com/lang/en-us/index/iclubby/2001-2015.

(Continued)

*Primary Examiner* — Rodney B White
(74) *Attorney, Agent, or Firm* — Craig M. Stainbrook; Stainbrook & Stainbrook, LLP

(57) ABSTRACT

An ergonomic workstation that includes a base; an effective hip axis affixed to the base; a seat bottom that rotates about the effective hip axis; a seat back that rotates about the effective hip axis; an effective shoulder axis positionally fixed to the seat back; an effective elbow axis positionally fixed to the seat back; a monitor support having a monitor mount that rotates about the shoulder axis; and an input device tray support configured such that an input device tray on the support rotates about the elbow axis. As the workstation moves through a broad range of operational zones, it maintains a fixed eye-to-monitor distance and fixed angle between the user's head and the monitor throughout a significant portion of the range of motion, and a fixed distance from the user's elbow to an input device throughout the entire range of motion.

3 Claims, 53 Drawing Sheets

(51) Int. Cl.

| | |
|---|---|
| ***A47B 83/02*** | (2006.01) |
| ***A47C 7/62*** | (2006.01) |
| ***A47C 1/00*** | (2006.01) |
| ***A47C 1/024*** | (2006.01) |
| ***A47C 1/036*** | (2006.01) |
| ***A47C 1/037*** | (2006.01) |
| ***A47C 7/00*** | (2006.01) |
| ***A47C 7/70*** | (2006.01) |
| ***A47C 7/72*** | (2006.01) |

(52) U.S. Cl.

CPC ..... *A47C 1/036* (2013.01); *A47C 1/037* (2013.01); *A47C 7/004* (2013.01); *A47C 7/006* (2013.01); *A47C 7/70* (2013.01); *A47C 7/72* (2013.01); *A47B 2083/025* (2013.01)

(56) References Cited

U.S. PATENT DOCUMENTS

| | | | | | |
|---|---|---|---|---|---|
| 5,028,016 | A * | 7/1991 | Kelvin | B64D 11/0015 | 244/122 R |
| 5,116,098 | A * | 5/1992 | Wooten | A47B 83/02 | 297/170 X |
| 5,174,223 | A * | 12/1992 | Nagy | A47B 21/00 | 108/50.01 |
| 5,624,312 | A * | 4/1997 | Collier | A47C 7/72 | 454/186 |
| 5,765,910 | A * | 6/1998 | Larkin | A47B 83/001 | 297/172 |
| 5,779,305 | A * | 7/1998 | Hocking | A47B 21/00 | 297/170 |
| 5,909,934 | A * | 6/1999 | McGraw | A47B 21/00 | 297/188.21 |
| 6,056,363 | A * | 5/2000 | Maddox | A47C 3/0257 | 297/161 X |
| 6,092,868 | A | 7/2000 | Wynn | | |
| 6,102,476 | A * | 8/2000 | May | A47B 21/00 | 297/217.3 X |
| 6,145,926 | A * | 11/2000 | Lin | A47C 7/72 | 297/170 |
| 6,248,014 | B1 * | 6/2001 | Collier | A47B 21/00 | 454/186 |
| 6,270,157 | B1 * | 8/2001 | Kapushinski | A47B 83/02 | 297/170 |
| 6,296,408 | B1 * | 10/2001 | Larkin | A47B 83/001 | 400/681 |
| 6,315,358 | B1 * | 11/2001 | Baru | A47B 21/00 | 297/170 |
| 6,374,752 | B1 * | 4/2002 | Walser | A47B 21/00 | 108/50.01 |
| 6,394,402 | B2 * | 5/2002 | Coonan | A47B 21/00 | 248/123.11 |
| 6,425,631 | B1 * | 7/2002 | Lin | A47B 21/03 | 297/170 |
| 6,450,578 | B1 * | 9/2002 | Taggett | A47C 1/0347 | 297/173 |
| 6,712,008 | B1 * | 3/2004 | Habenicht | A47B 21/0314 | 108/147 |
| 6,769,318 | B2 * | 8/2004 | Gabiniewicz | G01M 99/001 | 73/865.9 |
| 6,832,560 | B2 * | 12/2004 | Seiler | A47B 21/00 | 108/50.01 |
| 6,874,431 | B1 * | 4/2005 | Danna | A47B 21/03 | 108/102 |
| 7,100,517 | B1 * | 9/2006 | Godwin | A47B 21/02 | 108/2 |
| 7,134,719 | B2 * | 11/2006 | Moglin | A47C 7/72 | 297/170 |
| 7,322,653 | B2 | 1/2008 | Dragusin | | |
| 7,823,973 | B2 * | 11/2010 | Dragusin | A63F 13/08 | 297/170 X |
| 7,878,476 | B2 * | 2/2011 | Carson | B60R 11/0235 | 211/26 |
| 7,887,103 | B2 | 2/2011 | Evans et al. | | |
| 7,887,130 | B1 * | 2/2011 | Zvolena | A47C 9/002 | 297/217.3 |
| 7,922,249 | B2 | 4/2011 | Marchand | | |
| 8,141,949 | B2 * | 3/2012 | Baru | A47B 21/00 | 297/172 |
| 8,567,808 | B2 * | 10/2013 | Tholkes | A47C 9/02 | 280/47.4 |
| 8,596,599 | B1 * | 12/2013 | Carson | B60R 11/0235 | 211/26 |
| 8,939,500 | B2 * | 1/2015 | Voigt | A47B 83/02 | 297/170 |
| 2006/0119233 | A1 * | 6/2006 | Thomas | A47B 21/00 | 312/235.9 |
| 2007/0035164 | A1 * | 2/2007 | North | A47C 1/0242 | 297/217.1 |
| 2007/0278834 | A1 | 12/2007 | Kielland | | |
| 2008/0164737 | A1 * | 7/2008 | Fowlds | A47C 1/035 | 297/284.4 |
| 2010/0194155 | A1 * | 8/2010 | Dankovich | A47B 83/001 | 297/188.21 |
| 2010/0201165 | A1 * | 8/2010 | Dankovich | A47B 83/001 | 297/135 |
| 2011/0031788 | A1 * | 2/2011 | Kosik | A47C 3/0257 | 297/217.3 |
| 2013/0134744 | A1 * | 5/2013 | Dehli | A47C 7/72 | 297/173 |
| 2014/0225402 | A1 * | 8/2014 | Dehli | A47C 7/70 | 297/173 |
| 2014/0306075 | A1 * | 10/2014 | Stieler | A47C 7/70 | 248/176.3 |

OTHER PUBLICATIONS https://www.mwelab.com/index.php/en/2015.

* cited by examiner

10

| zone | sitting zone 14 | transition zone 18 | reclining zone 22 |
|---|---|---|---|
| approximate range of trunk angle (0 = upright) (back rest) 12 | 0 to 35 degrees +/– 10 degrees 16 | 35 to 45 degrees back +/– 10 degrees 20 | 45 degrees (+/– 10 degrees) to 90 degrees 24 |
| neck to ground angle (head rest) 26 | approximately constant at 90 deg relative to floor 28 | rotates up approximately 20 deg as seat back moves 10 degree 30 | fixed to seat back 32 |
| forearm angle (arm rest) 34 | remains approximately level with the ground 36 | rotates up approximately 20 deg as seat back moves back 10 degree 38 | fixed to seat back 40 |
| general monitor motion 42 | moves down and back 44 | moves rapidly up and back 46 | moves gradually up and back 48 |
| general description of input device motion 50 | moves down and back, but not as far as the monitor 52 | follows monitor 54 | follows monitor 56 |
| monitor rotation axis and translation 58 | does not rotate, follows the "effective pivot point between head and neck" down and back 60 | rotates upward and follows the "effective pivot point between head and neck" down and back 62 | rotates about the "effective pivot point between the thigh and trunk" 64 |
| input device rotation axis and translation 66 | does not rotate, translates with the "elbow pivot" down and back 68 | rotates upward and follows the "elbow point" down and back 70 | rotates about the "effective pivot point between the thigh and trunk" 72 |
| head rest 74 | forward to support head weight 76 | pulling back 78 | pulled back to allow head to be level 80 |

FIG. 5

ERGONOMIC PRODUCTIVITY WORKSTATION HAVING COORDINATED AND HARMONIZED MOVEMENT OF HEAD REST, BACKREST, SEAT, LEG REST, ARM RESTS, MONITOR SUPPORT, AND WORK TRAYS THROUGH SITTING, STANDING, AND RECLINING CONFIGURATIONS

CROSS REFERENCES TO RELATED APPLICATIONS

The present application is a continuation of U.S. Utility patent application Ser. No. 14/216,426, filed Mar. 17, 2014, now U.S. Pat. No. 8,989,500, issued Jan. 27, 2015, which in turn claims the benefit of United States Provisional Patent Application No. 61/800,457, filed Mar. 15, 2013.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to computer workstations, and more particularly to adjustable workstations designed to promote an ergonomically advantageous work environment involving extended interaction with a computer system and screens, and still more particularly to an ergonomic workstation having an adjustable chair, monitor, input device support, and work tray providing coordinated and harmonized movement: of a head rest, back rest, seat, leg rest, arm rests, monitor support, input device support, and work tray, through a variety of configurations, including standing, sitting, and reclining.

2. Background Discussion

Increasingly both vocations and avocations involve spending extended periods of time interacting directly with a computer (and, indirectly, with computers connected through networks) through input devices and a video display typically while sitting at some kind of desk or computer supporting workstation. Hours upon hours are spent in an upright sitting posture, remaining relatively static and perhaps occasionally shifting positions in small and incidental ways, all while staring at a screen and making small repetitive motions of the hands and fingers with the arms and hands and the back and neck held in positions of varying degrees of discomfort and stress. The end result is a growing epidemic of repetitive motion and overuse injuries originating in the workplace. The cost to business in productivity and money is socially and economically significant.

Human factors specialists have been working for the past few decades to develop ergonomic office and residential furniture that reduces or eliminates user fatigue and injury by adapting the workspace to the particular Physical dimensions and preferences of the users and the jobs. Aside from injury prevention, it is also hoped that worker productivity and morale will increase. In the residential and recreational setting, it is hoped that comfort, gaming versatility, and gaming performance will be enhanced.

To address the foregoing concerns, several ergonomic workstations and workstation components have been designed. Among them:

U.S. Pat. No. 7,322,653, to Dragusin, teaches a chair suitable for a video gaming and computer workstation that includes a vertically adjustable undercarriage; a tillable seat; and tillable backrest that can be moved independently of the seat, wherein when the backrest is tilted backward, the seat is moved forward and a back end of the seat is tilts down one distance and a front end of the seat tilts down a second distance, and vice versa when the backrest is tilted forward. Tilting mechanisms are also provided for peripheral devices on a support assembly, but no coordinated movement of the seat and support assembly is provided.

U.S. Pat. Appl. No. 2007/0278834, by Kielland, discloses a workstation having a base, a working platform and a supporting member between the base and the working platform for use with an ergonomically adjustable chair. The workstation includes a pair of leg rests adjustably fixed to the supporting member such that the user can hilly extend and support their legs in a comfortable manner. The angle and position of the working platform and leg rests are adjusted in concert with adjustments to the chair's height and seating angle to optimize the user's posture while operating a computer.

U.S. Pat. No. 7,922,249, to Marchand, describes a modular office desk and chair set embedded in a variable angular positioning mechanism. The mechanism enables a user to define the required angle of tilting of which the desk and chair are set, and other angular positioning and positioning of each element of the workstation in relation to other elements may be set. thus the proposed invention provides the user with multiple levels of freedom in multiple directions to achieve customization of the orientation and position of the workstation.

U.S. Pat. No. 6,092,868 to Wynn, discloses a computer work station including a reclining chair with a back rest, a seat, a leg rest, and a pair of arm rests, supported on a support base. A computer is mounted to the chair and each of the arm rests has a key pad swivelably attached thereto for controlling the computer. A monitor is pivotally connected to the back rest and is electrically connected to the computer for displaying visual images from the computer.

And U.S. Pat. No. 7,887,130 to Zvolena, teaches a workstation including a chair and operator equipment that move together in a pivoting motion through an automatic, time-controlled program, in which an orientation of the chair relative to the operator equipment is maintained during the pivoting motion.

In addition to the devices described in the foregoing patents, many, if not all of which have never been seen in the public marketplace or otherwise commercialized, there are a number of ergonomic workstations that have at least gestured in the general direction taken by the instant invention. Among them are included the Nethrone (Classic) Workstation, by Nethrone of Herzelyah, Israel. This workstation includes a massage chair with a seat adjustably and slidably mounted on arcuate rails and having a tiltable backrest. The video display is also mounted on an arcuate scaffold and can be adjusted vertically and tilted to harmonize with the adjustments of the seat and backrest. All adjustments, however, are manual and independent of one another.

The iClubby workstation by Gravitonus, Inc., of Fairfax, Va., is a computer workstation with a seat, display support, keyboard and input tray, and armrests, all mourned on a vertically oriented ring and all of which can be rotated or tilted, including into reclining positions, with all seating and workspace surfaces and elements moving in concert.

The Emperor 1510 and Emperor 200 workstations by MWE Lab of Quebec, QC, Canada. each provide independent and coordinated, monitor and seat adjustment. Configurations range from a fully upright sitting position to a fully reclined or supine position. The systems are prohibitively expensive, however, the former costing approximately $6,000 and the latter $50,000 at the time of this writing.

Without question each of the foregoing products would be characterized as high end, luxury workstations, and most would be considered exotic (and possibly ostentatious) by most consumers. Some provide a wide range of positions, from seated to reclined, but none fully coordinate the movements of the user, the monitor(s), the input devices, and the workspace, while truly enabling the user to achieve a fully reclined position as well as a fully standing position. In fact, to achieve coordinated movement of the various workstation apparatus, the prior art devices essentially keep users in a fixed posture, generally suitable for sitting and reclining slightly, but unsound ergonomically for a fully reclined position. Moreover, in even the most upright positions, these products give the impression of being somewhat recreational in nature: when a user achieves a semi-reclined or reclined position, it appears as if they are engaged in a leisurely activity, and it can feel similarly to the user. Some of this relates to the design choices made by the product designers; some, however, is inherent in the technical features of the workstation chairs. That is, they tend to depart dramatically in appearance from conventional task chairs and in their unusual appearance may signify either luxury or recreation or both, and as such they are certain to meet with resistance from department managers and others in office settings responsible for furniture purchasing decisions. Even if a workstation were truly successful in enhancing productivity, companies simply do not want to suggest to their employees or to visiting colleagues that workers are at leisure in the company workplace.

The present invention provides functionality and versatility beyond that offered by any of the prior art products mentioned above, and at a price substantially lower. Further, it does so without creating the appearance of either luxury or leisure. It achieves this by using the general design of a task chair for the seating portion of the inventive workstation.

It will be appreciated from the foregoing that ergonomic workstations have been fashioned in a number of different ways, with a principal focus variously placed on seating, desk apparatus, computer peripheral mounting and adjustment systems, or some combination thereof. None of the extant systems—including each of the exemplary systems referenced and described above, whether only a paper prototype in the form of a patent disclosure or an actual product in the marketplace—provides the features achieved by the workstation of the present invention. Specifically, no known system enables a user, without the assistance of other apparatus and without considerable expenditure of time, to adjust the workstation to configure it for work while sitting, standing, reclining, or collaborating with one or more colleagues standing at the side of the workstation, and to do so while maintaining an optimally ergonomic relationship between the user and various input devices and with more than one video display monitor.

The foregoing patents, patent applications, and commercially available products reflect the current state of the art of which the present inventors are aware. Reference to, and discussion of, these references is intended to aid in discharging. Applicants' acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention is the concrete distillation and synthesis of numerous insights obtained from a lengthy and detailed study of how users interact with computer peripherals at computer workstations. The result is an ergonomic workstation that provides users with a very natural feel throughout as broad range of positions and postures. The inventive apparatus includes an adjustable task seat (including a seat bottom, back rest, head rest, leg rest and, optionally, arm rests), as well as monitor and work tray supports, all of which move in a highly coordinated and harmonized fashion in relation to a user's head and arms through a. variety of configurations, including standing, sitting, and reclining. In a first preferred embodiment, the inventive workstation employs a single arm on which to mount and support workstation monitors, keyboard trays, and mini-desk work surface. In a second preferred embodiment, the monitors are disposed on a first support arm and the input device trays and any work surfaces are disposed on a second support arm.

In each of the preferred embodiments of the invention, the workstation operates to establish and preserve an optimal kinematic relationship between the body and the workstation throughout a range of working positions (synonymously referred to herein as "zones of operation" or "operative zones"). To accomplish the desired motions, the pivot axes of 4-bar mechanical linkages on the workstation are configured to be in close alignment with corresponding effective pivot points (or axes) of rotation on the human body. A first axis on the workstation is that of the seat back and seat bottom. These share an axis of rotation that is closely aligned with the effective trunk/thigh pivot axis of the body which passes approximately through the center of the hip joint femoral head (and may thus be referred to variously herein as either the "effective hip axis" or "the seat back axis"). A second axis on the workstation is a monitor/seat back rotation axis, which is closely or generally aligned, with the effective head/trunk pivot axis of the body, found in testing to pass approximately through the spine at approximately C7, in close alignment with a axis passing through the gleno-humeral joint at the shoulder (and may thus be referred to variously herein as either the "head rotation axis" or the "shoulder pivot axis" or the "monitor axis". A third axis is that of the input device support tray/seat back rotation axis, and this is closely aligned with the effective forearm/trunk pivot axis of the body, which passes approximately through the center of the elbow joint capitulum when the arm is relaxed at the side of the body (and may thus be referred to variously herein as either the "elbow axis" or the "input device tray axis").

Alignment or coupling of the workstation and anatomical axes is accomplished by locating workstation pivot hardware substantially at the level of, and generally passing through (in close alignment with) the axes. This is established in a purely mechanical fashion in the second preferred embodiment, discussed below. It is also accomplished by producing virtual pivot axes, as is in the first preferred embodiment, as discussed in detail below.

It is thus a first and principal object and advantage of the present invention that it provides continuous comfort for the user, from the user's standing position to a fully reclined position.

It is another object of the present invention to provide a workstation that moves through a broad range of functional positions while maintaining a fixed eye-to-monitor distance and fixed angle between the user's head and the monitor throughout a significant portion of the workstation range of motion, and a fixed distance from the user's elbow to an input device throughout the entire range of motion.

It is another object of the present invention to provide an improved workstation that increases productivity by increasing comfort during use over long periods of time.

A further object or feature of the present invention is to provide an improved workstation that permits the user and a colleague to collaborate at the workstation (use concurrently) by allowing the user and colleague to easily view the user's workstation monitor or monitors while the primary user continues to interact with the input devices.

An even further object of the present invention is to provide an improved workstation that meets the foregoing objects and advantages in a size compact enough to be suitable for standard office use.

Yet another object and advantage of the present invention is that it provides coordinated and harmonized movement of the head rest, back rest, seat bottom, foot and leg rest, arm rests (optionally), monitor, and keyboard tray; "coordinated and harmonized movement" meaning that these structures all move together so as to maintain an ergonomically optimal position for the user, whether in the standing, sitting, reclining, or collaboration configuration.

It is still another object and advantage of the present invention that at the user's option, a primary monitor can be set to adjust in coordination with adjustments to the other workstation features, while a secondary monitor can remain independently adjustable.

A still further object and advantage of the present invention is that it provides a vertical arm or arms supporting the monitor and keyboard trays that not only tilts for adjustment relative to the user, but also pivots in a horizontal plane to allow easy mounting and dismounting of the seat and to facilitate the collaboration configuration.

An even further object and advantage, in keeping with the goal of providing a workstation for use in a conventional office setting, is to provide a workstation chair having a retractable/foldable leg rest that at least partially folds beneath the seat, resulting in a footprint comparable to a task chair, yet also provides full length or partial leg support when in sitting and reclined positions, according to user preferences.

A still further object of the present invention, one clearly distinguishing over all known prior art devices, is to provide coordinated and harmonized motion of the seat back, seat bottom, monitor supports, and input device support and work tray, through a range of seating/postural zones, wherein the ratios of movement of the elements in relation to one another changes in the various zones so as to maintain optimally ergonomic positioning.

It is still another object of the present invention to provide all of the above-indicated functions and features through either purely mechanical means or using programmable (software, electrical, or other) control.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims, which will be filed with a non-provisional patent application claiming the benefit of the filing date of the instant application.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways.

Also, it is to be understood that the terminology and phraseology employed herein are for descriptive purposes only, and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention. Rather, the fundamental aspects of the invention, along with the various features and structures that characterize the invention, are pointed out with particularity in the claims annexed to and firming a part of this disclosure. For a better understanding of the present invention, its advantages and the specific objects attained by its uses, reference should be made to the accompanying drawings and descriptive matter in which there are illustrated the preferred embodiment.

BRIEF DESCRIPTION OF THE DRAWINGS

The invention will be better understood and objects other than those set forth above Will become apparent when consideration is given to the following detailed description thereof. Such description makes reference to the annexed drawings wherein:

FIG. 5 is a table summarizing the relative motions of the body, monitor, and input device support tray through the zones of operation;

Figure 35:
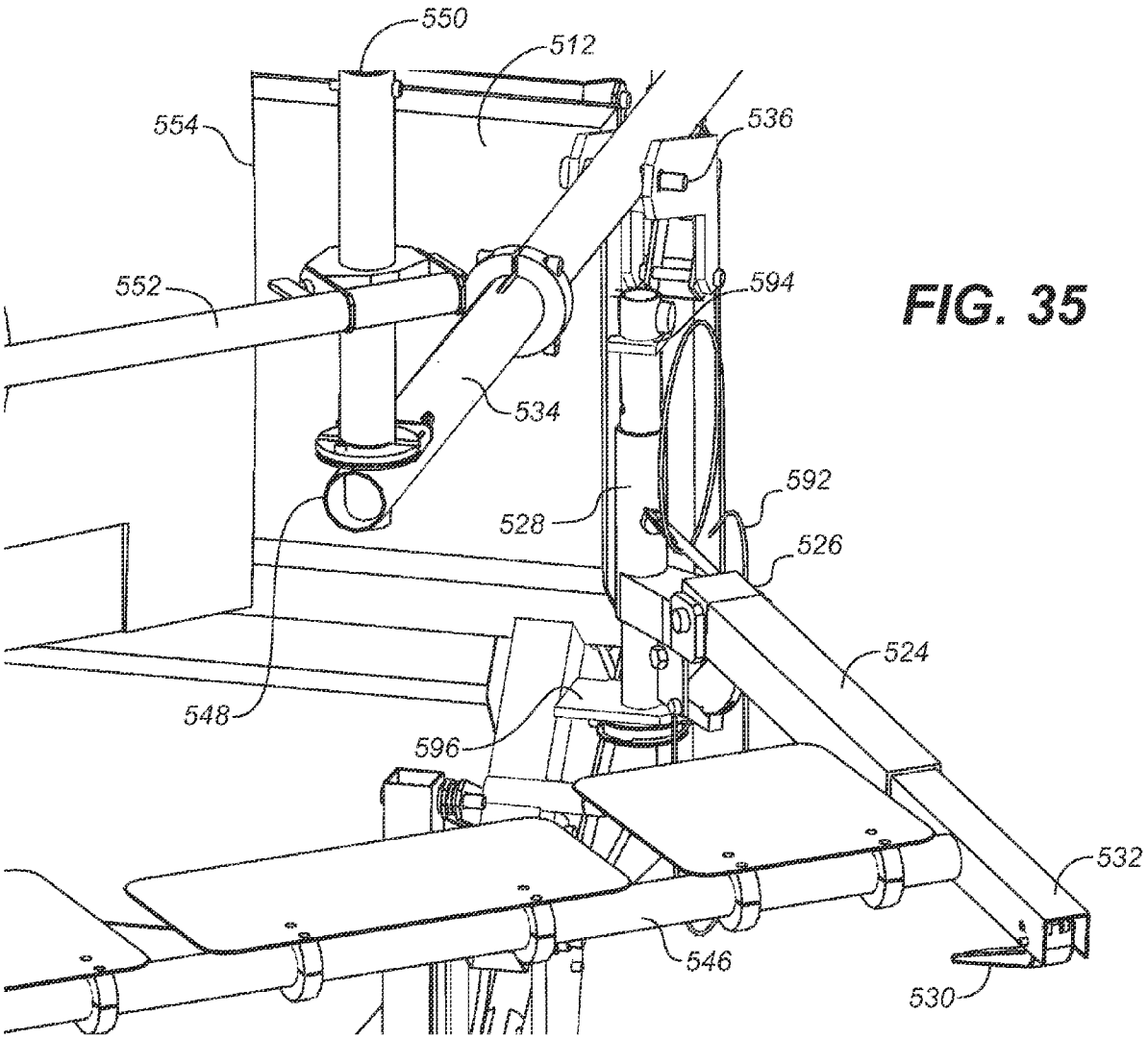
Figure 36:
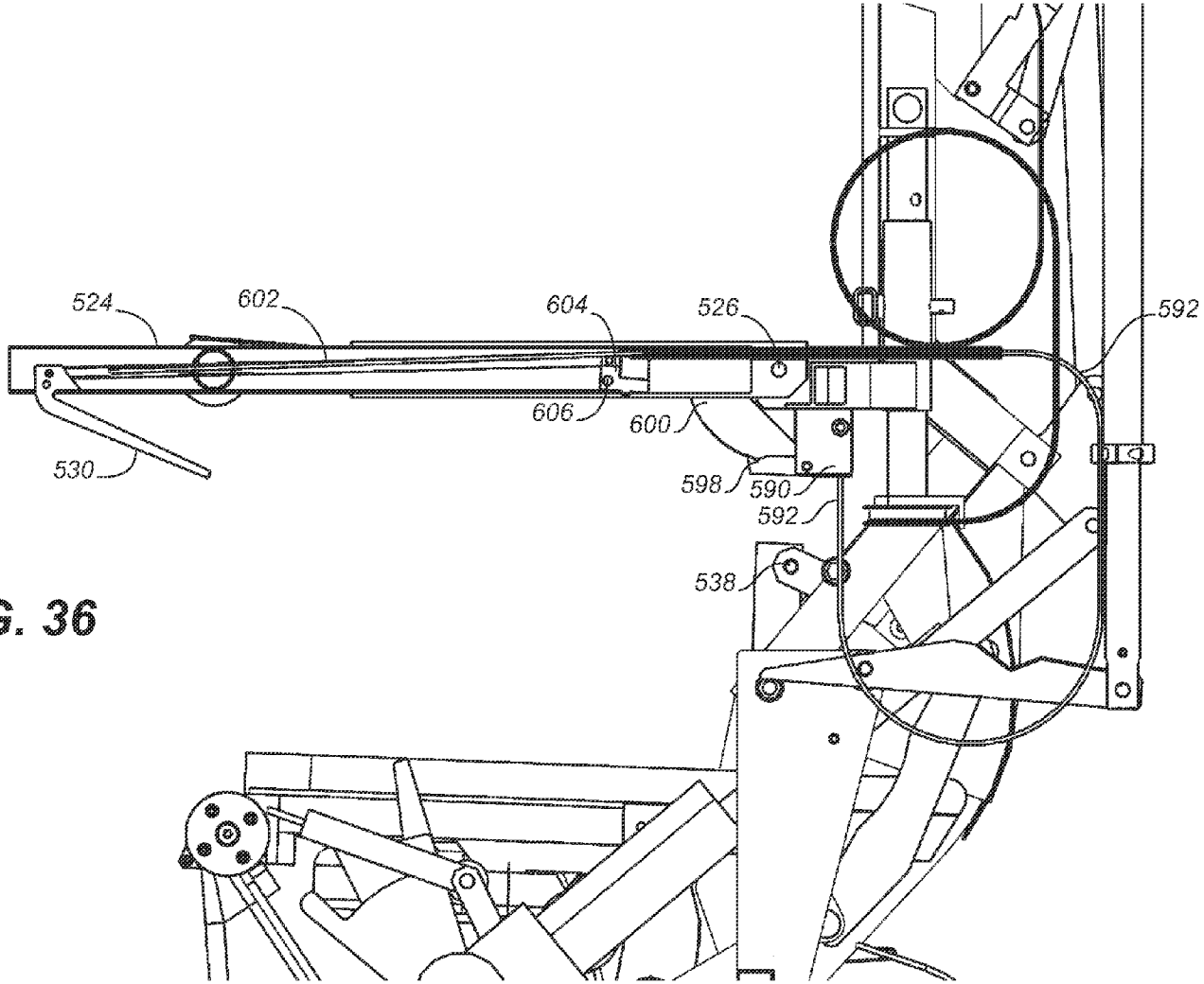
Figure 37:
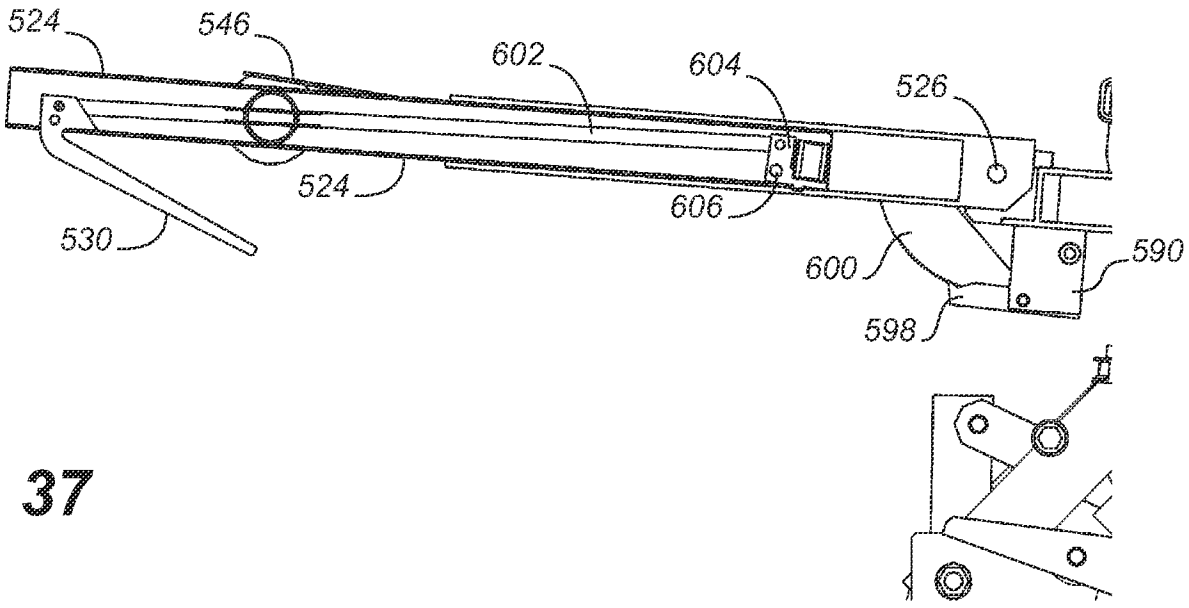
Figure 38A:
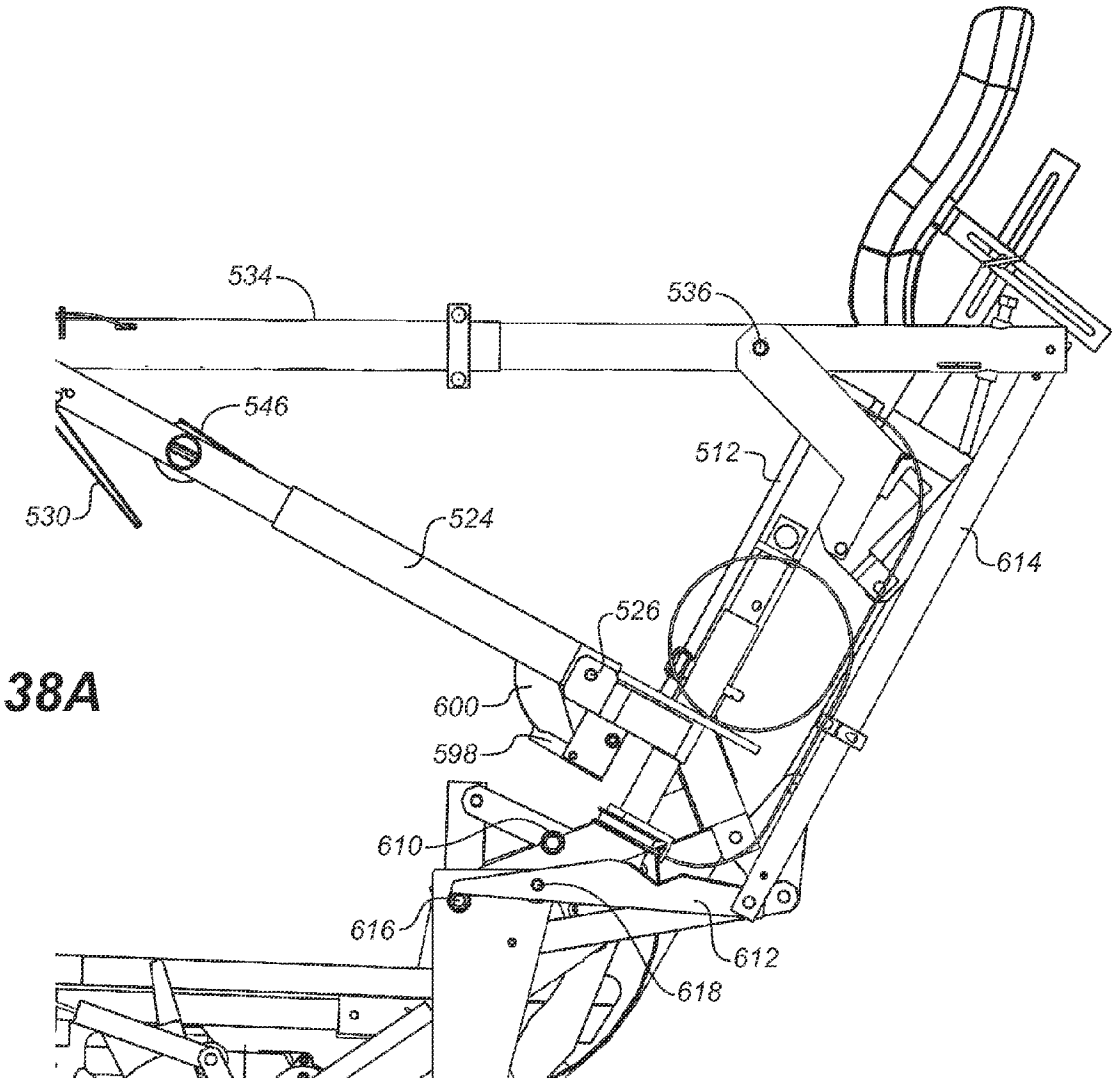
Figure 38B:
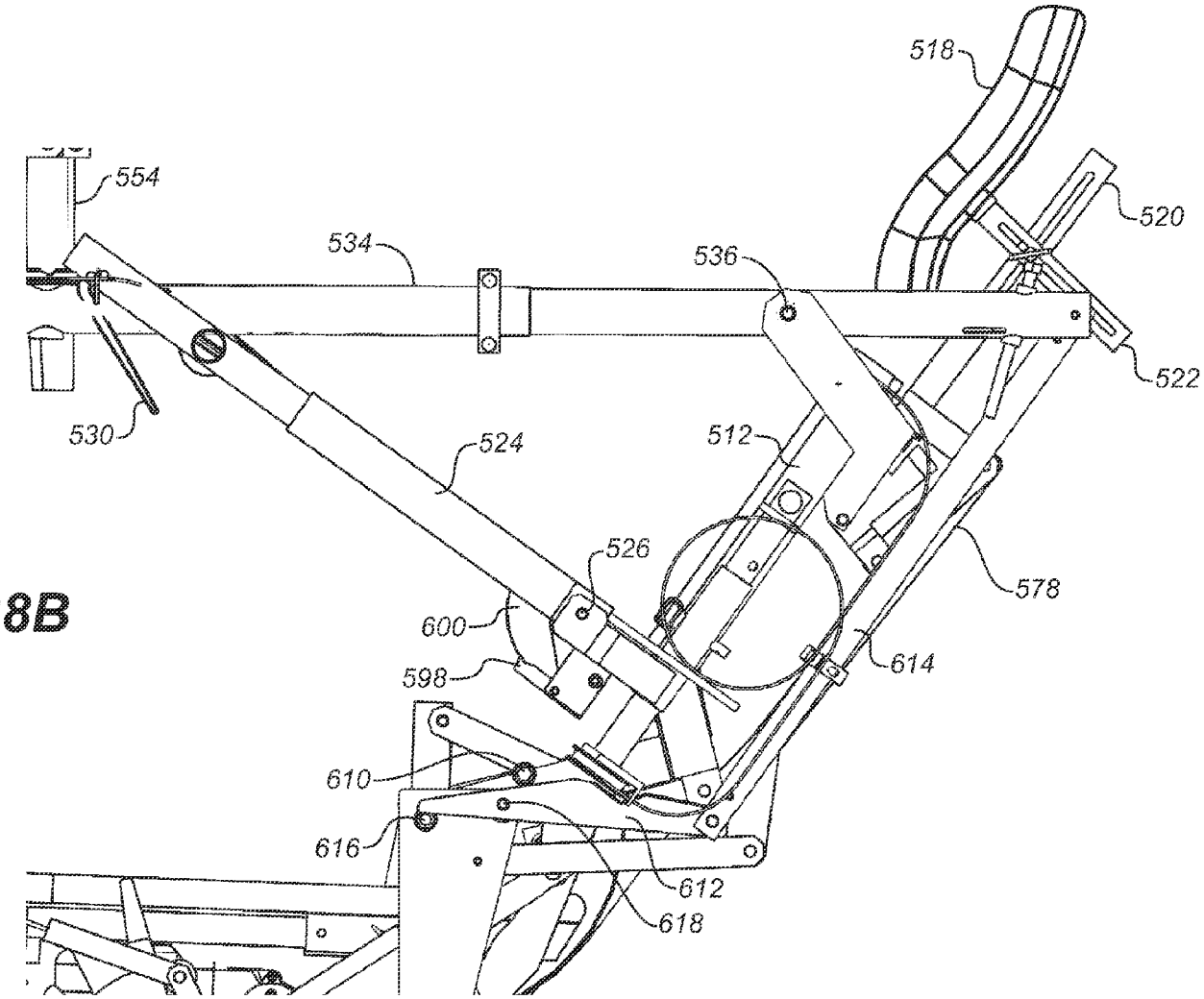
Figure 38C:
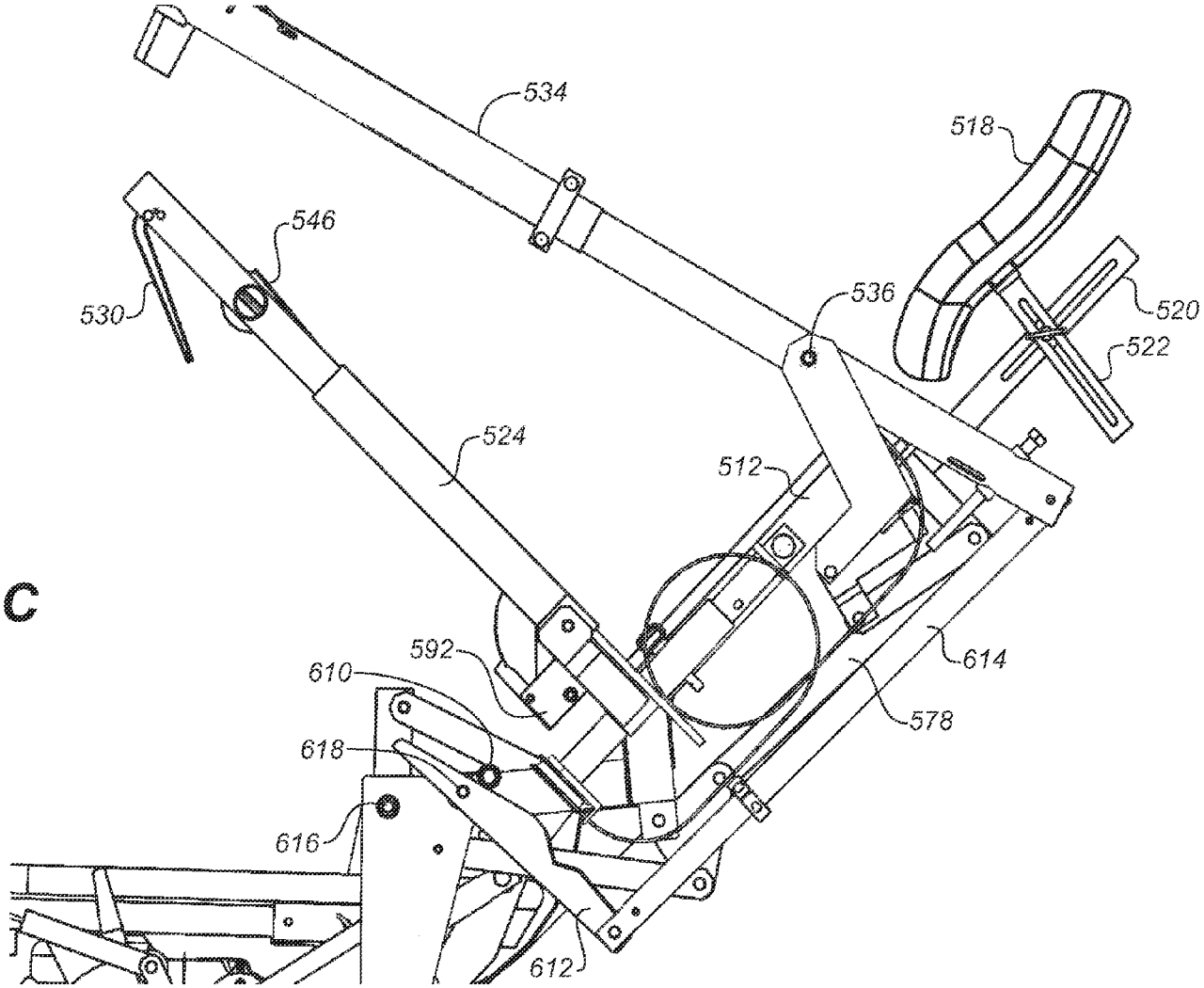
Figure 39:
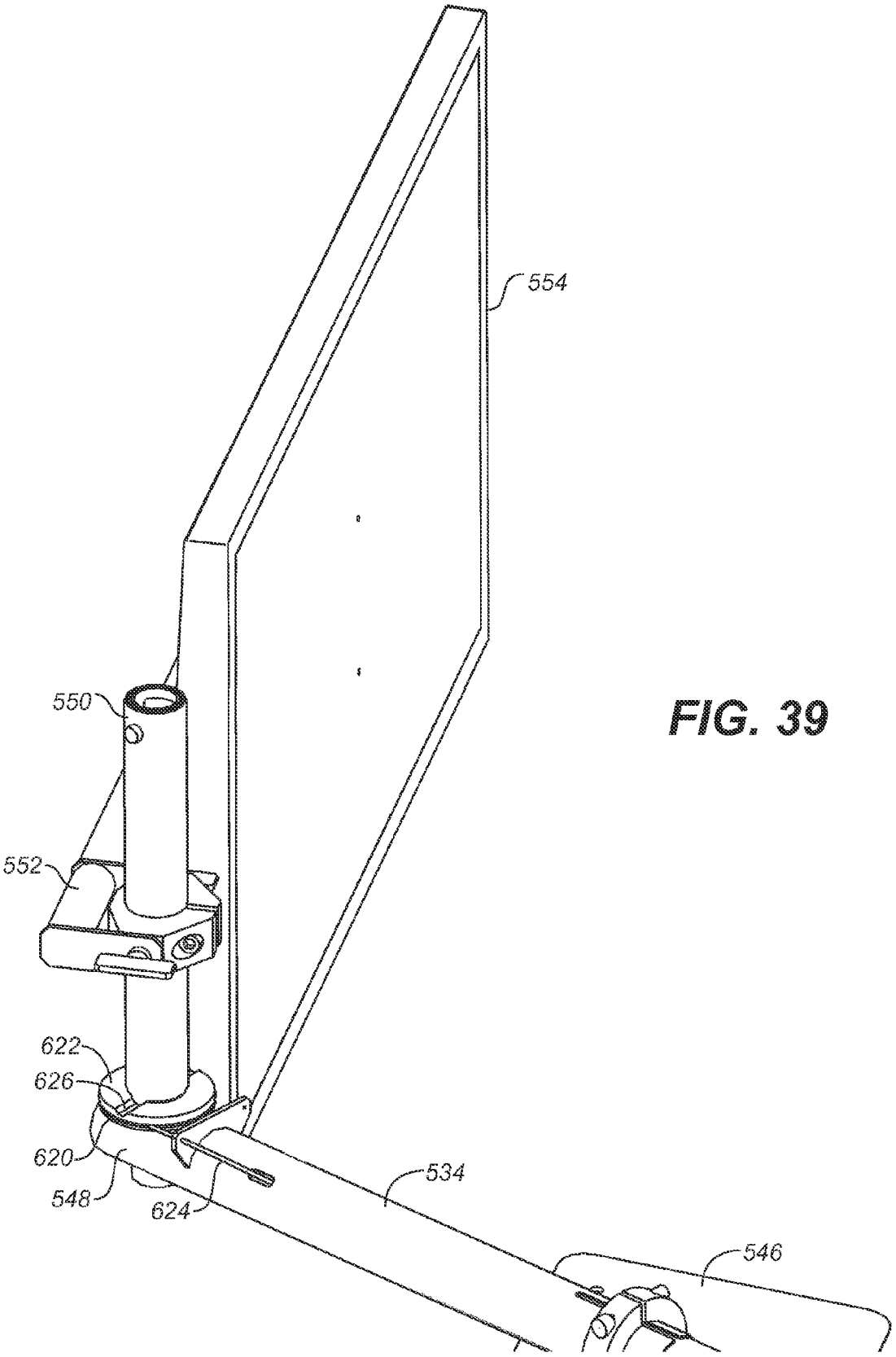
Figure 40:
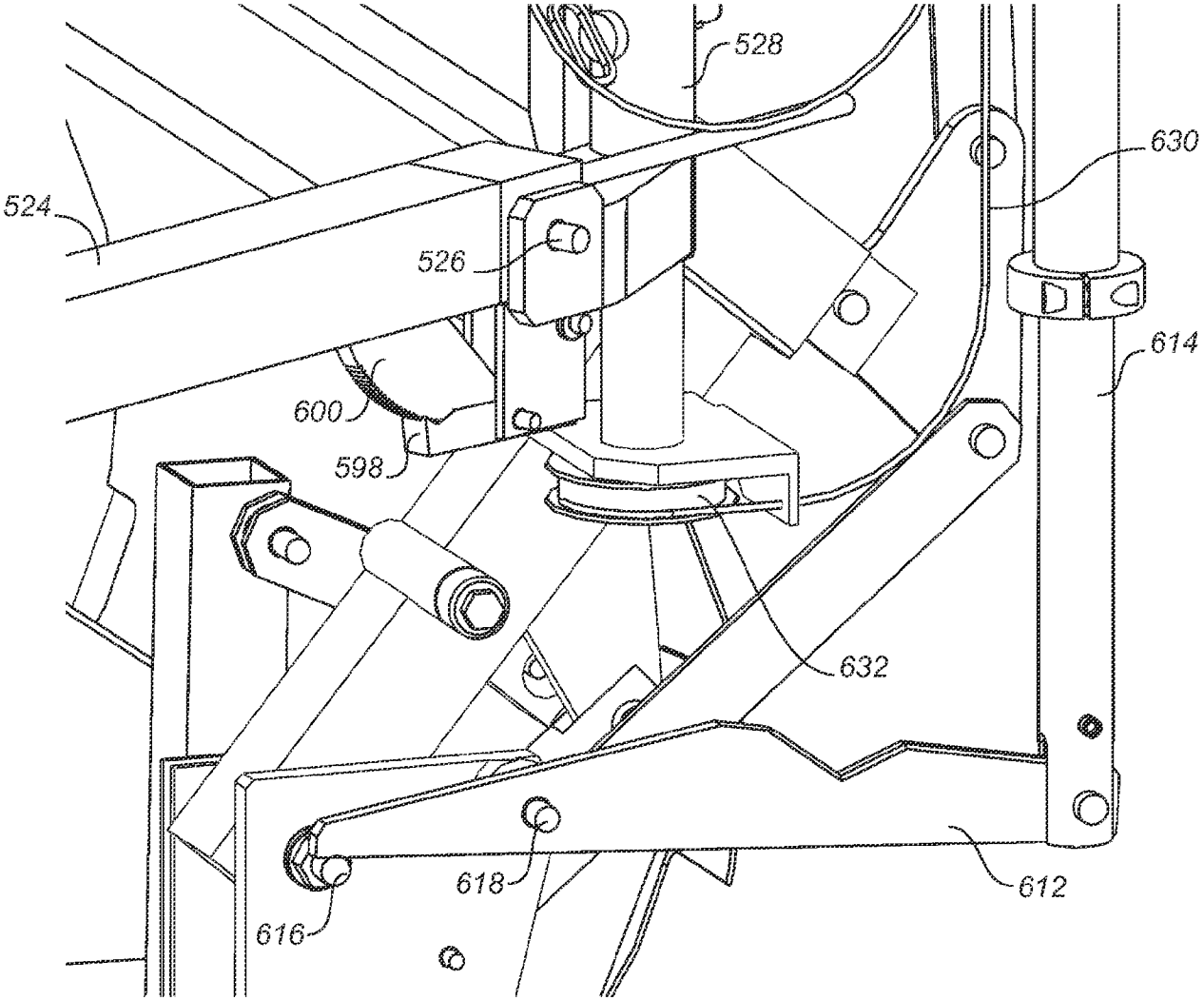

FM. 34B is a top plan view showing the mounting/dismounting configuration;

FIG. 35 is a front right perspective view showing details of the input device arm controls;

FIG. 36 is a detailed partial cross-sectional right side view in elevation showing the input device arm unlock mechanism;

FIG. 37 is a right side view in elevation showing further details of the input device arm unlock mechanism;

FIG. 38A is a right side view in elevation showing the operation of the monitor arm cam, this view shown with the features in the sitting zone of operation;

FIG. 38B is a right side view in elevation showing the operation of the monitor arm cam, this view shown with the backrest at the extreme range of the sitting zone and on the threshold of the transition zone;

FIG. 38C is a right side view in elevation showing the operation of the monitor arm cam, this view shown with the features at the end of the transition zone and entering into the reclining zone;

FIG. 39 is an upper right rear view showing detail of the cable drive linking the monitor and input arms; and FIG. 40 is an upper right &out view showing detail of the cable drive linking the monitor and input arms.

DETAILED DESCRIPTION OF THE INVENTION

Referring first to FIGS. 1 through 24B, wherein like reference numerals refer to like components in the various views, there is illustrated therein a first preferred embodiment of a new and improved ergonomic productivity workstation, generally denominated 100 herein.

Turning initially to the general views, FIGS. 1-2, and 11-12, the figures collectively show that the inventive workstation is an integrated and standalone system that includes a task seat 102 slidably and adjustably mounted on a vertical support 104 affixed to an asymmetrical four-point base 106. The base includes at base cross bar 108, right and left rear legs, 110, 112, and right and left front legs 114, 116. The right front leg 114 is preferably longer than the other legs in order to provide support to loads cantilevered outwardly from a horizontal monitor arm 118, cantilevered away from the top of the vertical support 104 and having a long moment arm. In contrast, the left front leg 116 is relatively short to prevent a user from stumbling, and generally to facilitate mounting and dismounting the workstation. The legs do not extend beyond the footprint of the workstation in the recline position (discussed extensively below). The base is completed by a set of four casters 120, one each swivelingly affixed to an end of a base leg.

The task seat includes a seat bottom 122, a seat back 124 having a unique seat back pinch guard 125, a three-panel leg rest 126, and a headrest 128. A headrest pull-back mechanism 130 is disposed on the back side 132 of the seat back 124, and the head rest is operatively coupled to the head rest pull-back mechanism through an adjustable head rest support 131.

As indicated, a horizontal monitor arm 118 extends forwardly from the top of the vertical support 104. It is pivotally connected to the vertical support at its proximal end 134. Pivotally attached to the distal end 136 of the horizontal monitor arm is a vertical monitor arm 138, having an upper support bracket 140 proximate its terminal end 142, on which are pivotally and adjustably disposed a primary monitor 144 and a secondary monitor 146. A medial support bracket 148 provides for a pivotal connection of a mini-desk 150 and one or more input device trays 152, such as a keyboard tray 152*a*, and mouse trays 152*b*.

Figure 1:
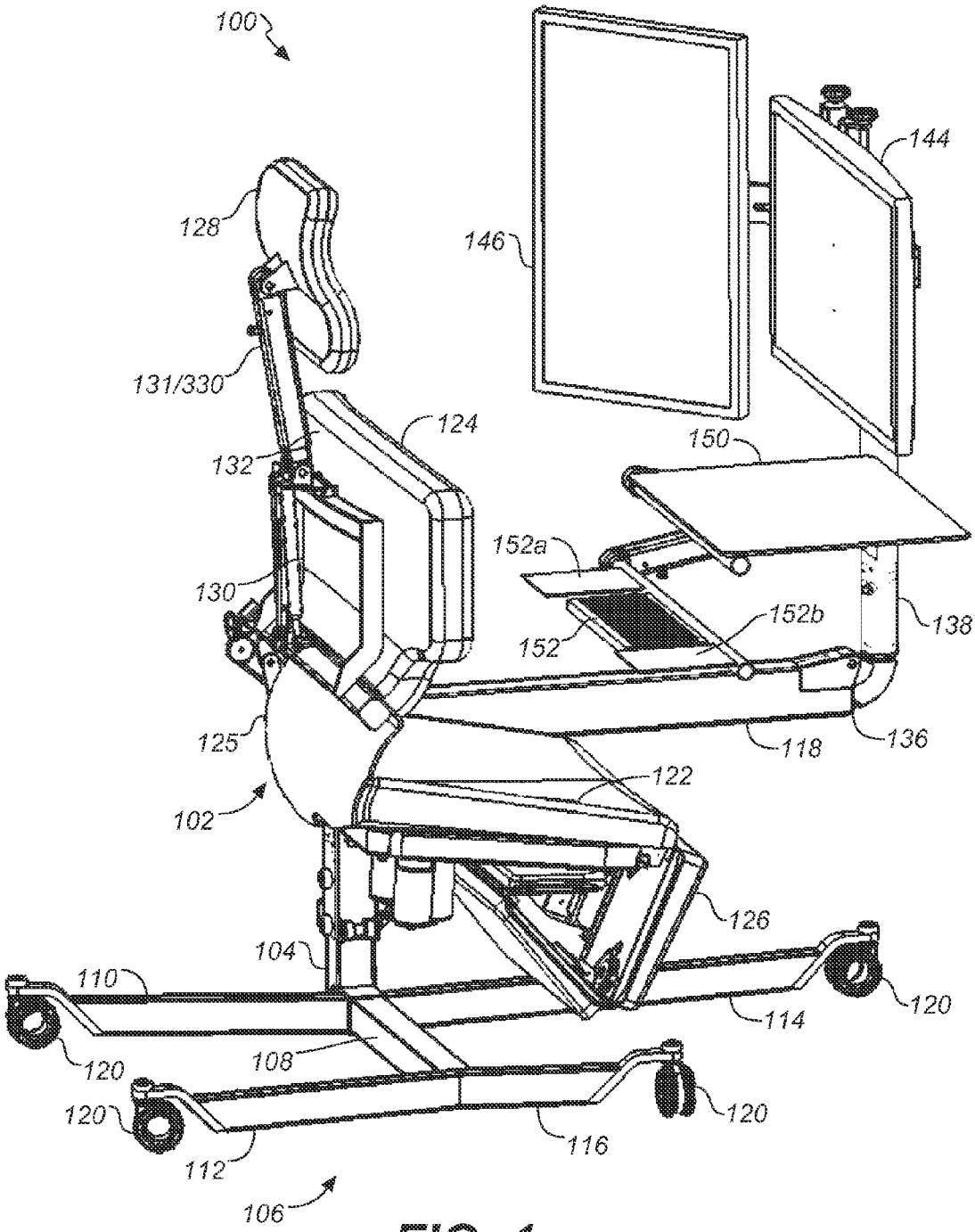
FIG. 1 is an upper left rear perspective view of a first preferred embodiment of the ergonomic productivity workstation of the present invention.
Figure 2:
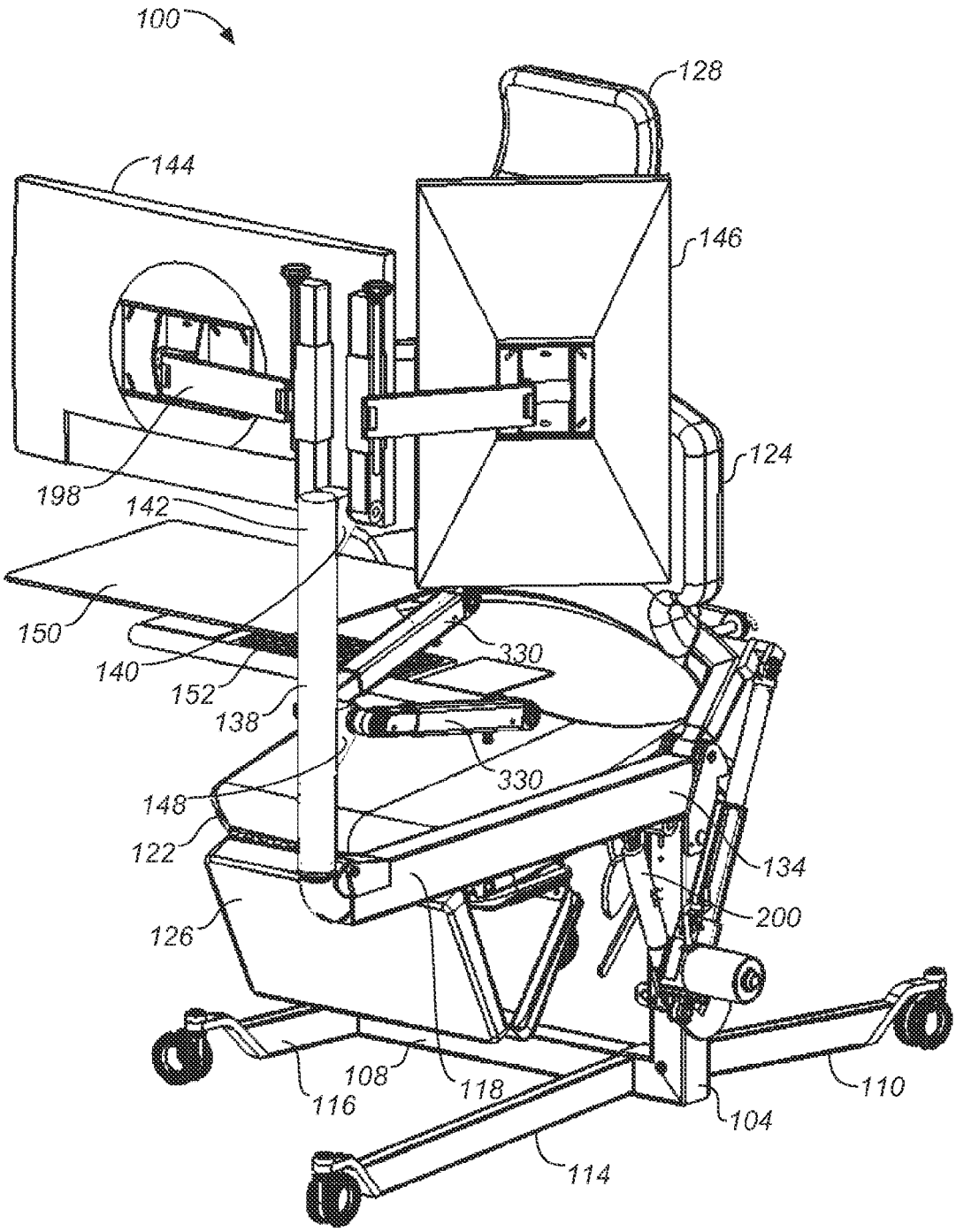
FIG. 2 is an upper front right perspective view thereof.
Figure 3:
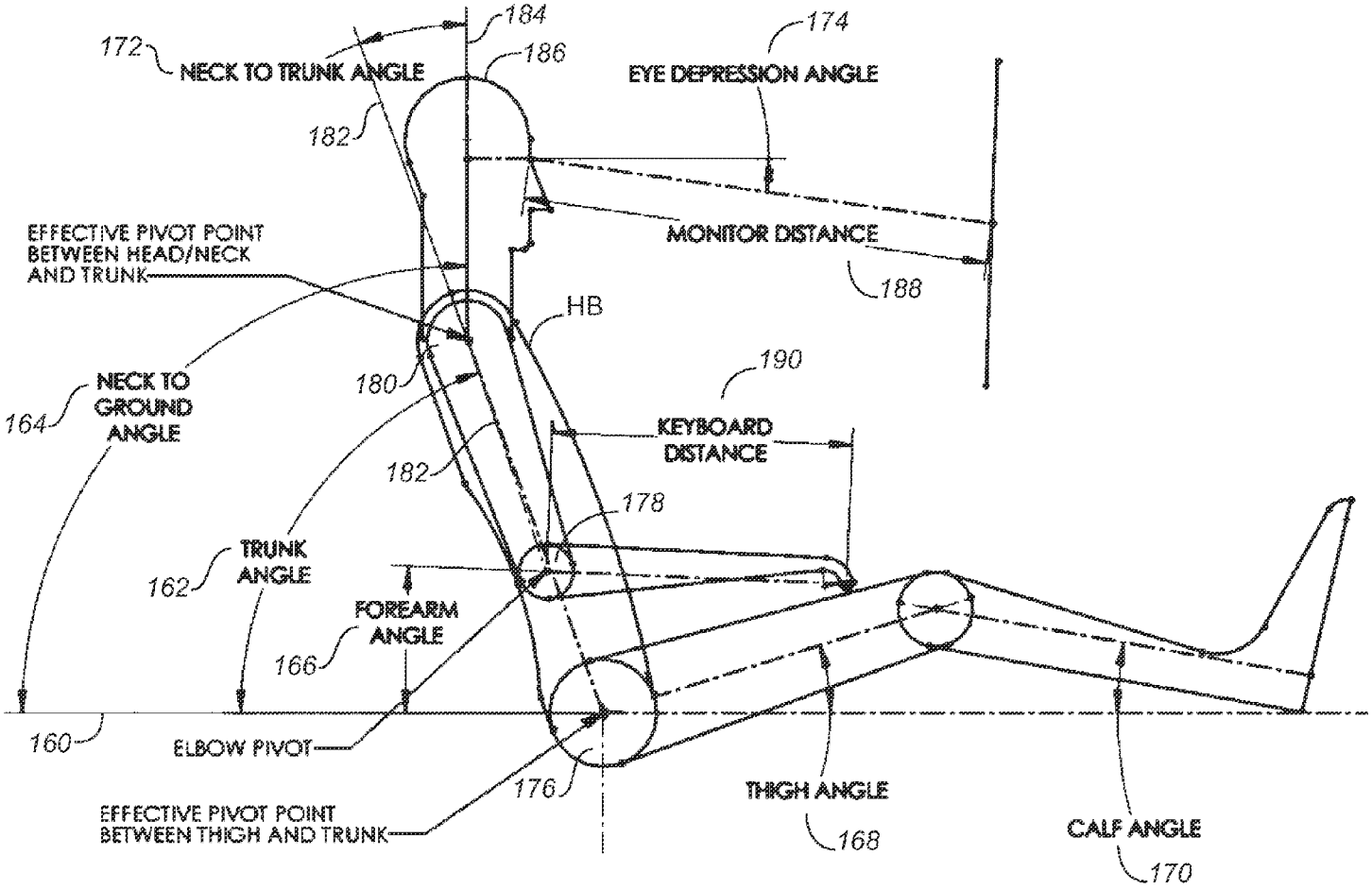
FIG. 3 is a schematic side view in elevation illustrating features and terminology used in the description herein to describe the desired motions in the ergonomic workstation of the present invention.
Figure 4:
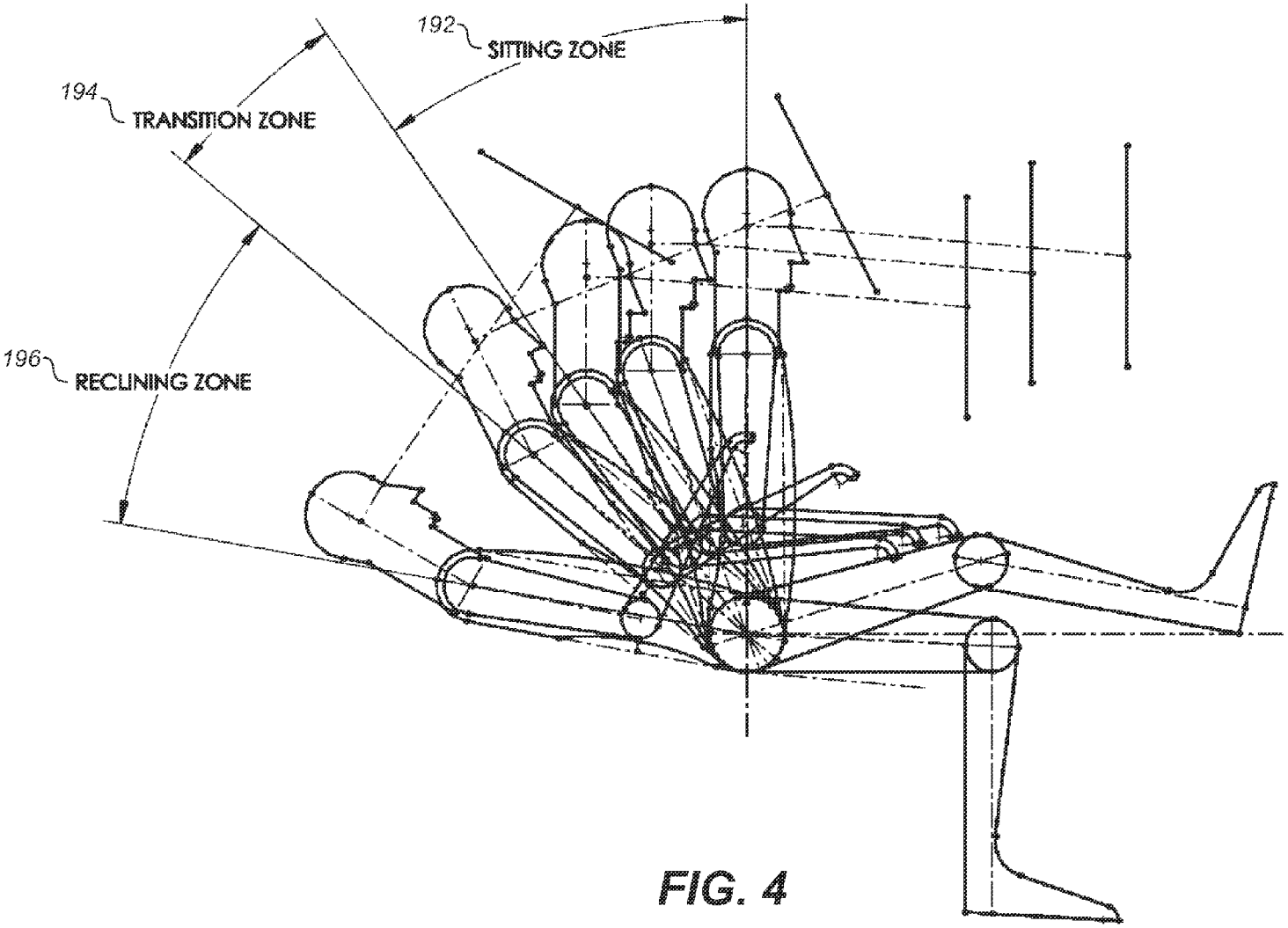
FIG. 4 is a schematic side view in elevation showing the three zones of operation for the present invention.

Turning next to FIGS. 3-5, there is shown in schematic and table form the critical points about which data was gathered during field testing of the inventive apparatus and its many experimental iterations. For purposes of devising an ergonomically sound workstation, three critical pivots points and seven angles are considered. Referring now specifically to FIG. 3, using a horizontal datum reference plane 160, a user HB is considered to have a trunk angle 162, a neck-to-ground angle 164, a forearm angle 166, a thigh angle 168, calf angle 170, neck-to-trunk angle 172, and eye depression angle 174 (measured to the center of the monitor).

The reference pivot axes include the femoral-acetabular joint at the hip 176 (which may be referred to herein either as the "hip axis" or the "seat back axis"), the humeral-ulnar joint at the elbow 178 (which may also be referred to as the "elbow axis" or the "input device tray axis"), and the gleno-humeral joint at the shoulder 180 (which may be referred to as "the monitor axis" or "the shoulder axis"). The datum reference line for the trunk angle 162 is a trunk line 182 extending through the gleno-humeral joint 180 and the femoral-acetabular joint 176. The datum reference line 184 for the neck-to-trunk angle 172 is an imaginary line from the crown 186 of the head through the horizontal axis through the effective pivot axis 180, which, for purposes of the instant application, is considered to be generally coincident with a horizontal line running transversely through the gleno-humeral joint comprising each shoulder of a user of average size. Critical distances include the monitor-to-eye distance 188 and the keyboard distance 190, both of which are typically set by the user after initially settling into the workstation upon mounting it. Note should be made that the monitor-to-eye distance 188 is shown here as extending to the datum reference line 184 for the neck-to-trunk angle 172; this is for simplicity in the views. The essential feature and concept is that once the distance and angle from the monitor to a reference point in the user's head is set by the user, the monitor axis and input device tray axis (shoulder and elbow axes) of rotation are set, and neither the angle of, nor the distance from, those axes to the monitor or input device tray will change as the workstation is moved through its operational zones.

FIG. 4 shows the zones of operation, and the table 10 of FIG. 5 correlates the above-identified reference points to the various zones of operation. FIG. 5 also describes the novel kinds of motions made possible by the workstation configuration. By reference to the table of FIG. 5, it can be seen that the approximate range of the trunk angle 12 for a typical user in the sitting zone 14 (corresponding to 192 in FIG. 4), and as correlated, to the back rest angle, is from 0 to between 35 degrees (+/− 10 degrees) 16; for the transition zone 18 (corresponding to 194 in FIG. 4), that angle is between 35 and 45 degrees, inclusive (+/− 10 degrees) 20; for the reclining zone 22 (corresponding to 196 in FIG. 4), it is between 45 (+/− 10 degrees) to 90 degrees 24. The neck-to-ground angle 26, correlating to the head rest angle, remains approximately constant relative 28 to the floor in the sitting zone; it rotates up approximately 20 degrees as the seat back moves 10 degrees 30 through the transition zone; and it remains fixed in relation to the seat back 32 in the reclining zone. The forearm angle 34 governed by and associated with the arm rest angle (if included) remains approximately level with (i.e., roughly parallel with) the plane of the ground 36 in the sitting zone; it rotates up approximately 20 degrees as the seat back moves back 10 degrees 38 in the transition zone; and it remains fixed to the seat back in the reclining zone 40. The monitor motion 42 is movement down and back 44 in the sitting zone; rapidly up and back 46 in the transition zone; and gradually up and back 48 in the reclining zone.

Continuing with a survey of the table 10 of FIG. 5, it is seen that the input device motion 50 is down and back, slightly lagging behind the monitor 52 in the sitting zone; generally following the monitor 54 in the transition zone; and generally following the monitor 56 in the reclining zone. The monitor rotation axis and translation 58 does not rotate but follows the effective pivot point between the head and translates down (i.e., down and back) 60 in the sitting zone; it rotates upward and follows the effective pivot point between the head and neck 62 in the transition zone; and it rotates about the effective pivot point between the thigh and trunk 64 in the reclining zone. Next, the input device rotation axis and translation 66 does not rotate but translates with the elbow pivot down and back 68 in the sitting zone; it rotates upward and follows the elbow point down and back 70 through the transition zone; and it rotates about the effective pivot point between the thigh and trunk in the reclining zone 72. Finally, the head rest 74 remains in a forward position and orientation to support head weight 76 in the sitting zone; it pulls back slightly 78 in the transition zone; and it pulls back to allow the head to be level 80 in the reclining zone.

Referring next to FIGS. 6-10, we see that a user moving through the zones of operation is presented with a workstation that cooperates with the user to provide a natural feeling interaction with the station devices. Beginning with FIG. 6, we see a user in as fully upright sitting position and the trunk angle 162 and neck-to-ground angle 164 at essentially normal, or 90 degrees. In this position the head rest does not engage the back of the user's head, as most users consider it unnecessary and uncomfortable.

Note should be made that in the sitting zone there is an important relationship between the trunk and the head. The center of mass of the head is optimally balanced directly above the effective pivot axis between the trunk and head/neck 180. If the head is angled too far forward, extensor muscles in the back of the neck must be contracted (isometrically in a stationary position) to keep the head from falling forward. If the head is angled too far back, flexor muscles in the front of the neck need to be contracted (again, isometrically) to keep the head from falling backward. Because of these potential strains, the body naturally seeks and finds a generally relaxed position as the seat back is tilted back. This is depicted schematically as the "neck-to-ground" angle, which preferably remains substantially static at approximately 90 degrees as the user tilts the seat back in order to keep his head balanced over its optimal support point.

When the user mounts the seat in the workstation, he or she is usually sitting in a fully upright position. In that position he or she will then adjust a monitor to a "monitor distance" and "eye depression angle" according to his preferences and needs. Thereafter, the inventive workstation maintains a constant monitor distance and eye depression angle as the user leans the seat backward and forward. This same coordinated and harmonized movement applies to the input devices (keyboard, pad, mouse, etc), i.e., to the "keyboard distance" and "forearm angle." These, too, are set to suit the user's needs, and again the invention maintains a constant "keyboard distance" and "forearm angle" as the user moves the workstation through the zones of operation in both directions.

As the user tilts the seat back to a reasonably small angle, up to between 35 and 45 degrees, inclusive, for instance (see FIGS. 7-8), most users prefer continuing to provide muscular head support using the neck flexors (longus colli, longus capitis, infra hyoids) as the load is nominal at small angles and the low degree of contraction is easy and comfortable and thus generally obviates any need or desire to have the head supported in any way by a headrest. However, such support is possible and optionally available.

Figure 9:
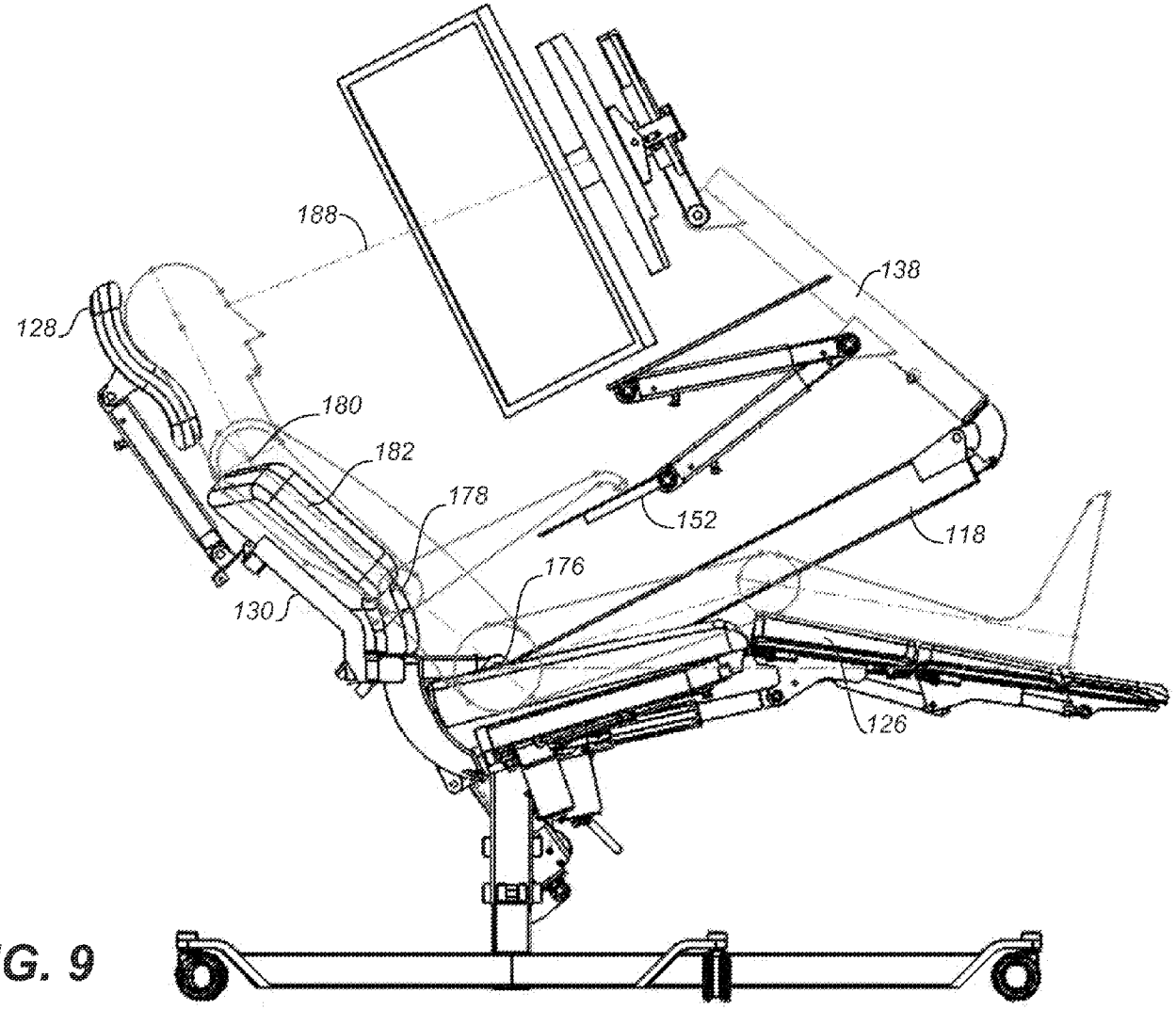
FIG. 9 is a schematic side view in elevation showing a user with the seat back and corresponding device supports tilted back into the beginning of the relining zone, showing as well that both the head rest has moved forward to support the head and the leg rest has deployed for full leg support.

However, when the user transitions fully into the transition zone of operation, FIG. 9, the headrest 128 moves up, actuated by the head rest pull-back mechanism 130, and engages the user's head to provide it with support. This is desirable because as the user continues to lean further back as the seat back tilts, he or she will feel a muscular strain in holding his head in a vertical orientation, and if held long enough and deep enough into the transition zone, he or she will even find his chin begins to get too close to his or her chest. In consequence, the user will prefer to have his or her head supported by the head rest attached to the seat back. This transition normally happens at seat back angles between 35 and 45 degrees from vertical.

When the user finally does lean his or her head back against a head rest, the "neck-to-trunk angle" changes slightly. Then, for the workstation to maintain the user's preferred "monitor distance" and "eye depression angle" the monitor must move up and back, as illustrated in FIG. 9. Additionally, for the keyboard to maintain the optimal keyboard distance and also to remain within the sight of the user, it too must also move up and back, again as illustrated in FIG. 9.

Without headrest support, it is expected that most users will not desire to remain long in the transition zone of operation. This has been borne out by testing conducted over an extended period of time with a small cohort of experimental users. As users lean back, they generally enter the transition zone with the head upright and exit the transition zone into the reclining zone with the head fully supported by the head rest. Such support, is then maintained throughout operation in the reclining zone. However, the headrest may be adjusted to provide support earlier in the transition zone, making sitting positions in this zone both productive and comfortable.

Importantly, it should be noted that the keyboard distance 190 and the eye-to-monitor distance 188, as well as the eye depression angle 174 does not appreciably or noticeably change through the sitting and reclining zones of operation. It follows, moreover, that the distance from the monitor to any given reference point on the seat back does not appreciably or noticeably change through the sitting and reclining zones of operation. This is achieved by having precisely coordinated and harmonized movement of the seat back, monitor, and input device support. Just as importantly, the horizontal arm 118 remains at a fixed angle relative to the horizontal (ground) throughout seat back angle changes over the full range of the sitting zone; it remains at a fixed angle in relation to the seat back in the reclining zone; but it elevates approximately 25 degrees as the seat back moves approximately 10 degrees through the reclining zone. This brings the monitors over and above the user for viewing in the reclined position.

Figure 10:
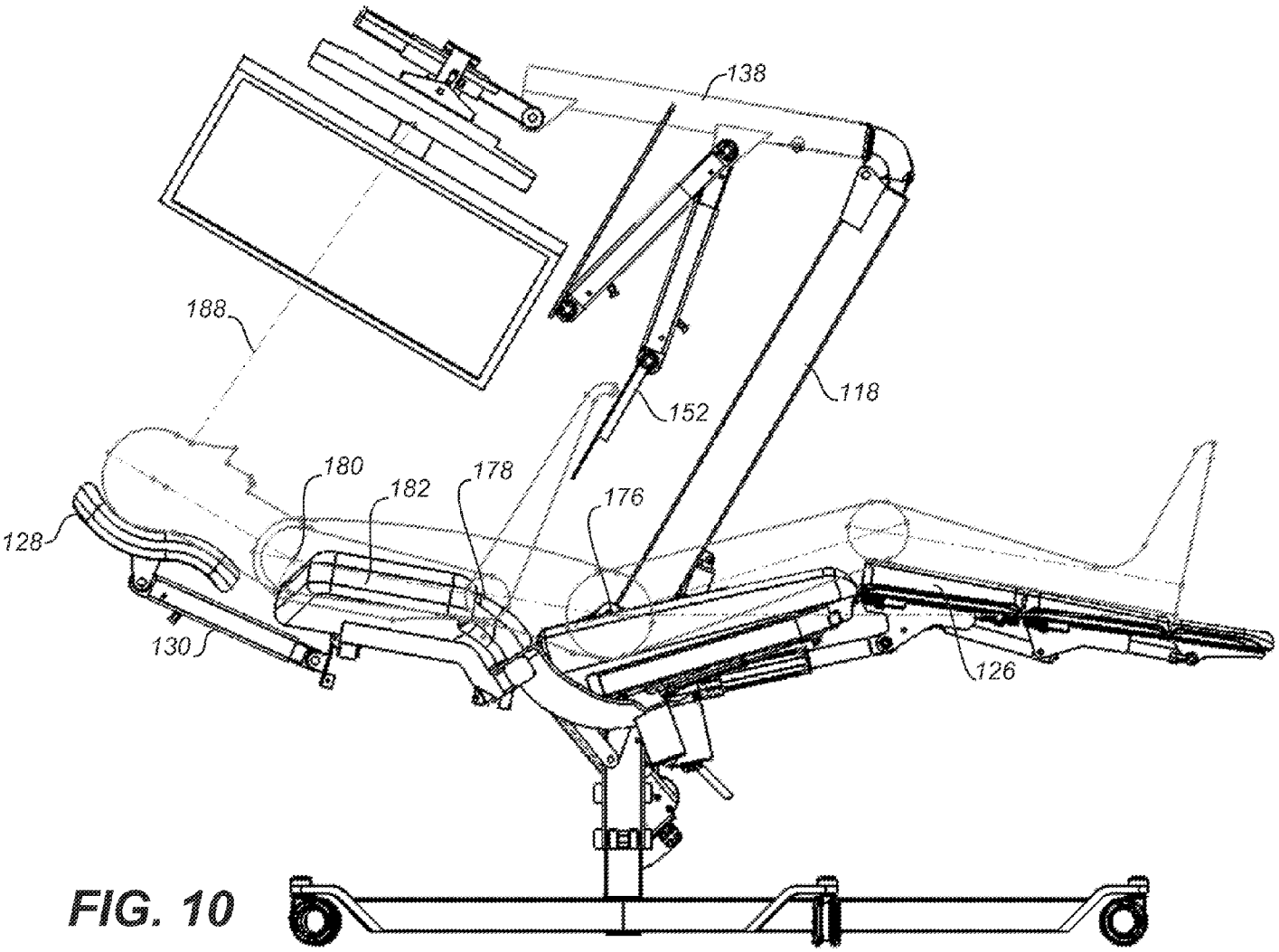
FIG. 10 is a schematic side view in elevation showing a workstation user near the end of the range for the reclining zone, having achieved a fully reclined, position.

Looking at both FIG. 4 and FIGS. 9-10, it can be seen that the thigh angle and the calf angle change through the transition zone. This corresponds to changes in the angle of the seat bottom and according to support provided by leg rest deployment. These motions are shown as taking place only in the transition zone, but this is for clarification and simplicity in the views. The reader, however, should appreciate that seat bottom and leg rest motion can occur at any seat back angle, and are, in fact, likely to occur even when the user is in sitting mode. Thus, an important feature of the present invention should be noted: the thigh rotates radially about its "effective pivot axis" at the femoral/acetabular joint. Rotation of the thigh and calf do not affect the position of the trunk, head, monitor, or input devices. Accordingly, the user does not need to readjust the monitor or input devices when he moves the leg rest or the seat bottom angle.

Figure 6:
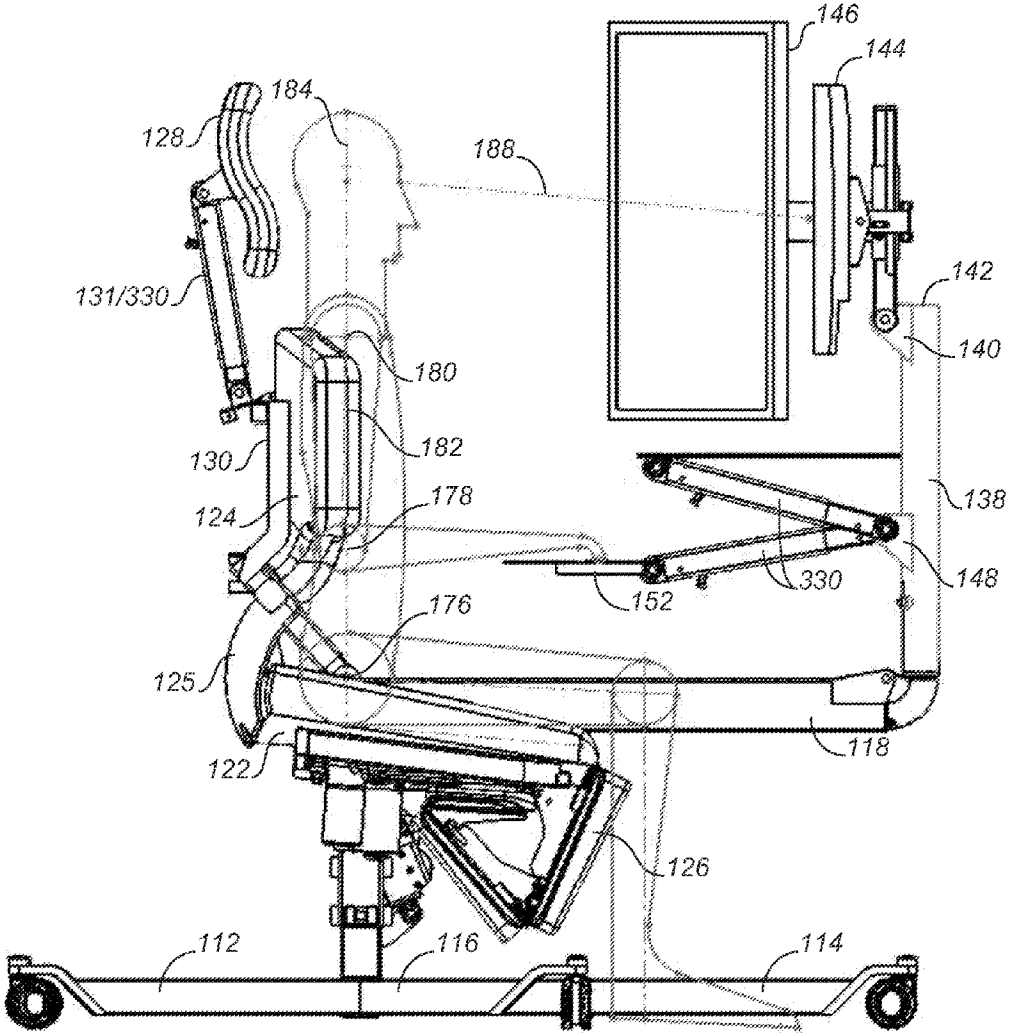
FIG. 6 is a schematic side view in elevation showing a workstation user in a seated (upright) position with the head rest pulled back clear of the head.
Figure 7:
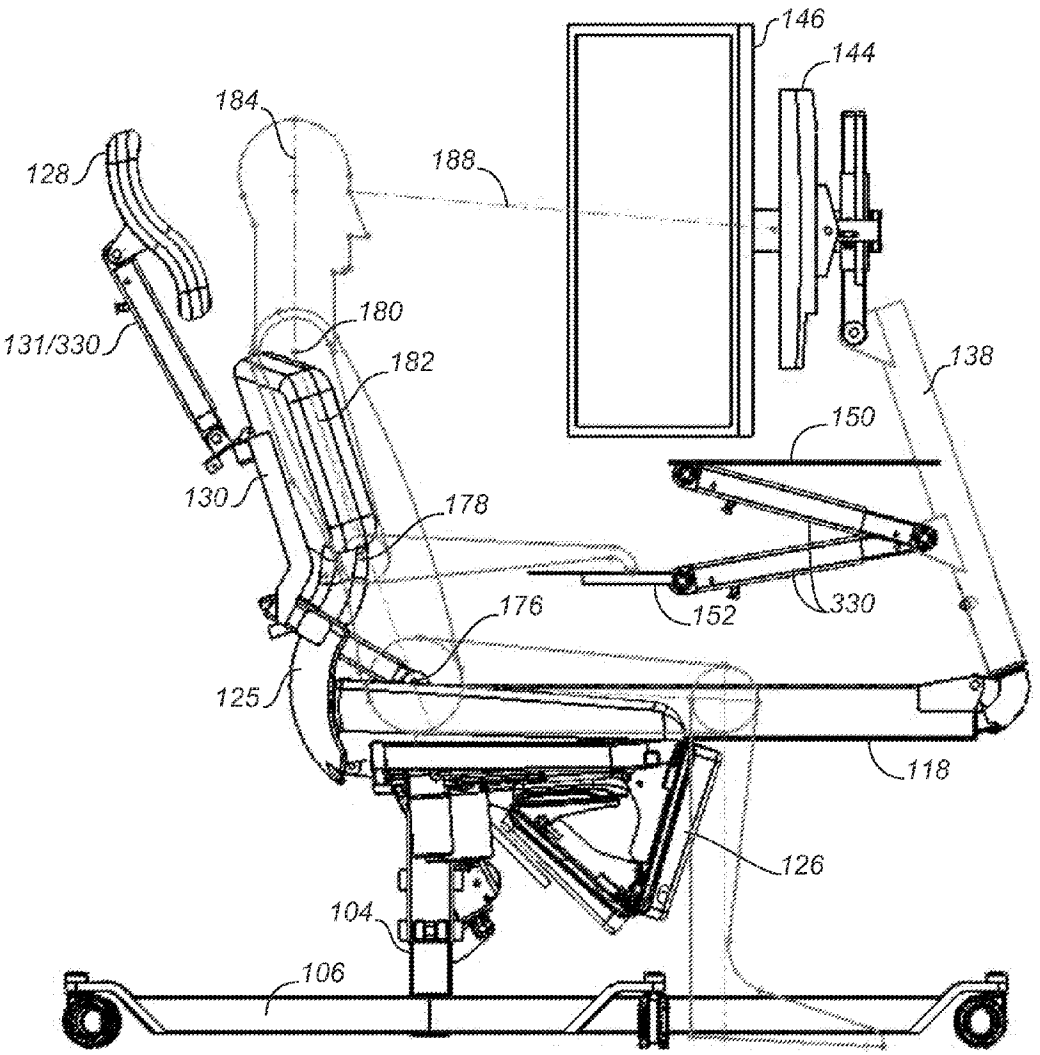
FIG. 7 is a schematic side view in elevation showing a user still in the sitting zone of operation, but with the backrest and trunk slightly tilted back, and the vertical monitor arm supporting the monitor, input device support, and work tray support slightly tilted back to maintain optimal spacing.
Figure 8:
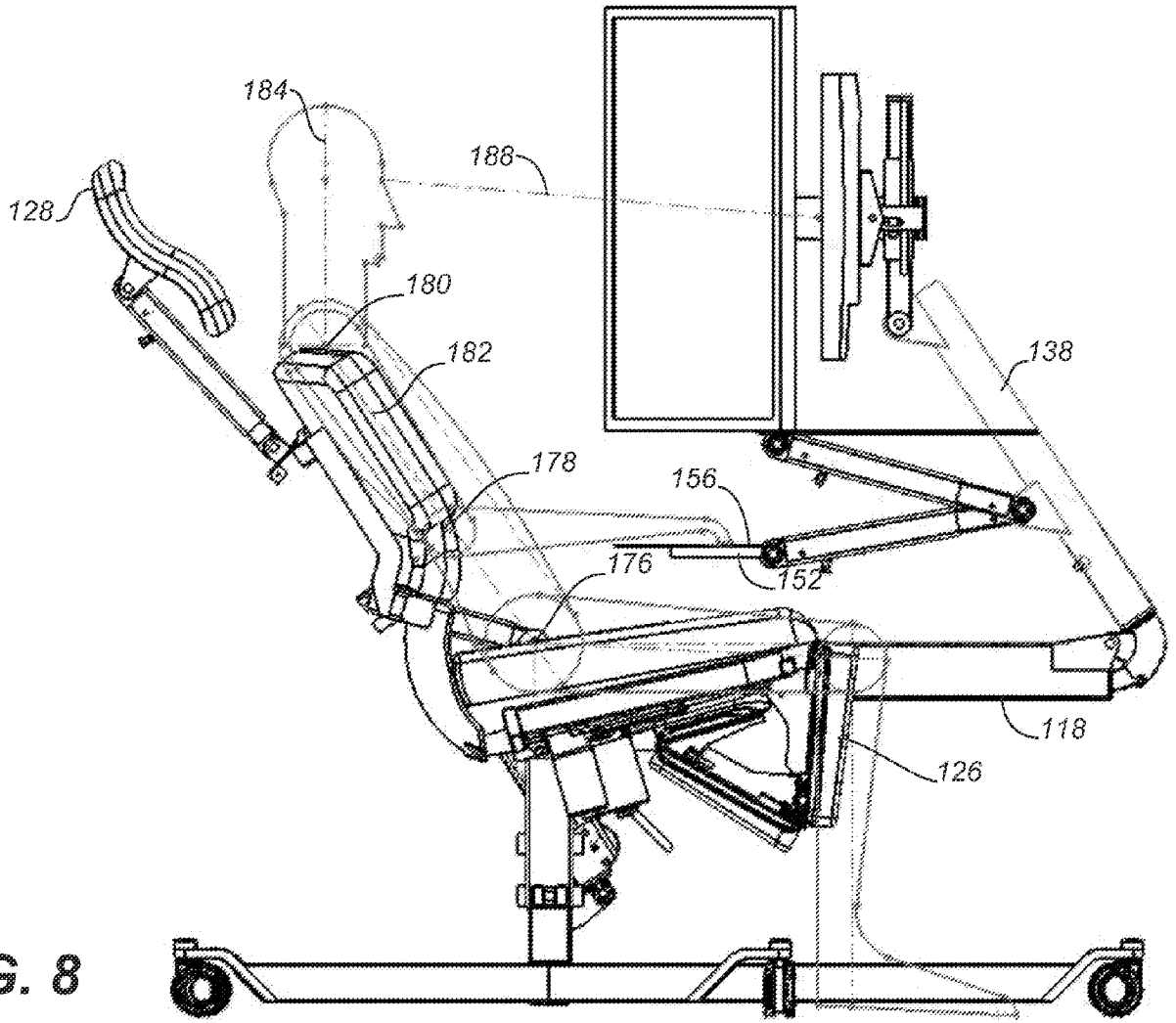
FIG. 8 is a schematic side view in elevation showing the user positioned at the beginning of the transition zone.

Further, the "neck-to-trunk angle" changes from approximately 0 degrees in the most upright sitting position, FIG. 6, to approximately 20 degrees in the reclining zone, FIG. 10. The head rest must thus be pulled, back when the user moves into the upright position in the sitting zone. This is accomplished by the head rest pull-back mechanism 130 as the user moves the seat back forward from the reclining zone through the transition zone.

Still referring to FIG. 10, it will be appreciated that the reclining zone begins when the user tilts the seat back far enough that the weight of his head must be supported by a head rest attached to the seat back. It has been noted that this begins at a seat back angle of approximately 45 degrees and it extends until the user is in a completely reclined position.

The monitor distance 188 and the eye depression angle 174 must be maintained in the reclining zone. As the user's head is rested on the head rest, the head rest moves directly and coincidentally (radially degree by degree) with the seat back. That is to say, it remains fixed. Therefore, the monitor, input devices, and the head and trunk, all move as a unit with the seat back as the seat back pivots around the effective pivot axis 176 between the thigh and trunk.

Figure 11:
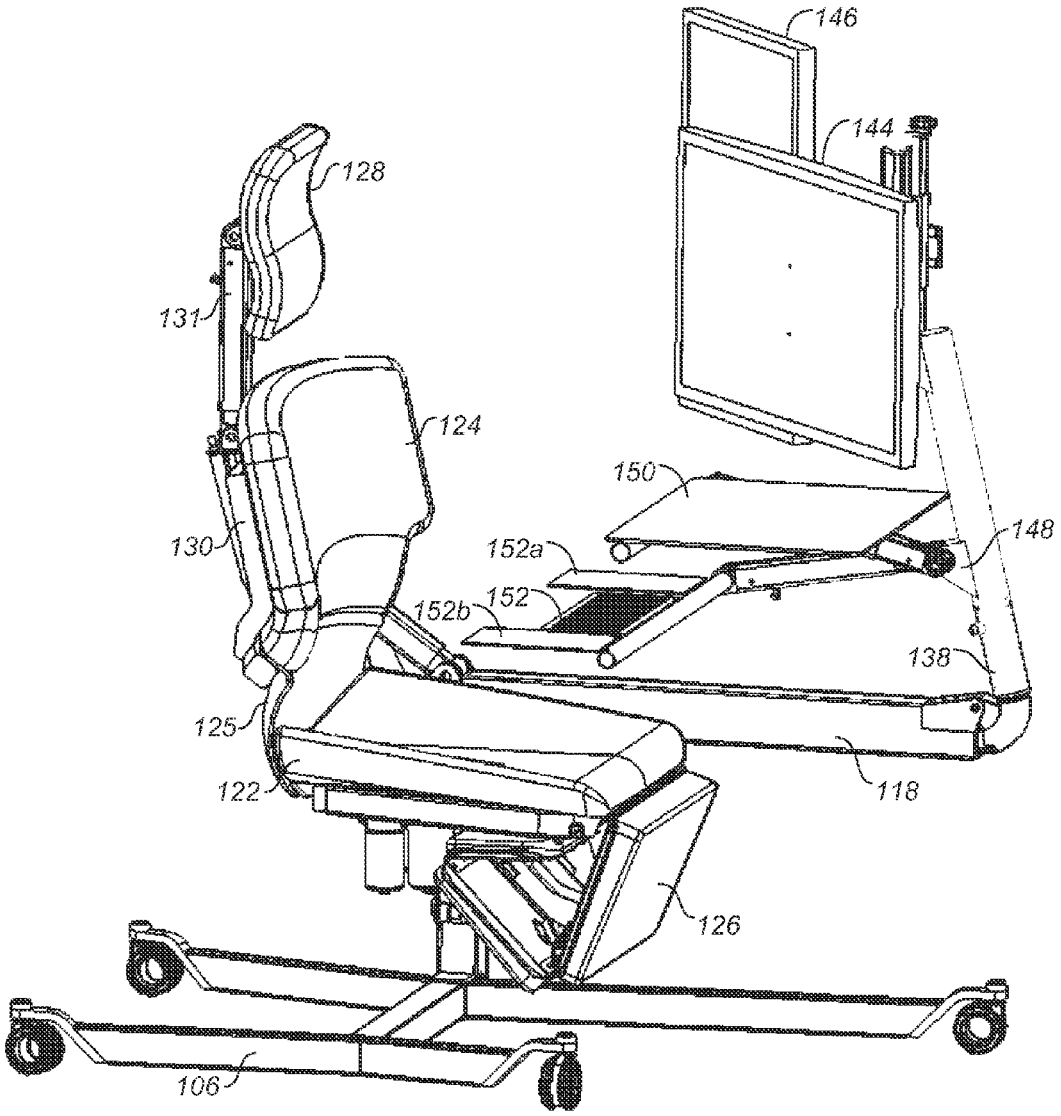
FIG. 11 is an upper left front perspective view showing the workstation in the collaborate mode configuration.

Referring next to FIG. 11, the inventive workstation is shown in the collaborate mode. In this configuration the seated user may share his view of the primary and secondary monitors, 144, 146 with a person sitting or standing to his right. A detented linkage behind the monitor allows the user manually rotate the primary monitor about the axis 198 shown in FIG. 2.

Figure 12:
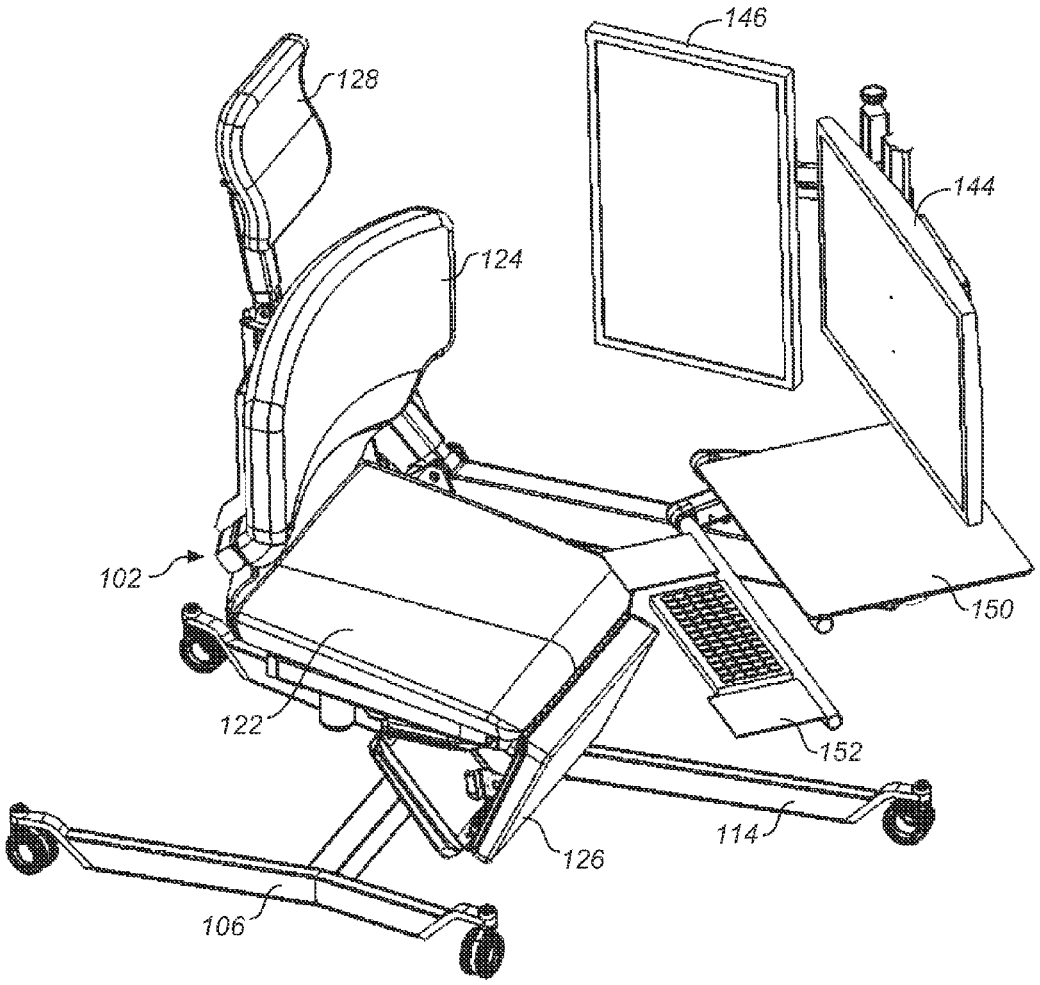
FIG. 12 is an upper left front perspective view showing the workstation with the input device support and monitors partially pivoted so as to allow for ingress or egress (mounting/dismounting) of the workstation seat.

FIG. 12 shows the workstation configured for easy mounting and dismounting, with the keyboard trays 152, the mini-desk 150, and the monitors 144, 146 pivoted, away from the seat 102 and seat bottom 124. From this view it will be seen that when a user wishes to sit in the workstation, the monitors and keyboard trays are pivoted to a position allowing easy entrance to the seat. After the user sits in the chair, he or she will pull either the monitor support or the input devices toward the seat. In either case, one motion moves the keyboard trays, the mini-desk, and he monitors into the working configuration. This is achieved by mounting the keyboard tray mounts and the monitor mounts to the same tube, i.e., the vertical monitor arm 138. This tube is allowed to pivot as a single unit in relation to the horizontal monitor arm 118.

Then, when users wish to stand, they can push the keyboard tray or monitor support away, and when either is pushed, the motion is transmitted to the rest of the system, so that once again the motion allows for an easy and expeditious exit to a standing position. This mode can accessed only if the user has moved the seat back to the upright sitting position.

Figure 13:
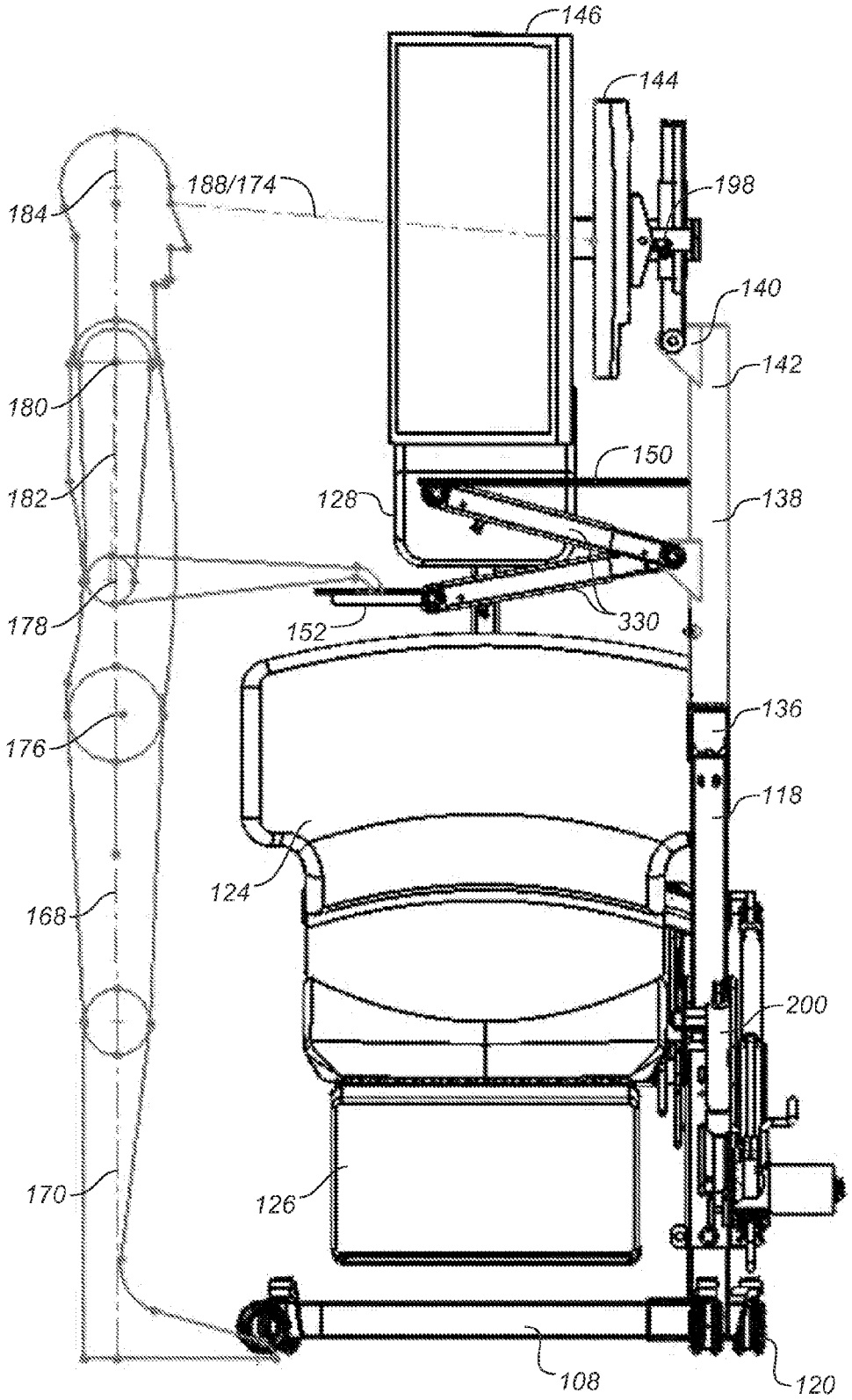
FIG. 13 is a schematic front view in elevation showing the workstation and a user working at the working station in the standing mode.

Next, and turning now to FIG. 13, a user may wish to work in a standing position. To configure the workstation in this mode, the user need only move the seat back to the most upright position and manually rotate, as a unit, the monitors, input devices, and mini-desk about the vertical monitor arm 90 degrees from the normal sitting work position. The user will generally need to lift the horizontal monitor arm approximately 30 degrees from its angle in the sitting position, It is held in the raised position by a commonly available locking gas spring, linear ratchet, or linear actuator 200, including an electrical actuator.

Figure 14:
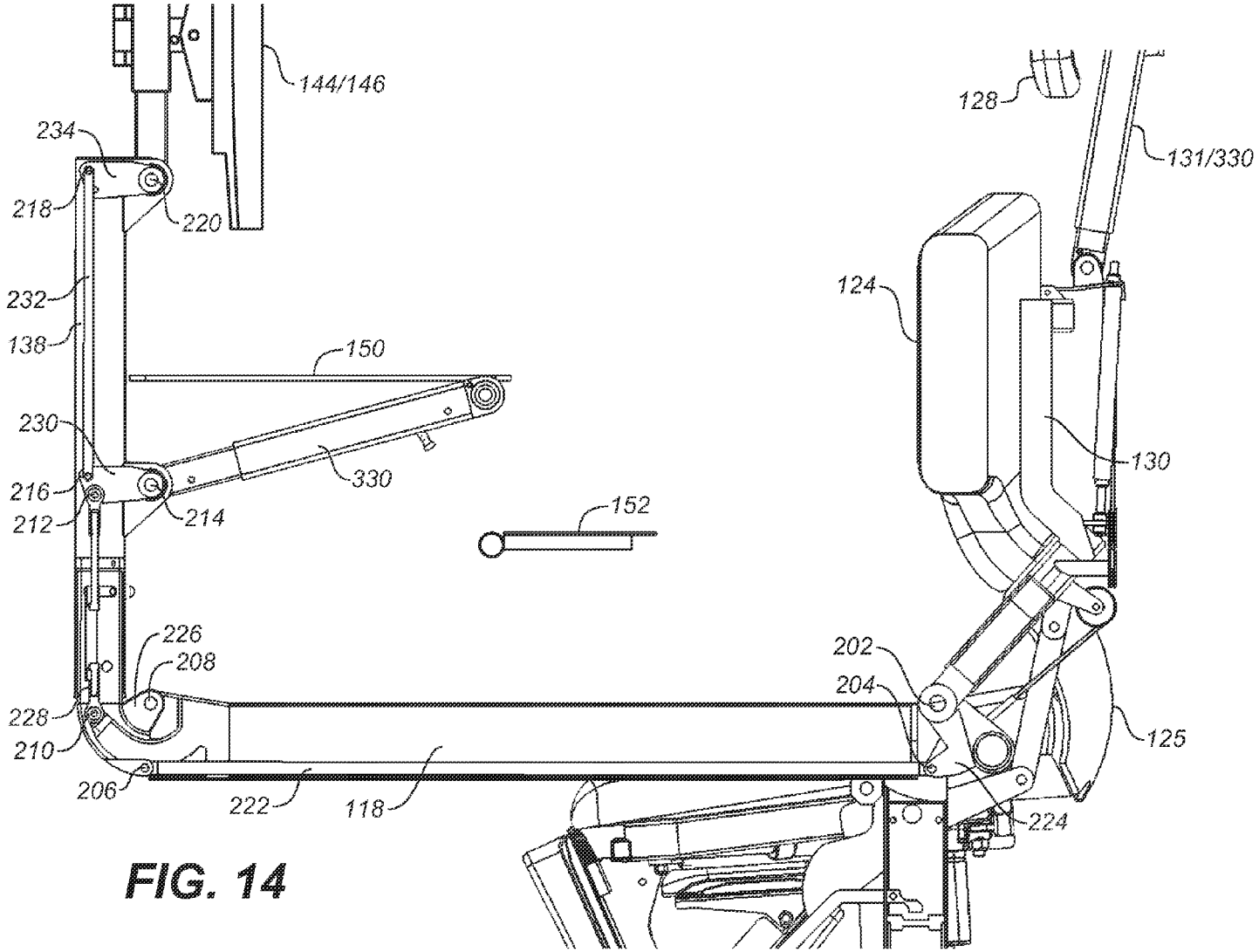
FIG. 14 is a cross-sectional detailed right side view in elevation showing the structural and operational elements of the arm linkages in the horizontal and vertical monitor arms with the workstation in the upright sitting position.
Figure 15:
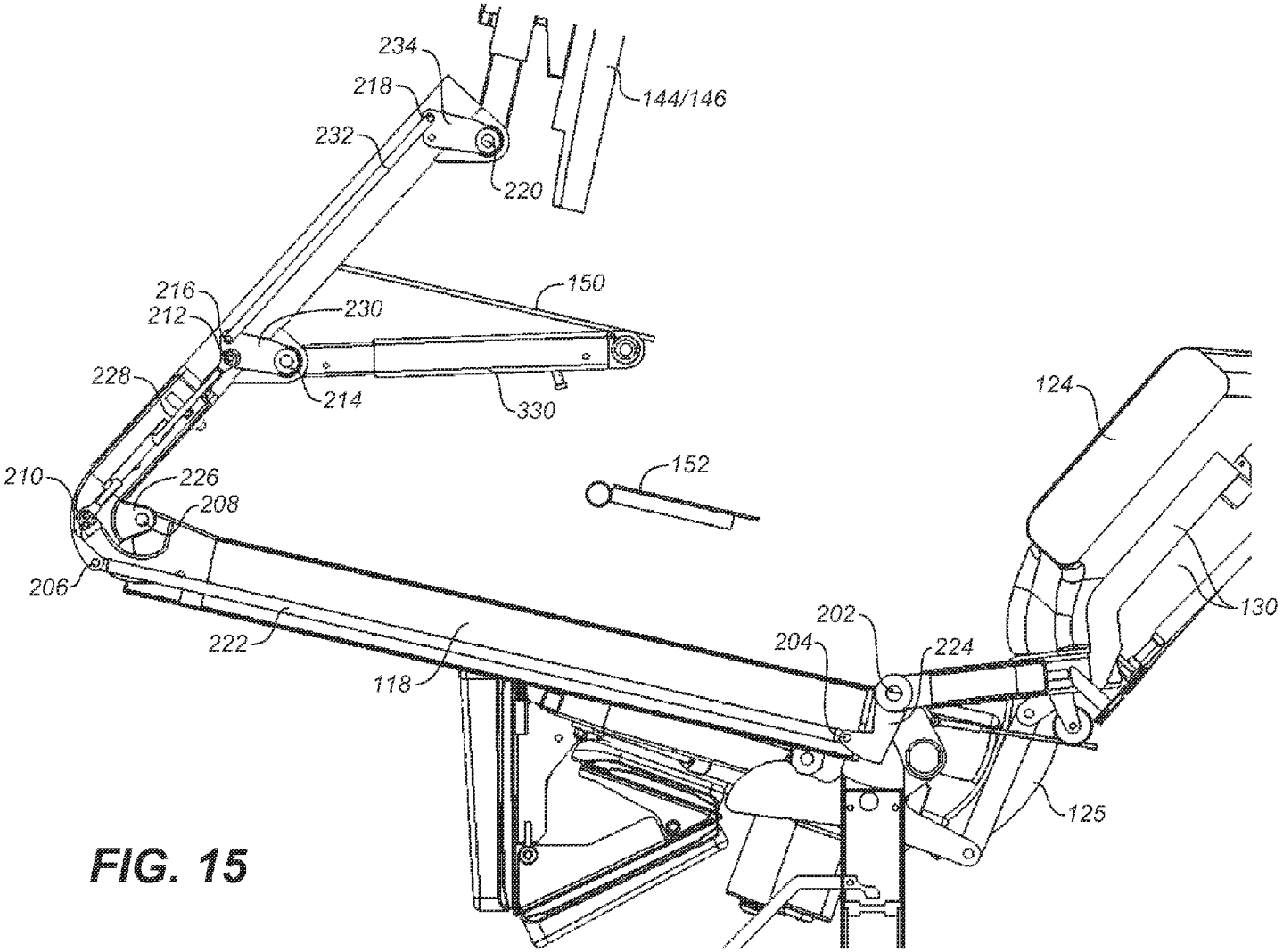
FIG. 15 is a cross-sectional right side view in elevation showing the structural and operational elements of the arm linkages with the backrest moved to the beginning of the transition zone, showing the three 4-bar parallelogram linkages used to maintain the desired structural relationships through a range of motion in the zones.

Referring next to FIGS. 14-15, there is shown in cross-sectional side views the monitor arm internal planar 4-bar linkages that make possible some of the coordinated motions characteristic of the present invention. Pivot axes for the linkages create multiple parallelograms that are maintained as parallelograms by virtue of the linkage geometry. Specifically, a first parallelogram is formed by lines joining pivot axes 202-204-206-208-202; similarly, a second parallelogram is formed by lines joining 208-210-212-214-208; and a third by lines joining pivot axes 214-216-218-220-214. These three parallelograms are maintained in parallelogram geometry through the action of the parallelogram linkages, which are formed by (1) horizontal monitor arm link 222, which is joined at its proximal end at pivot axis 204 to arm 224, which pivots about pivot axis 202, and at its distal end at pivot axis 206 to arm 226, which pivots about pivot axis 208; and (2) lower vertical monitor arm link 228, a ball joint link, joined at its lower end to arm 118 at pivot axis 210, and at its upper end at pivot axis 212 to arm 230, which pivots about pivot axis 214; and (3) upper monitor support arm link 232 joined at its lower end to arm 230 at pivot axis 216, and at its upper end at pivot axis 218 to arm 234, which pivots about pivot axis 220.

As may be appreciated from the views, the first of the parallelogram linkages maintains the vertical monitor arm 138 and the frame at the back of the seat back 124 in a parallel relationship. The second and third of the parallelograms linkages maintain a parallel relationship between the horizontal monitor arm 118, the upper edge of arm 230, and the upper edge of arm 234 (though it will be appreciated that these features of the arms 230 and 234 are for reference only, inasmuch as by setting an arbitrary line on the arms defining their respective parallelograms in any initial position, it will be observed that as to that line, the parallel relationship is maintained, whether or not the line corresponds to a physical feature, e.g., the upper edges, of the respective arms).

The three parallelogram linkages are concealed within the tubular arms comprising support structures in the workstation. These linkages operate slightly differently in the standup mode due to the presence of the collapsible ball joint link 228 that can be collapsed in length. When the workstation is in stand up mode, the linkage inside the horizontal monitor arm keeps the vertical monitor arm upright, and the linkage inside the vertical, monitor arm becomes inactive, as the collapsible ball joint link, collapses.

Figure 16:
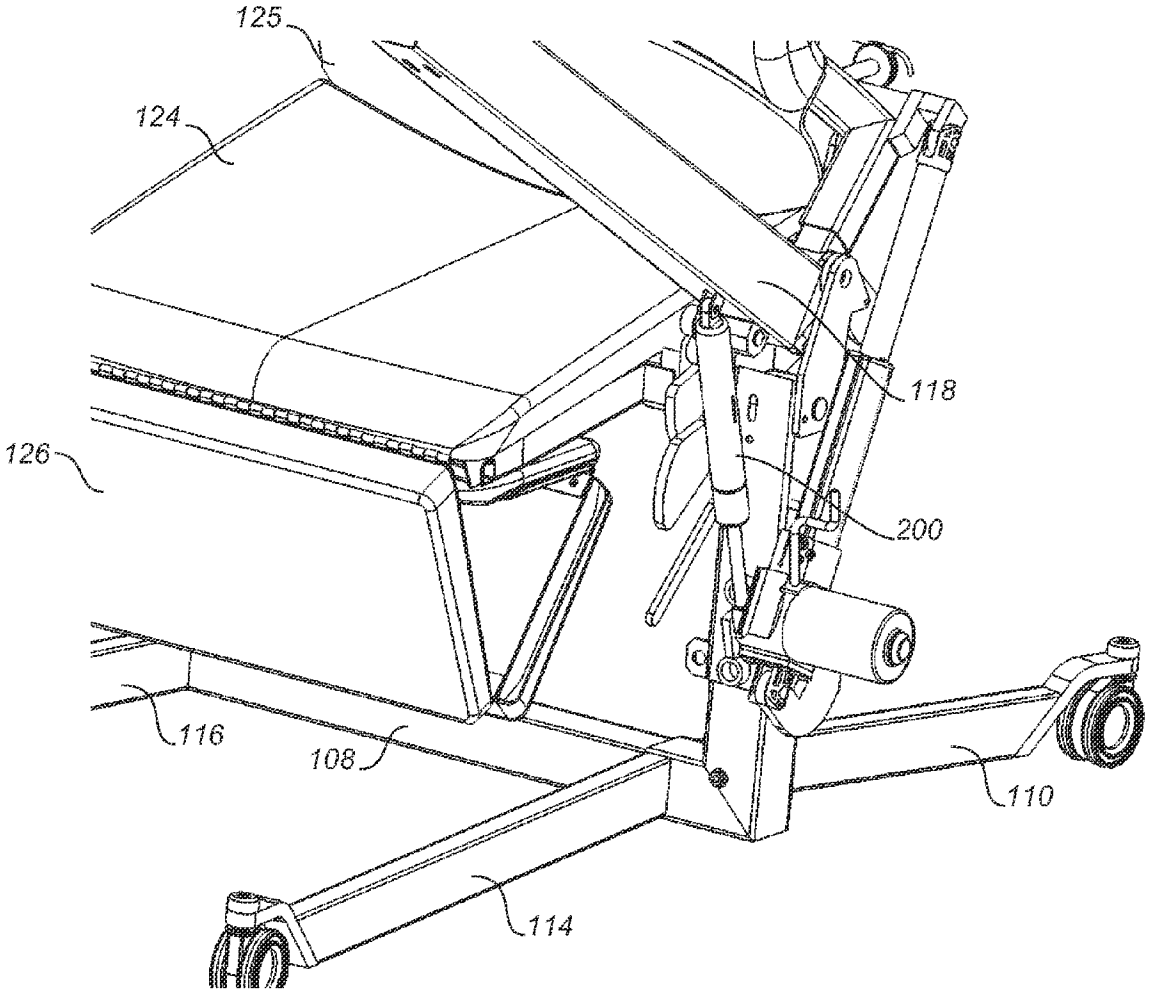
FIG. 16 is a front right perspective view showing detail of the locking gas spring supporting the horizontal monitor arm, this view showing the arm in an elevated, standing configuration.

FIG. 16 illustrates the locking gas spring 200 used to keep hold the horizontal monitor arm 118 up at approximately 30 degrees for the stand-up mode configuration. In an alternative embodiment, this locking gas spring could be also be implemented as a linear ratchet and spring or a linear electric actuator, as will be appreciated by those with skill in the art.

Figure 17:
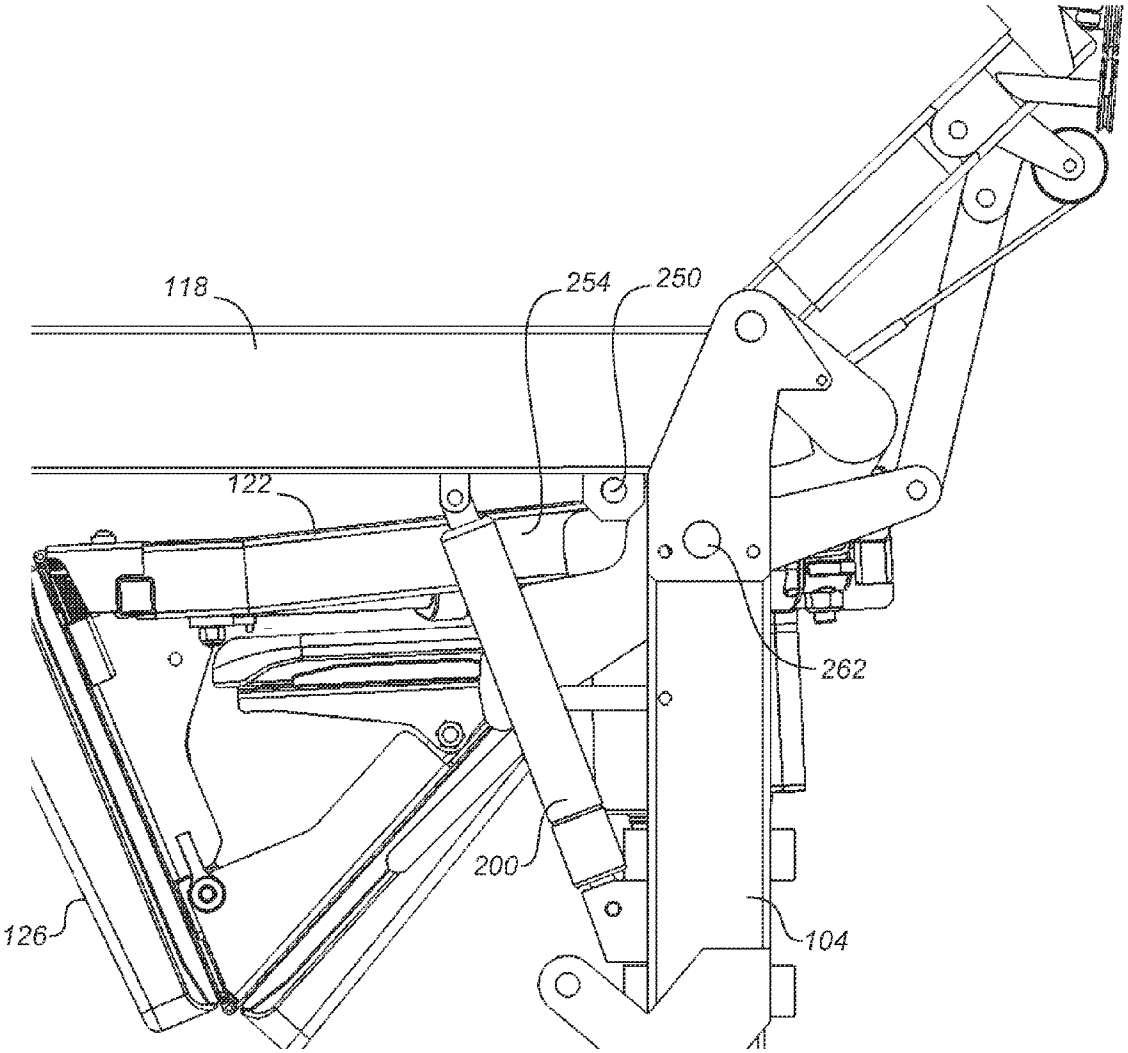
FIG. 17 is a detailed right side view in elevation showing details of the cam system for the seat back and seat bottom, this view showing the seat back in the vertical, sitting configuration.
Figure 18:
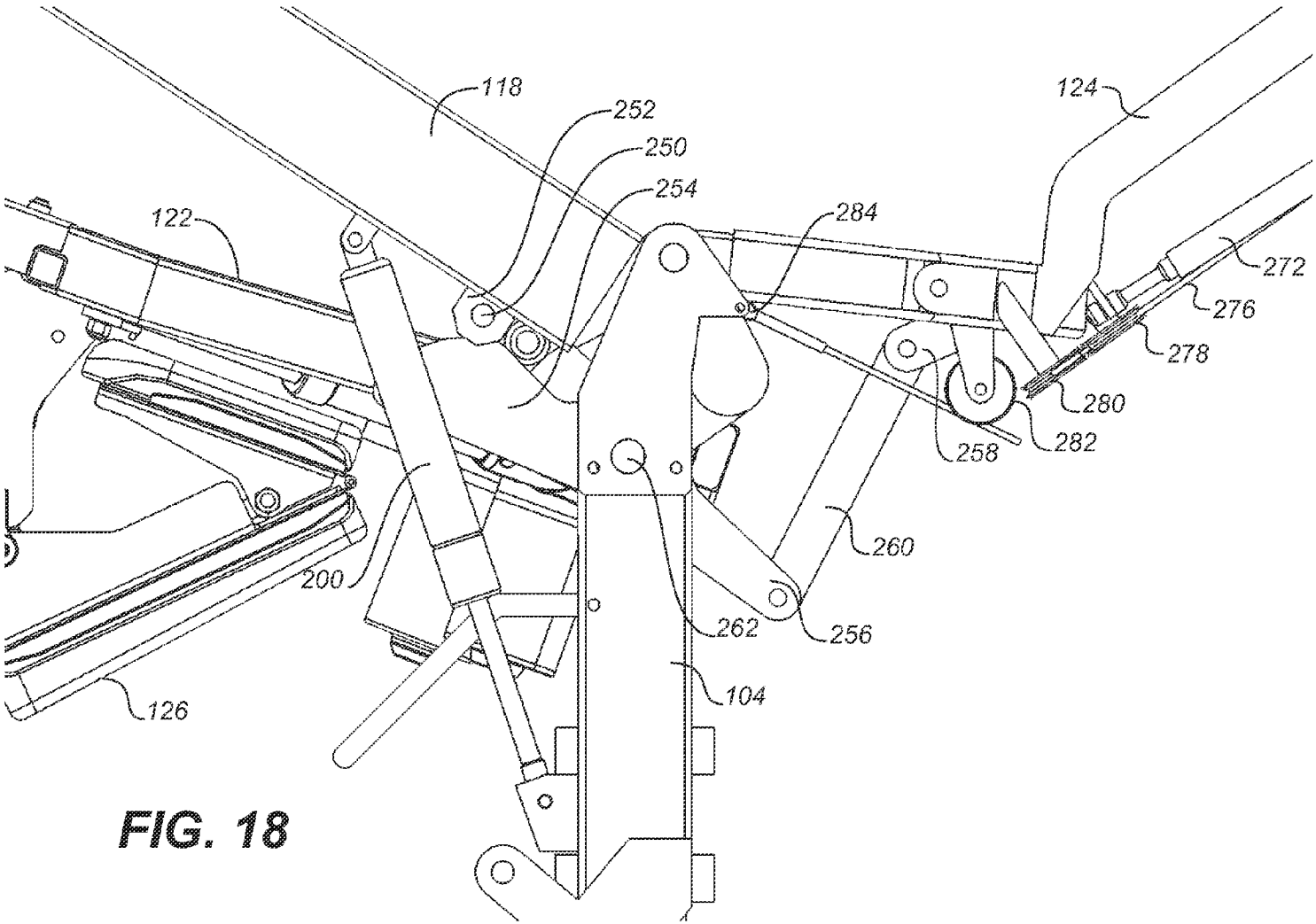
FIG. 18 is detailed right side view in elevation showing details of the cam system for the seat back and seat bottom, this view showing the seat back in an early stage of the reclined zone, and the horizontal monitor arm and seat bottom correspondingly tilted.
Figure 19:
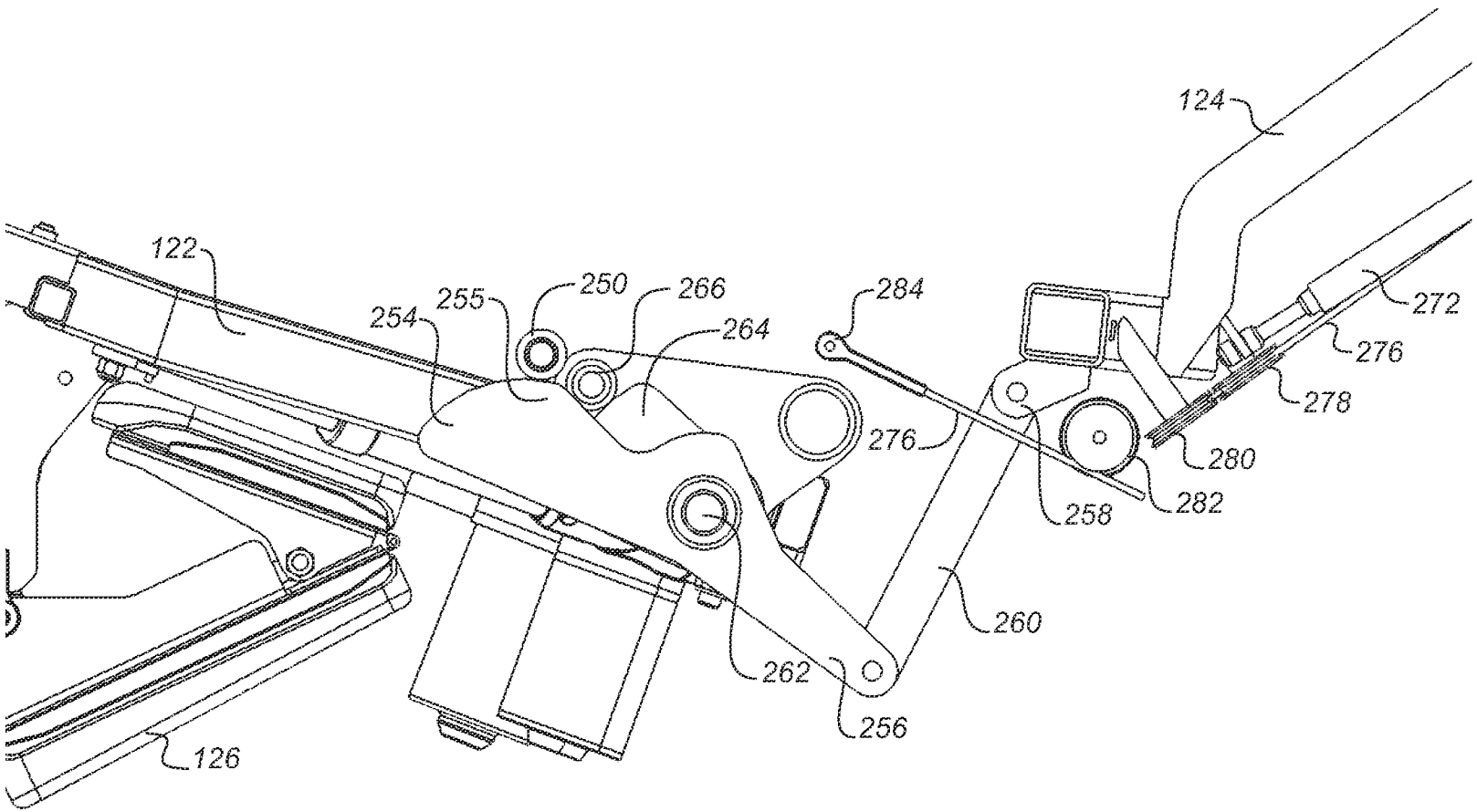
FIG. 19 is a deeper right side sectional view showing the cam system with the seat bottom and seat back in the configuration of FIG. 18.

Referring next to FIGS. 17-19, there are shown detailed right side views in elevation of the earn system for the seat back 124, seat bottom 122, and horizontal monitor arm 118. This system mechanically and operatively links the seat back to the horizontal monitor arm and the seat bottom. The underside of horizontal monitor arm includes a cam follower 250 (concealed behind its mount 252) which engages horizontal monitor arm drive cam 254 which has a cam surface contoured with an upper lobe 255 to drive the horizontal monitor arm upwardly when the seat back angle reaches a predetermined amount, preferably about 35 degrees. Cam arm 256 is pivotally coupled to seat back 124 at bracket 258 through link 260. As the seat back moves from vertical, FIG. 17, the horizontal monitor arm 118 remains stationary (i.e., horizontal until the seat back angle is at approximately 35 degrees, FIG. 18, at which point the horizontal monitor arm 118 is pushed upwards by the cam follower's engagement with the contoured surface of cam 254. The seat bottom is gradually raised from −4 deg to +20 degrees as the seat back moves from vertical to 35 degrees, were it is then is held generally stationary as the seat back continues to recline. Cam 256 pivots about cam pivot shaft 262 disposed proximate the top of vertical support 104. In this view there is also visible seat bottom cam 264 engaged by seat bottom cam follower 266, which alters the position of the seat bottom 122 as the seat back reaches threshold angles moving through the operational zones.

Figure 20:
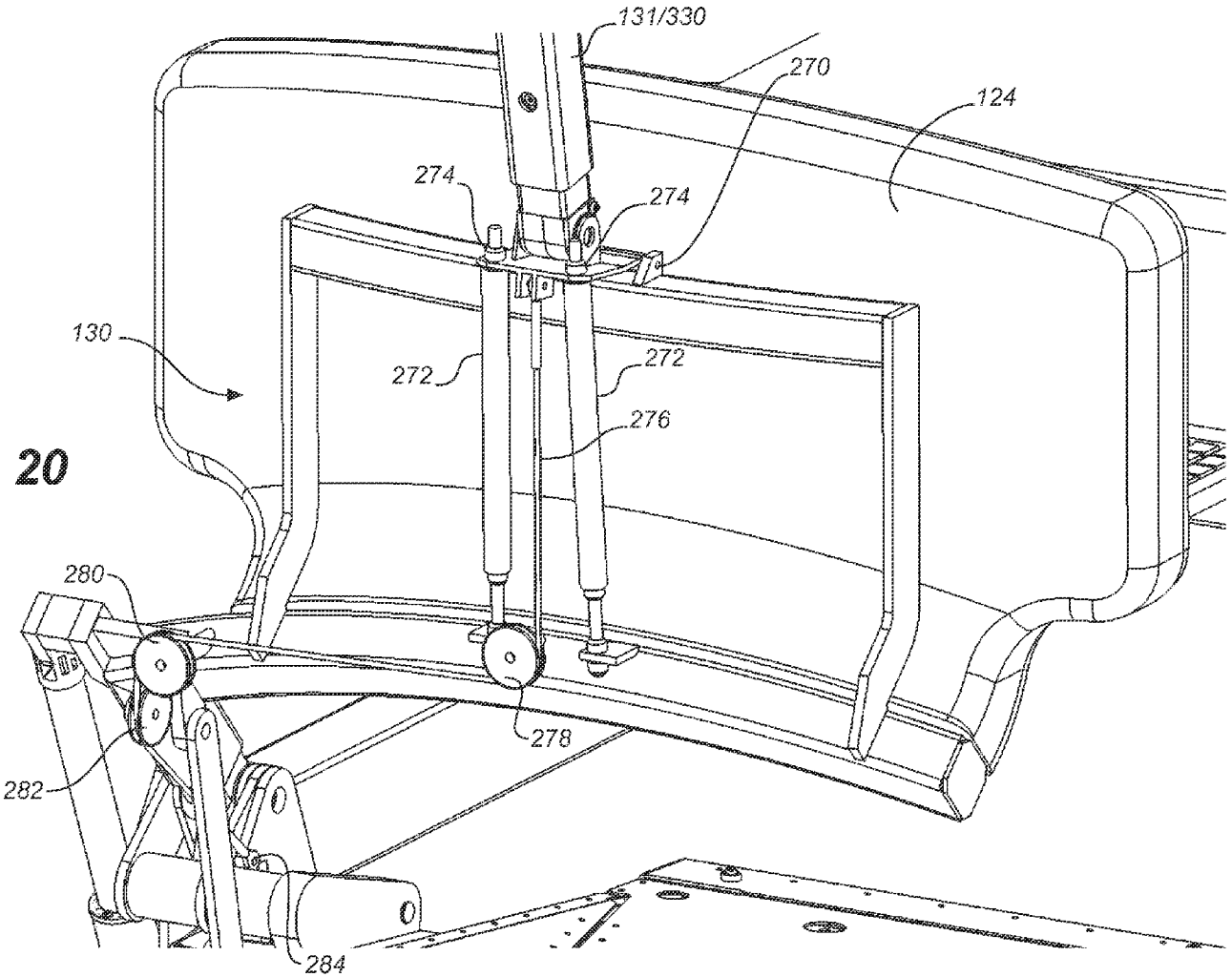
FIG. 20 is an upper left perspective view showing the headrest pullback mechanism that operates to support the user at the desirable time as the user transitions from the sitting to the reclining operating zones.

Next, and turning now to FIG. 20. there is shown a preferred embodiment for the head rest pull-back mechanism 130 employed in the present invention. In its most essential aspect, the head rest rotates about an axis 270 attached to the seat back 124. Two compression springs 272 apply a farce that pushes the head rest forward against stops 274. A wire tension cable 276 is routed around three pulleys 278, 280, 282 oriented so as to pull the head rest back. The lower end 284 of the cable is attached to a stationary portion of the vertical support 104, such that tension is created in the cable as the seat back rotates forward.

Figure 21A:
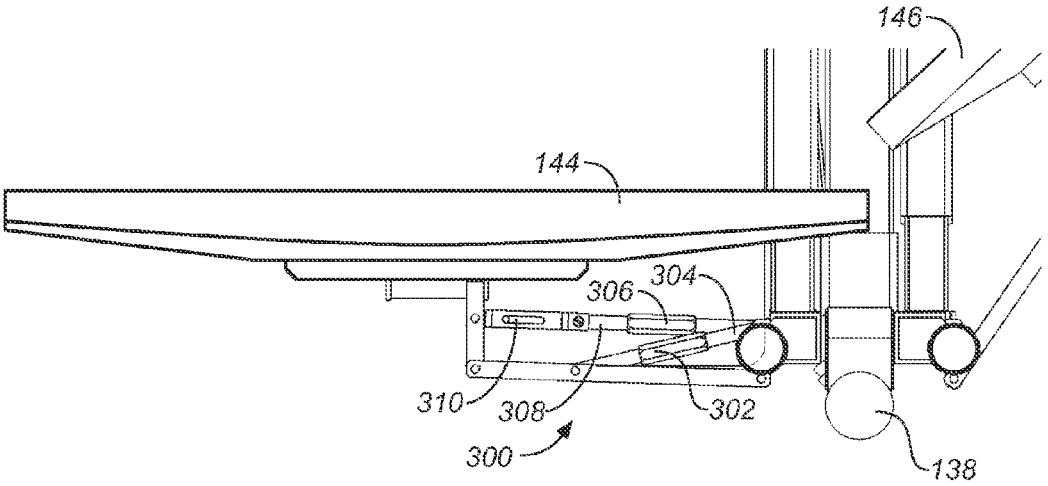
FIGS. 21A and 21B are top plan views of the primary monitor adjustment mechanism employed in a possible embodiment the present invention.
Figure 21B:
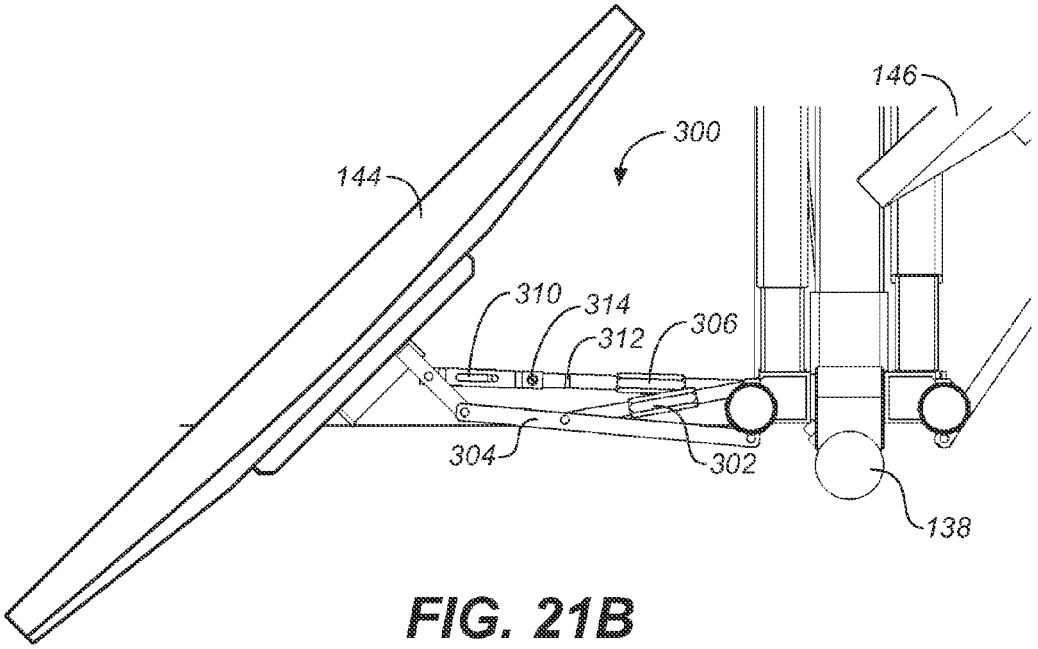
Figure 21C:
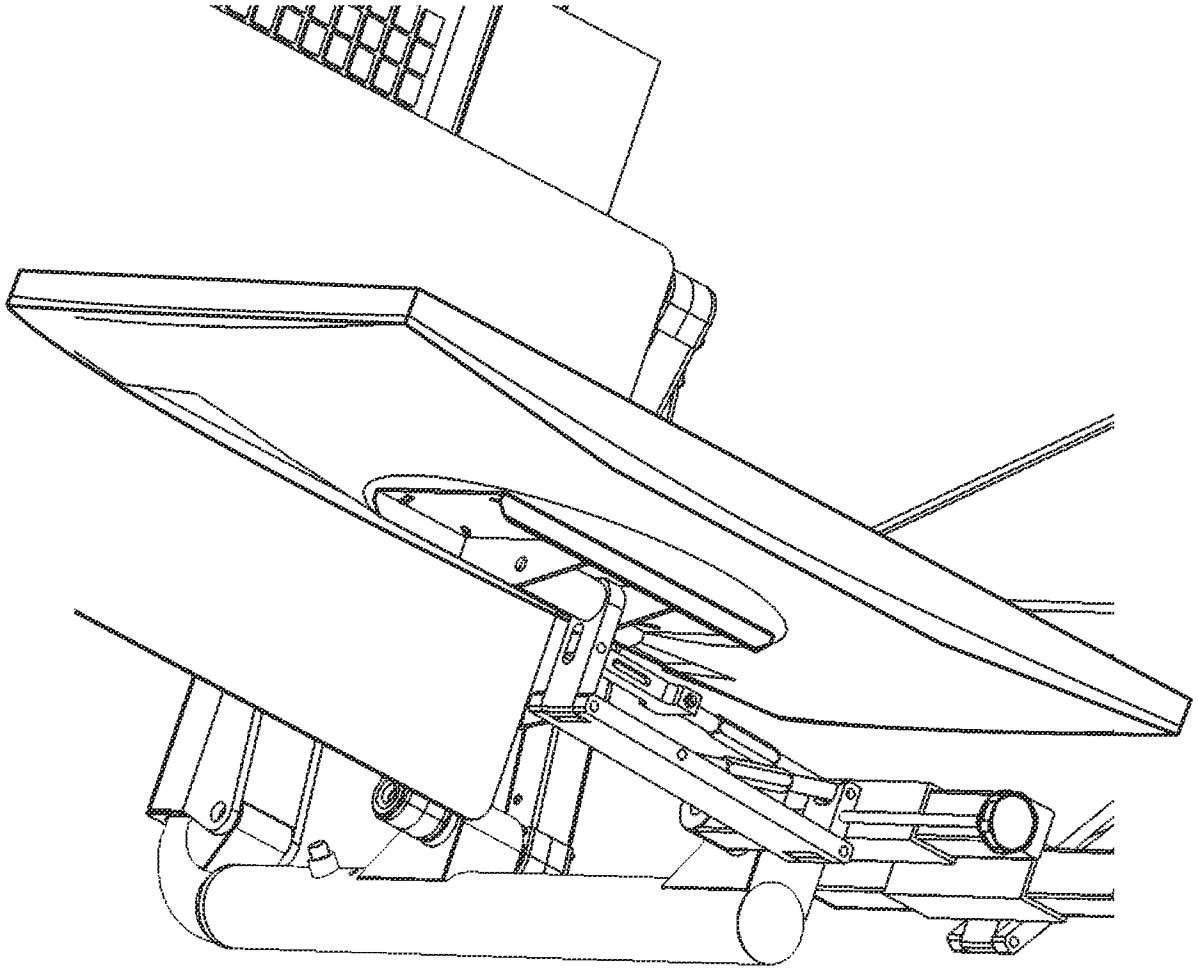
FIG. 21C is an upper left front perspective view showing details of the vertical adjustment knob and screw for the primary monitor mechanism.

FIGS. 21A through 21C show details of the primary monitor adjustment linkage 300. This is provided so that the user can initially set the monitor 144 to his desired monitor-to-eye distance, height and lean angle. A first turnbuckle 302 and link 304 adjusts the monitor eye distance. This, too, is a 4-bar parallelogram linkage, so the monitor angles do not change as the eye distance varies. The second turnbuckle 306 and link 108 are for fine tuning and adjusting the monitor angle. This link is extendable, but has a length limiter 310 to set its minimum length. It is held to its minimum length by a detent groove 312 and a pair of ball details. Pulling the link out of the detent position allows the monitor to be swiveled into the collaborate position, as shown in FIGS. 11 and 21B.

FIGS. 22A through 22H show in various views the multi-use adjustment mechanism incorporated in several places in the inventive workstation. It functions as input device holders, the mini-desk holder, and in a preferred embodiment of the adjustable head rest support (see FIGS. 2, 6, 7, 13, and 20). The mechanism 320 is an elongate arm with pawl and ratchet rotation shafts 322, 324 disposed at each end, a first rotation shaft 322 in an inner telescopic tube 326, and a second rotation shaft 324 in an outer telescopic tube 328. The inner telescopic tube 326 is slidably inserted into the outer telescopic tube 328 and includes a linear array of slide stop holes 330. It also includes a slot 332 at its inboard end. A release button 334 is inserted through button hole 336 disposed in outer telescopic tube 328. A second clearance hole 338 accepts a locking tab 340 to stop lateral translation of opposing linear slides 342, 344, within the tubes.

Each linear slide 342, 344 includes a ratchet 346, 348 shaft disposed on its outer end, and each ratchet shaft is engaged by two pawls 350, 352 and 354, 356, respectively, each urged into the ratchet shaft splines by springs 358, 360. Compression springs 362, 364 are employed to drive each arm downwardly so as to keep the locking, tab 340 engaged with the slide stop holes 330.

Figure 22A:
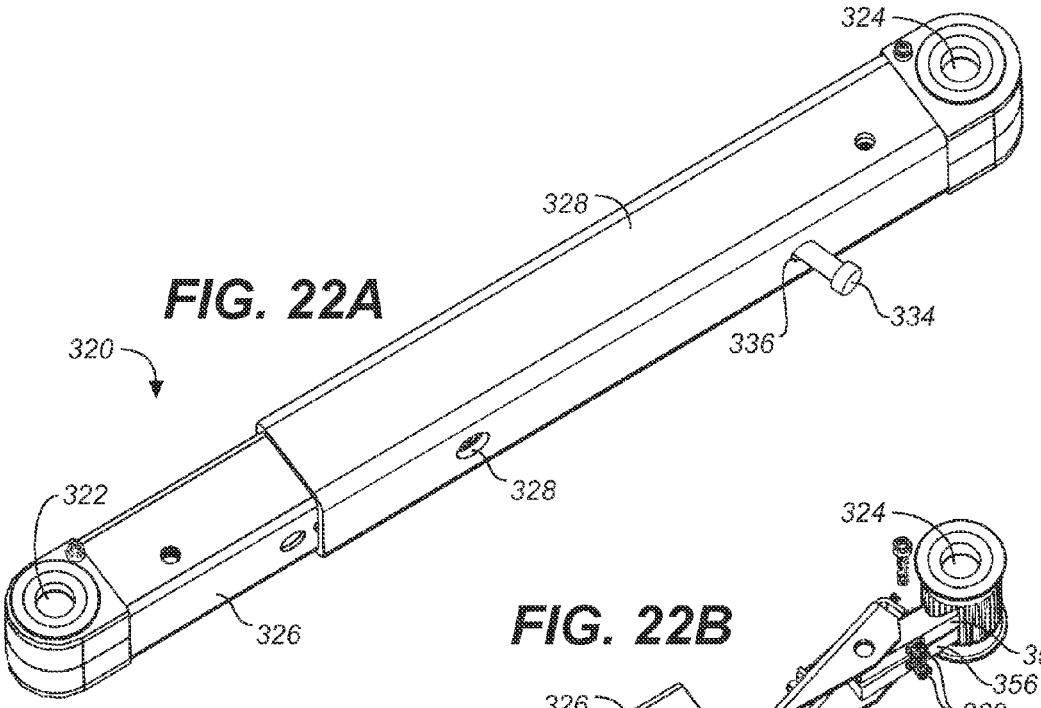
FIG. 22A is an upper perspective view showing a multi-use adjustment mechanism employed in a preferred embodiment of the present invention for the headrest, mini-desk, and input device rail.
Figure 22B:
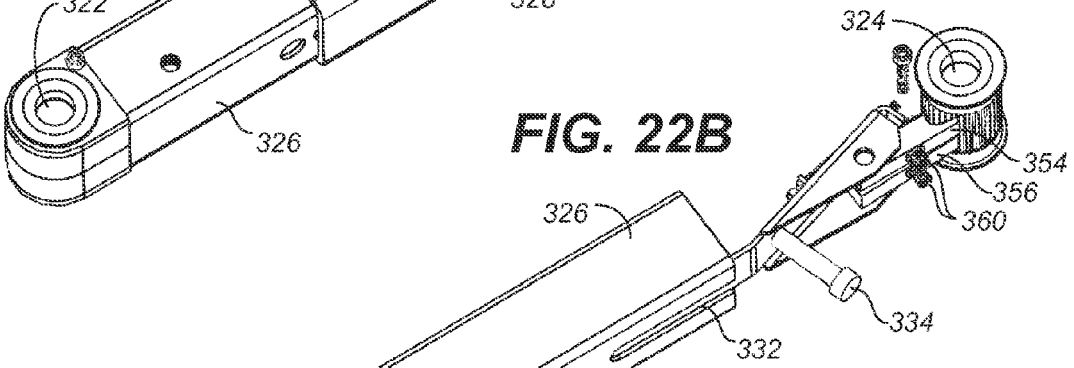
FIG. 22B shows the same mechanism with the outer telescopic tube removed.
Figure 22C:
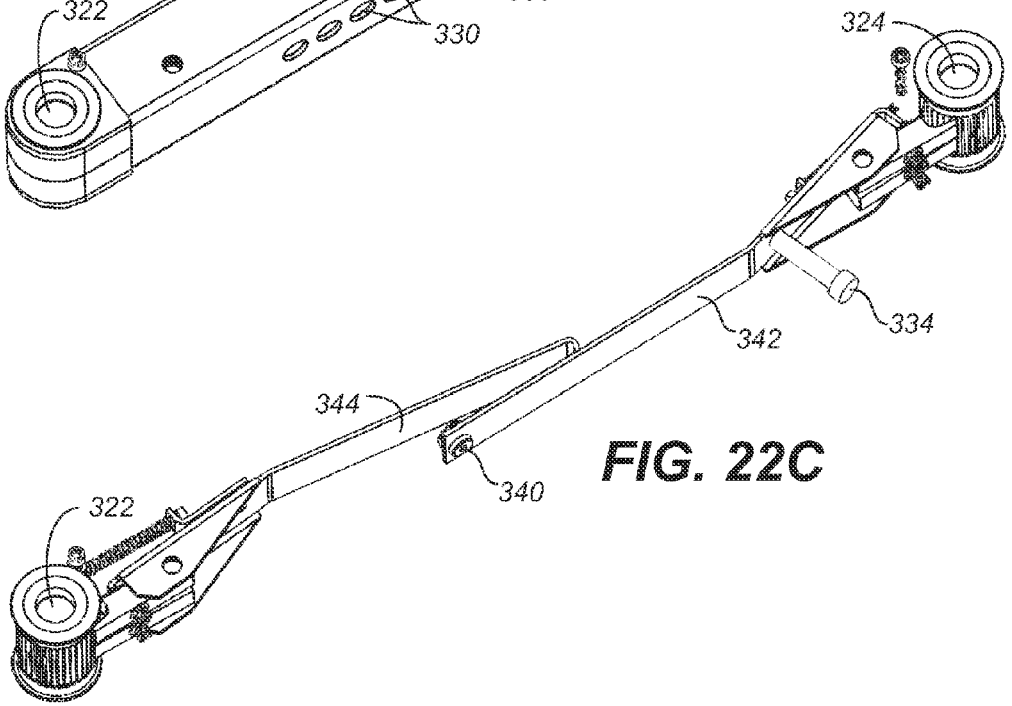
FIG. 22C shows the internal operative components of the multi-use adjustment mechanism (i.e., with both the inner and outer telescopic tubes removed)
Figure 22D:
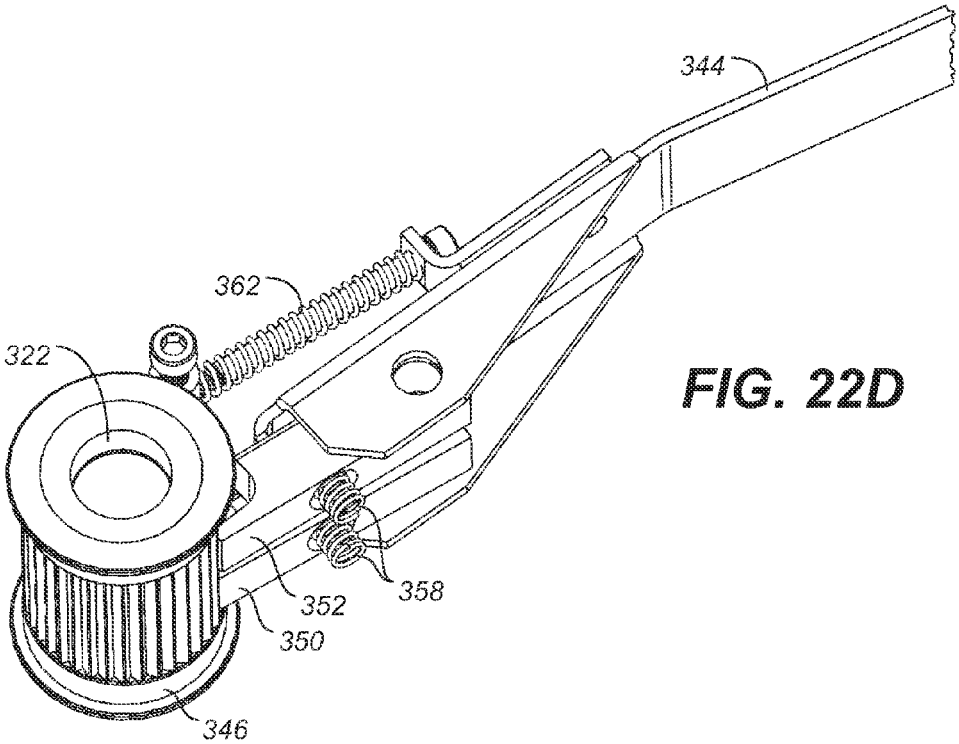
FIGS. 22D and 22E are perspective views showing the pawl and ratchet element at the outboard ends of the linear slides of the multi-use adjustment mechanism.
Figure 22E:
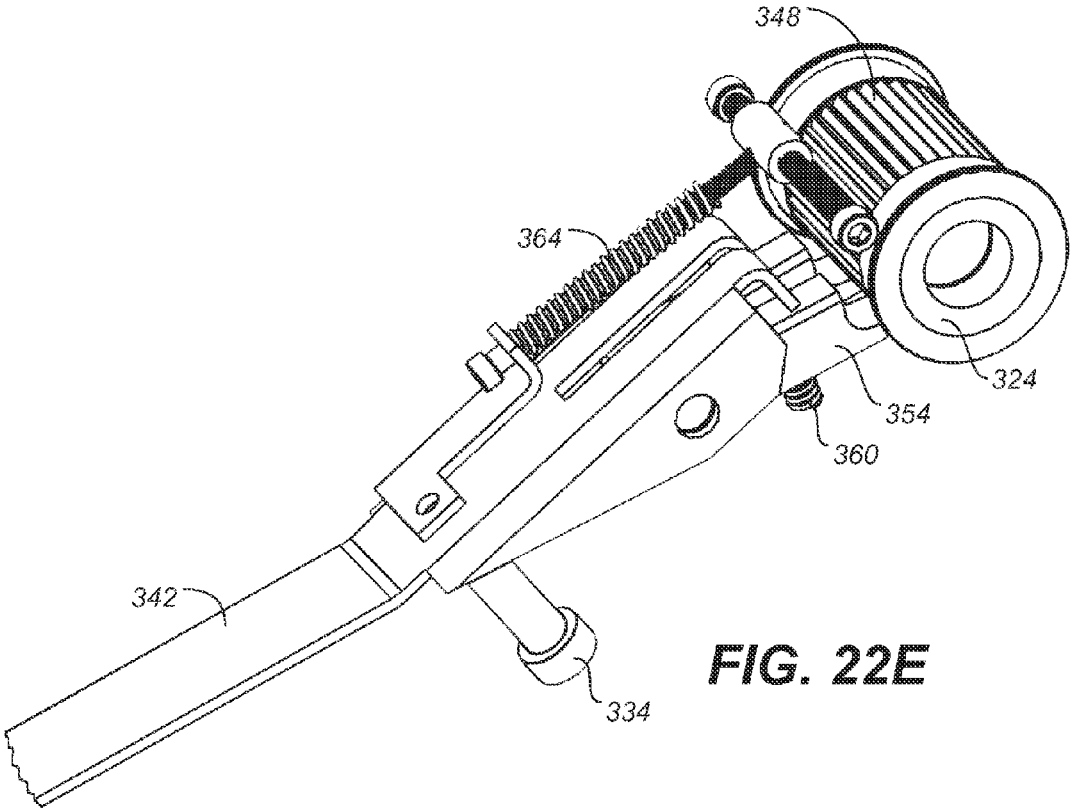
Figure 22F:
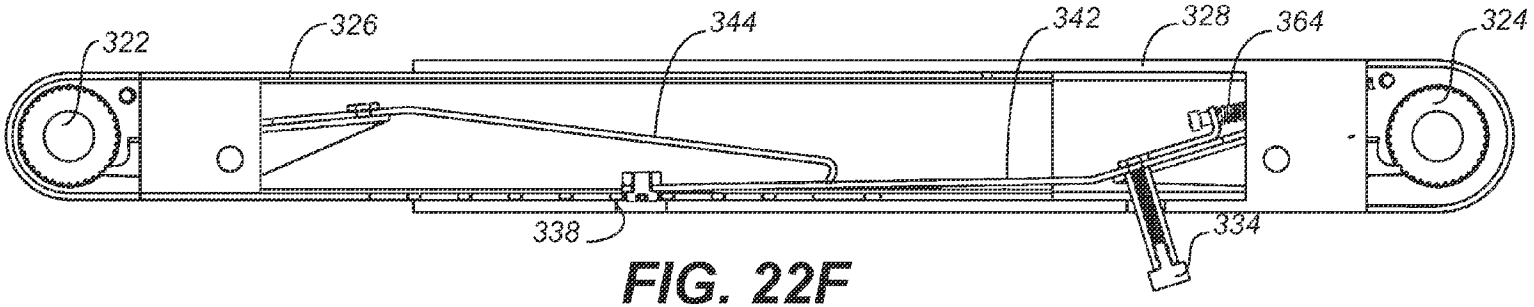
FIGS. 22F-22H are cross-sectional side views in elevation showing how the locking tab of the linear slides engaged with and disengage from the telescopic tubes so as to permit length adjustment and how the pawls engage and disengage the ratchets to allow rotation of each.
Figure 22G:
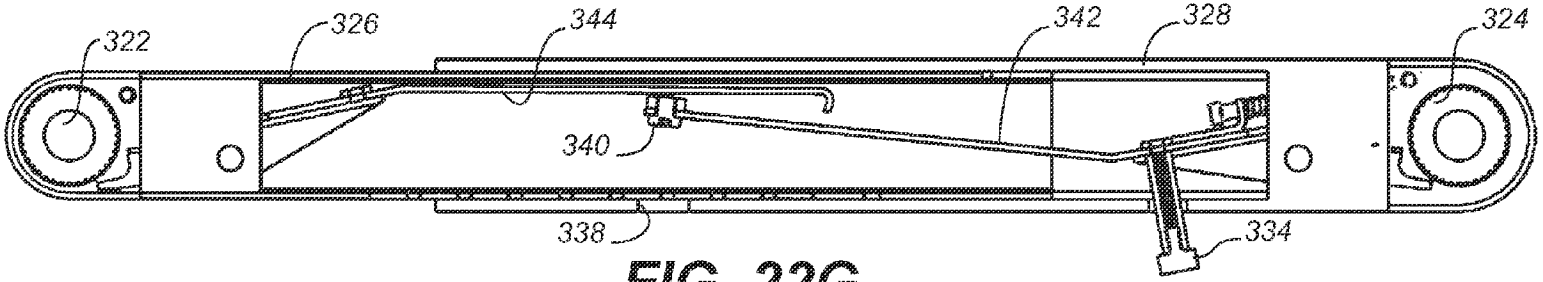
Figure 22H:
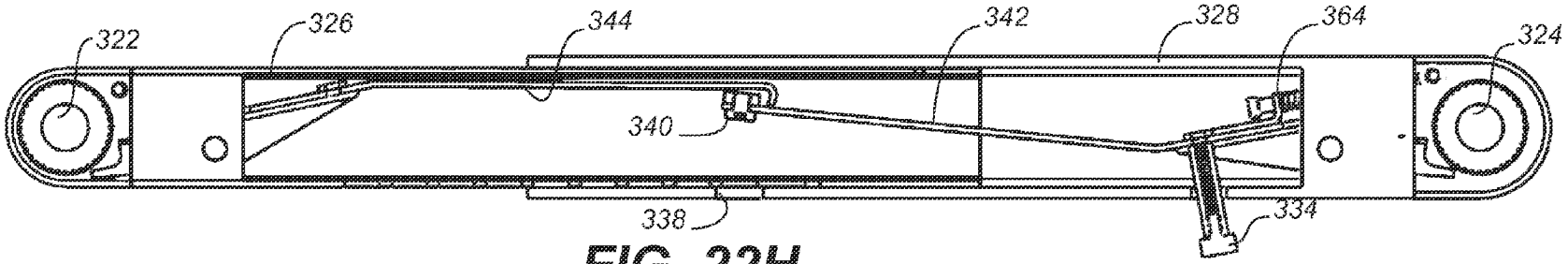
Figure 23A:
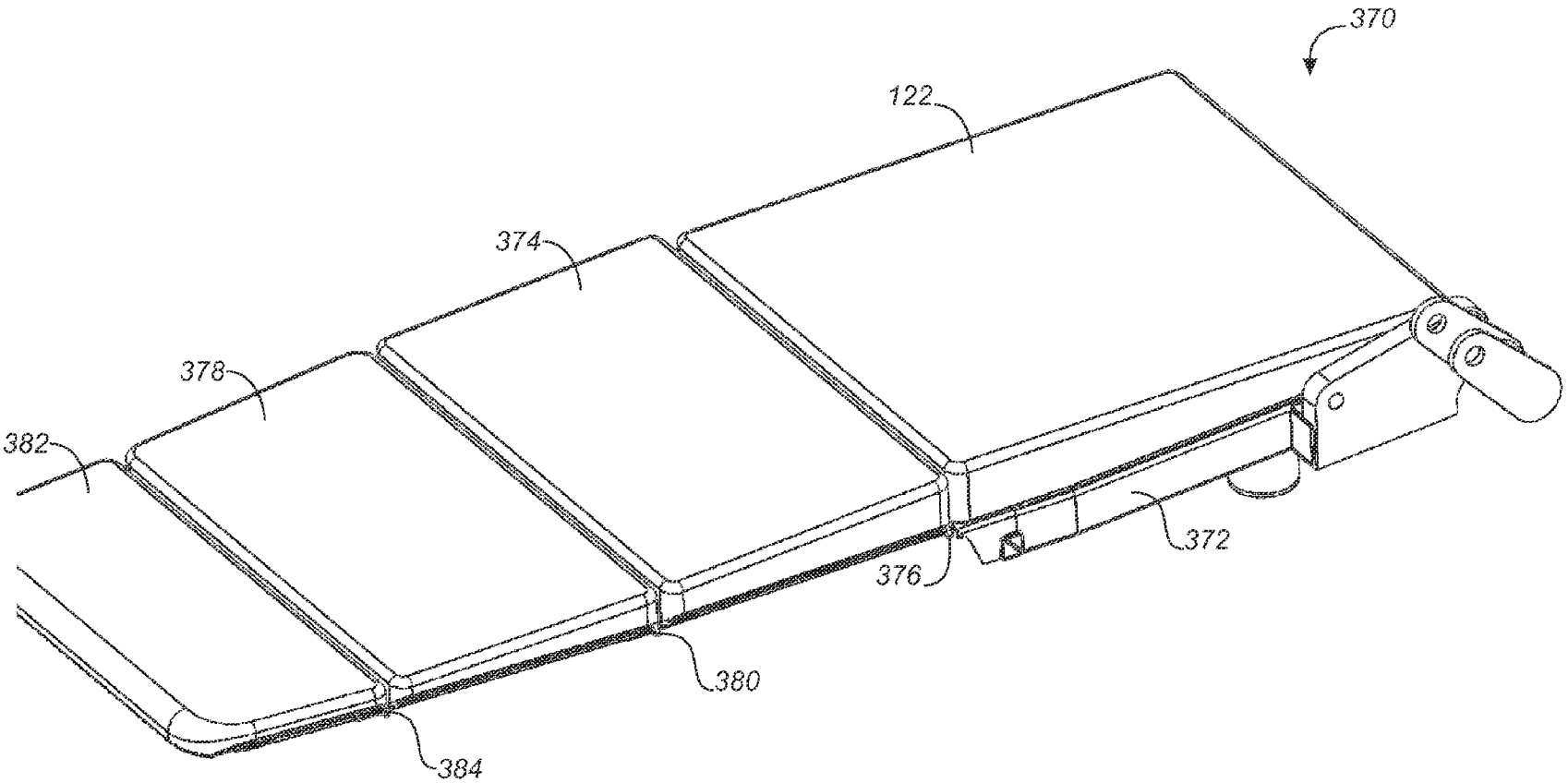
FIG. 23A is an upper right perspective view showing the leg rest in a fully deployed configuration.
Figure 23B:
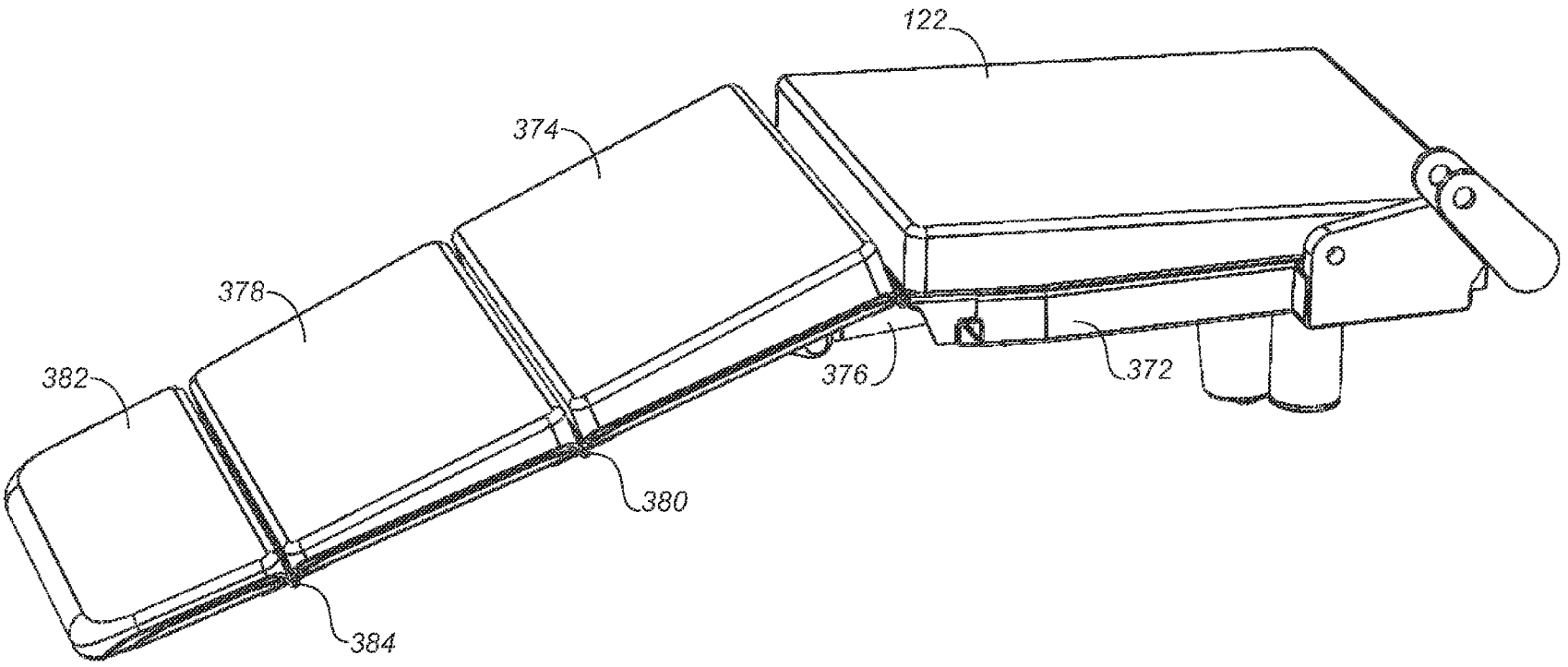
FIG. 23B is an upper right perspective view showing the leg rest with a fold commencing at the scat bottom front edge.
Figure 23C:
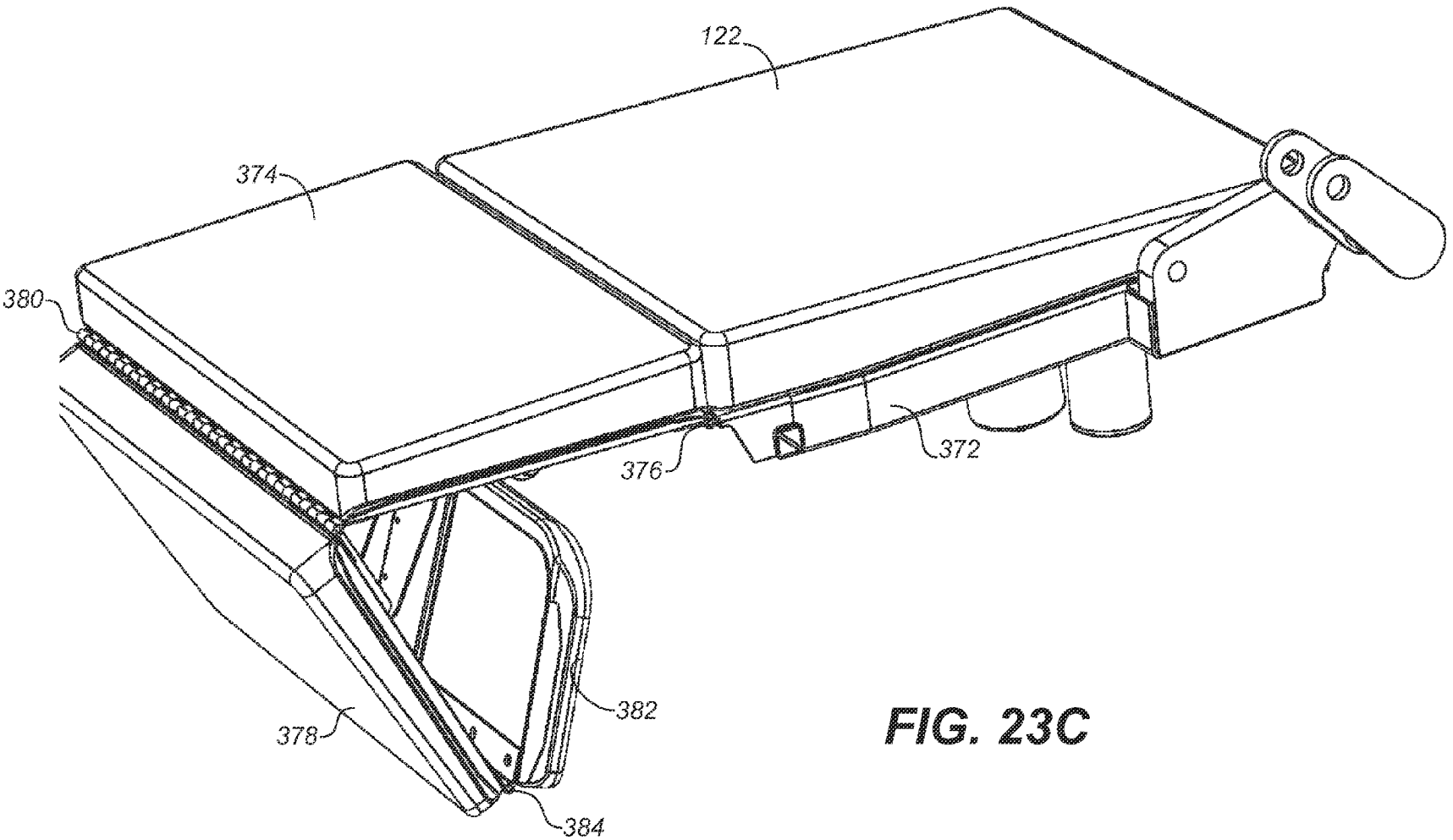
FIG. 23C is an upper right perspective view showing the leg rest with the distal two panels folded under into a partially retracted configuration.
Figure 23D:
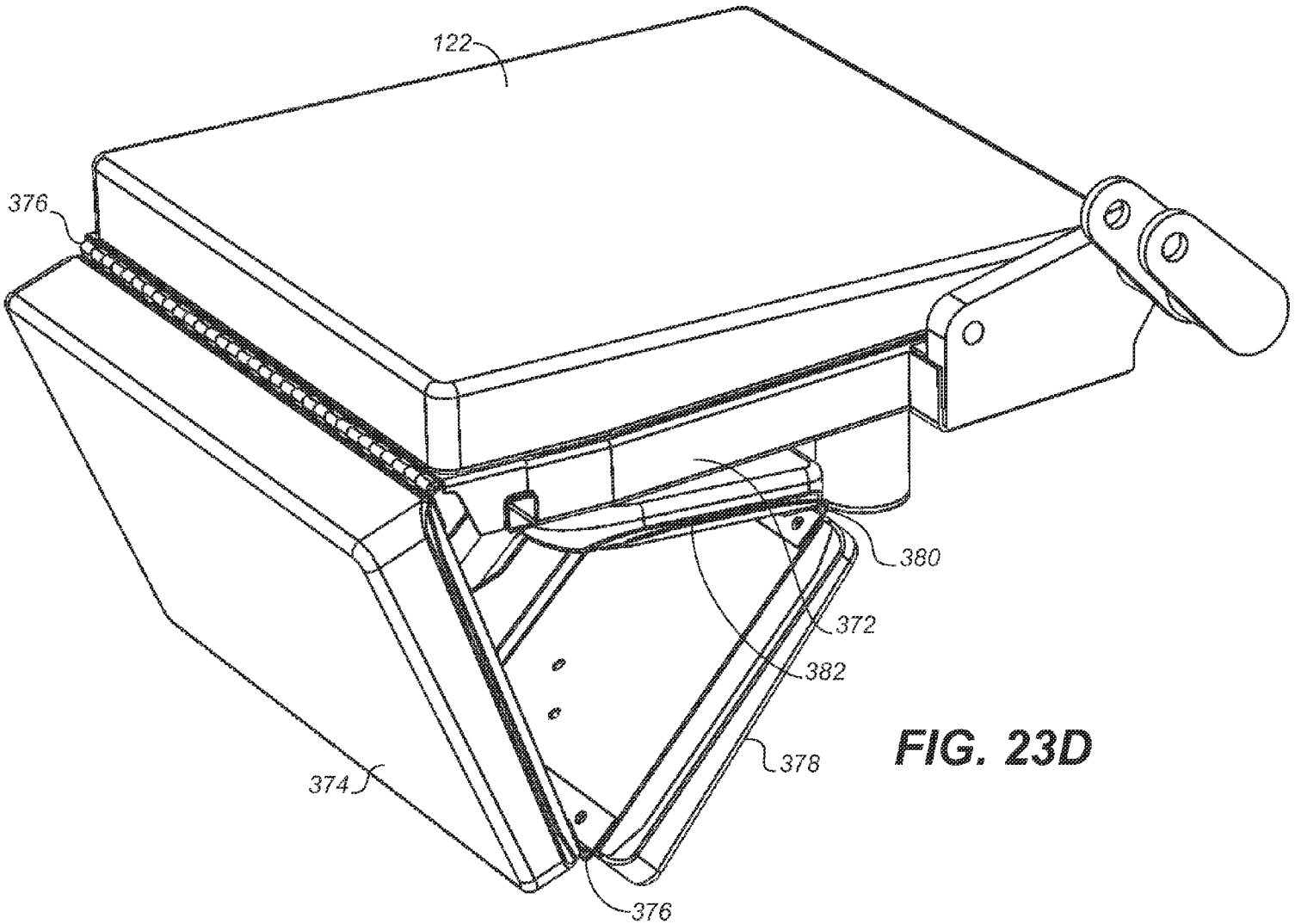
FIG. 23D is an upper right perspective view showing the leg rest with the distal two panels folded under into the fully retracted configuration.
Figure 23E:
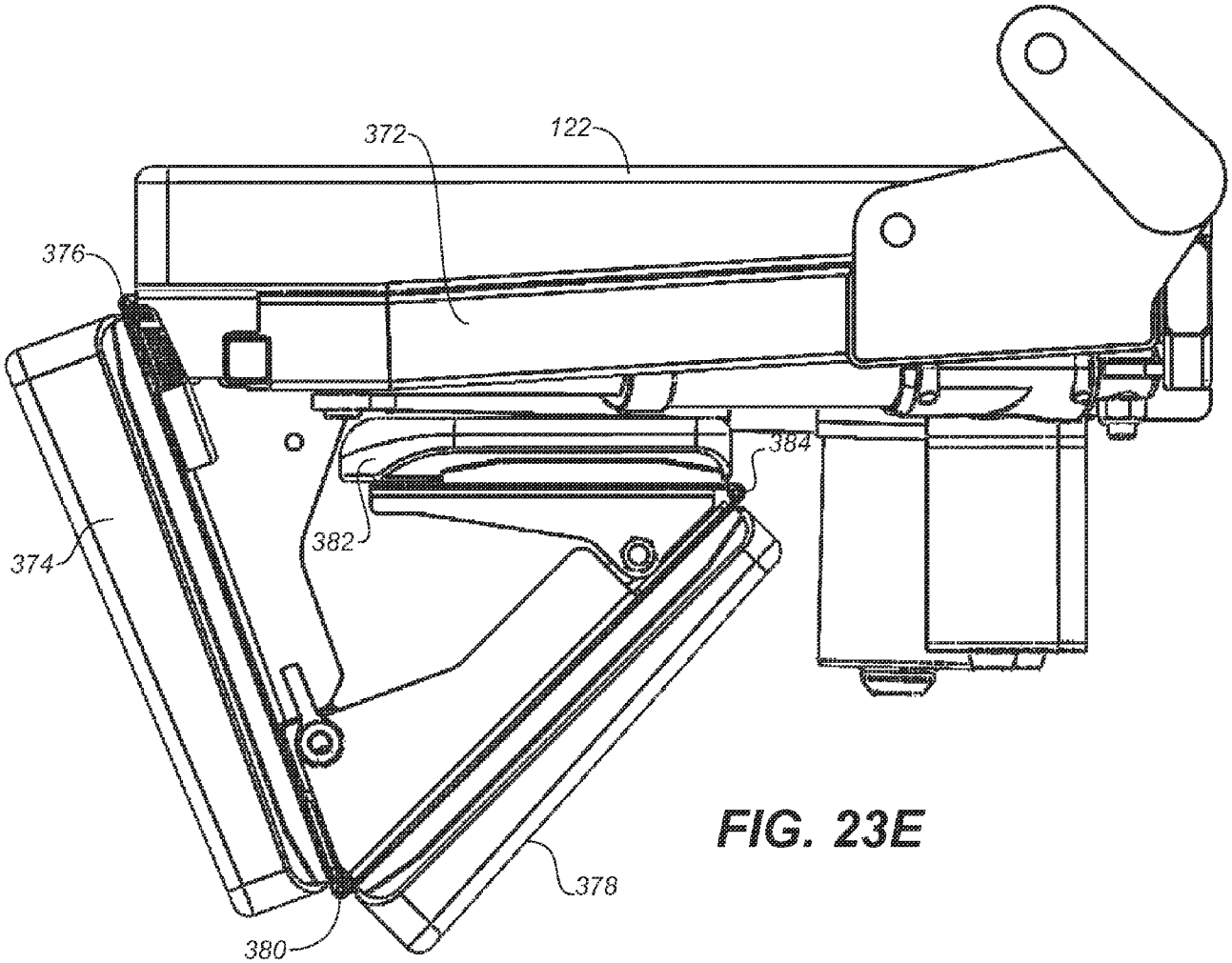
FIG. 23E is a right side view in elevation thereof.
Figure 23F:
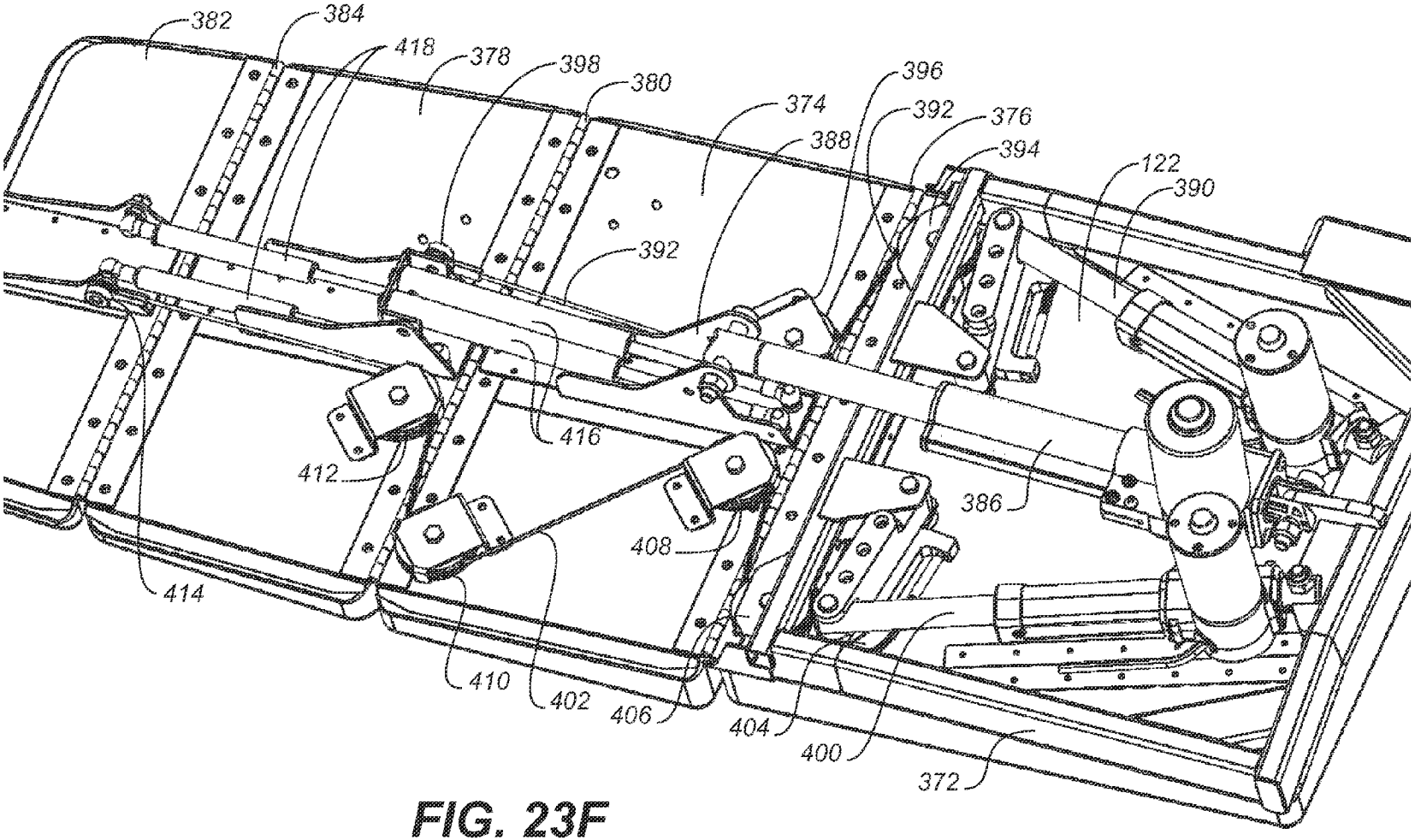
FIG. 23F is a bottom left perspective view of the underside of the leg rest, showing the leg rest in a fully deployed configuration, as in FIG. 23A, and particularly showing the gas springs, linear actuator, and cables involved in the apparatus movements.
Figure 23G:
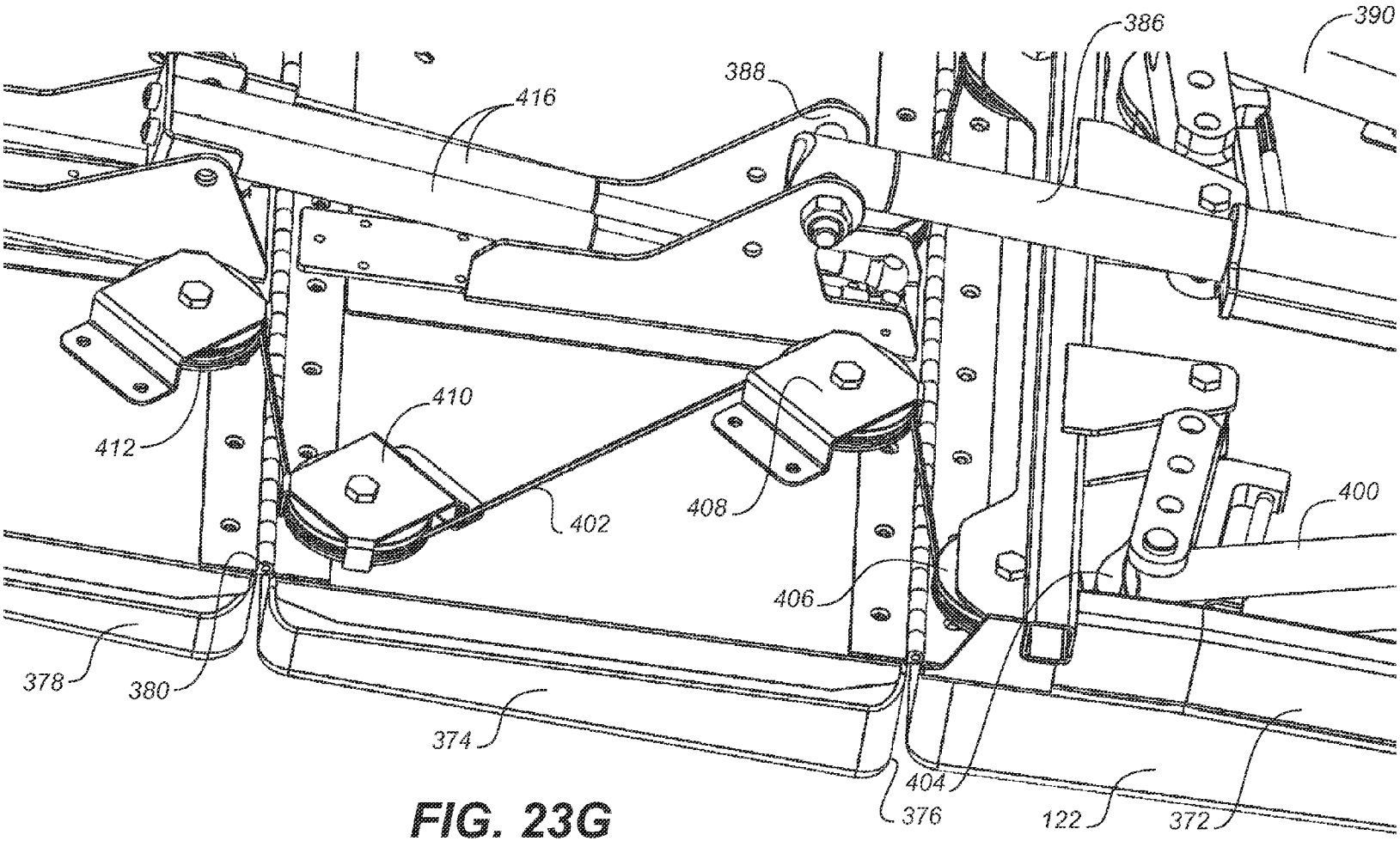
FIG. 23G is a detailed bottom left perspective view showing the deployment and retraction apparatus for the leg rest, focusing on the seat bottom, first and second panels.
Figure 23H:
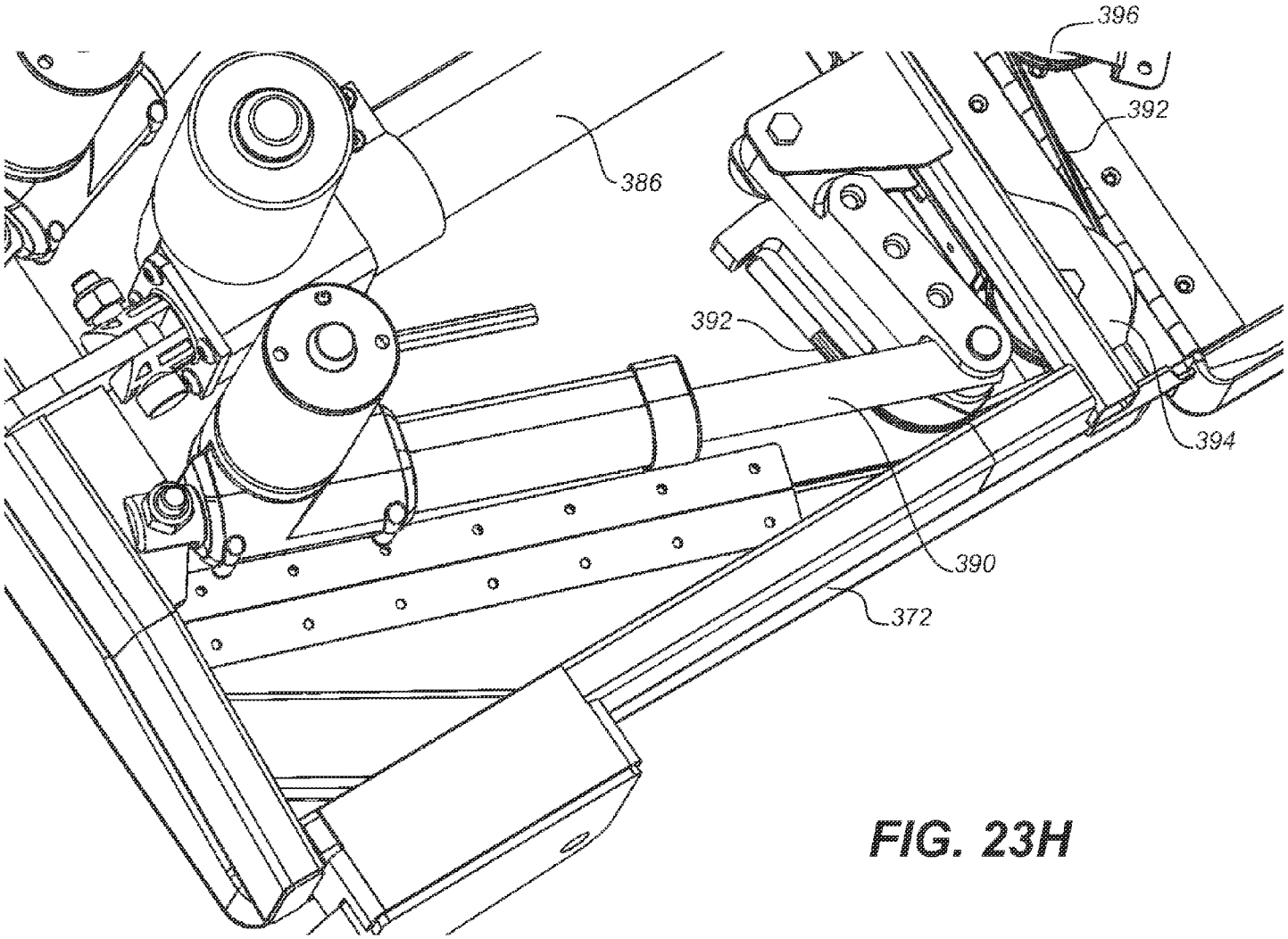
FIG. 23H is a detailed bottom right perspective view showing the deployment and retraction apparatus for a portion of the main seat and bottom first panel.

FIGS. 22F-22H show how the locking, tab is disengaged by depressing release button 334 so as so permit slides 342, 344 to translate laterally to lengthen or shorten the adjustment mechanism. When the desired length is reached, the release button is released and is urged down and out from hole 336 by compression spring 364.

FIGS. 23A through 23H show the retractable leg rest 370 of the present invention. The views collectively teach three pivoting panels that deploy from a main seat, the seat bottom 122 mounted on a main seat frame 372. The first panel 374 is pivotally connected to the main seat frame 372 through a first hinge 376; the second panel 378 is pivotally connected to the first panel 374 through a. second hinge 380; the third panel 382 is pivotally connected to the second panel 378 through a third hinge 384.

Deployment and retraction of the first through third panels in relation to one another is accomplished by a plurality of gas springs and linear actuators disposed under the main seat and panels and operatively coupled to one another. To accomplish retraction, a system of linear actuators is employed, the system including a first linear actuator 386 pivotally connected to bracket 388, which moves the first panel 374. A second linear actuator 390 is operatively connected to cable 392 and routed around pulleys 394, 396 and terminates in coupling 398 disposed on the underside of the second panel 378. A third linear actuator 400 is operatively connected to cable 402, which is routed through pulleys 404, 406, 408, 410, and 412, each disposed on the underside of the panels, before it terminates in coupling 414 on the underside of the third panel 382.

A pair of compressed gas springs 416 and 418, disposed between each pair of the first and second panels 374, 378, respectively, and the second and third panels 378, 382, respectively maintain the panels in a deployed configuration.

Figure 24A:
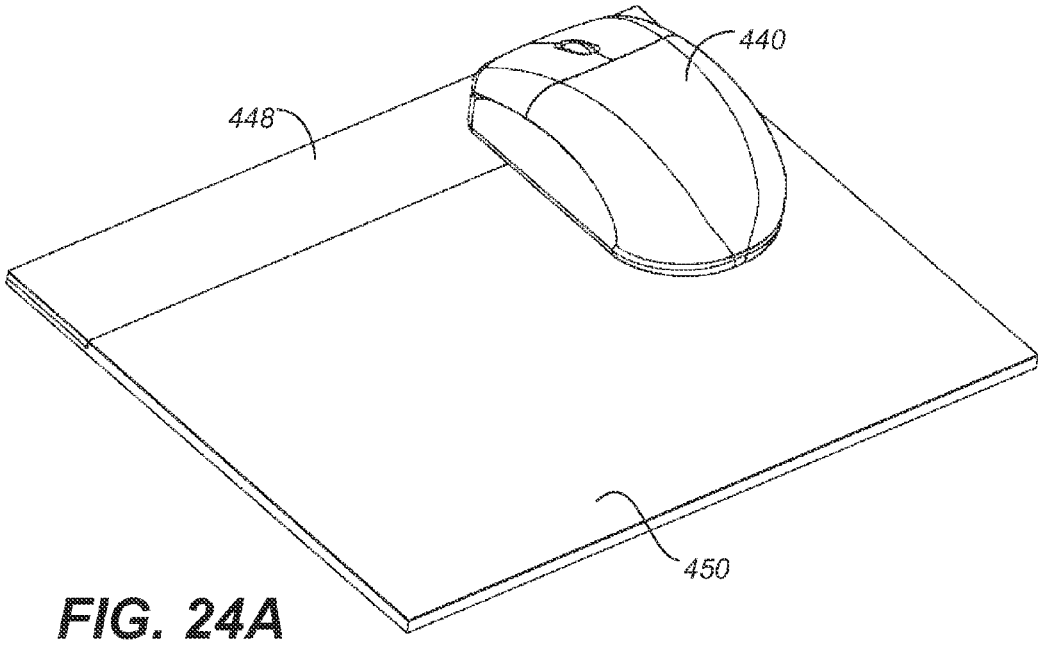
FIGS. 24A and 24B are upper right rear and lower left front perspective views showing the magnetic mouse and mousing surface employed in the present invention.
Figure 24B:
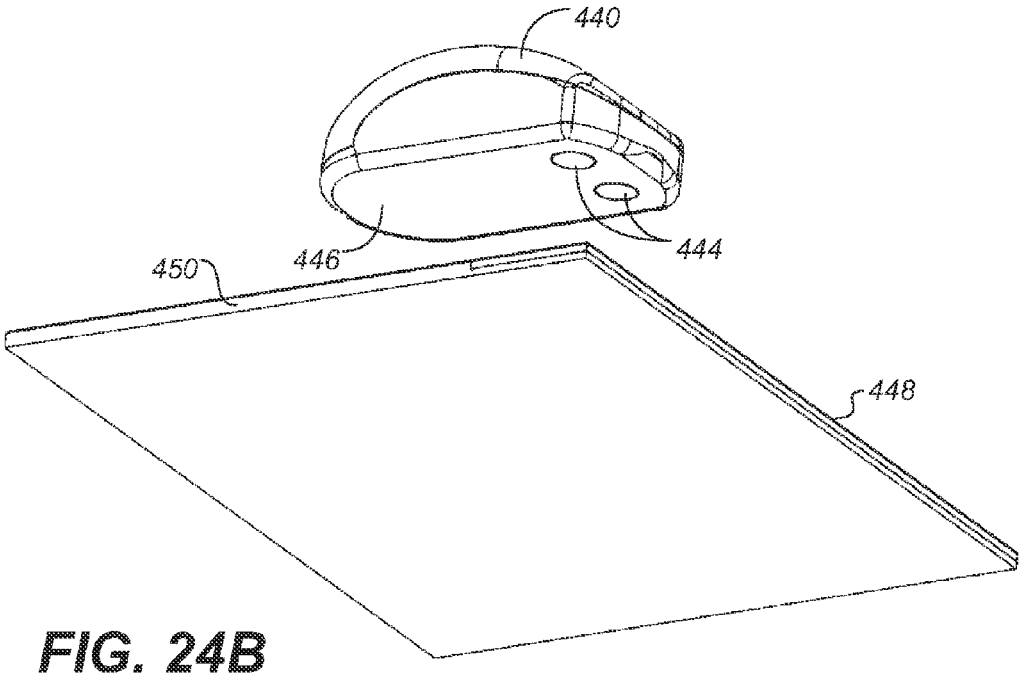
Figure 25:
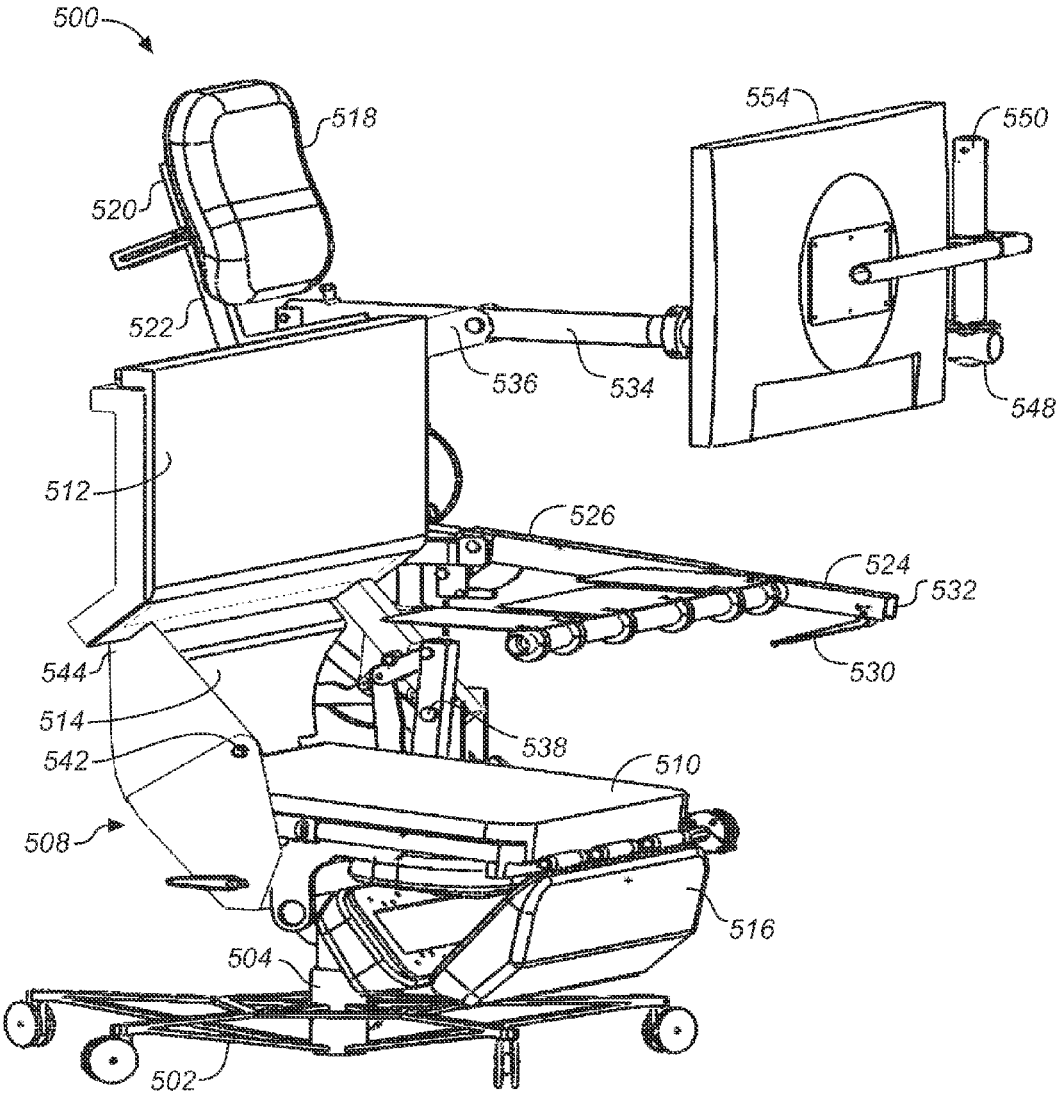
FIG. 25 is an upper front left perspective view of a second preferred embodiment of the inventive ergonomic productivity workstation of the present invention.
Figure 26:
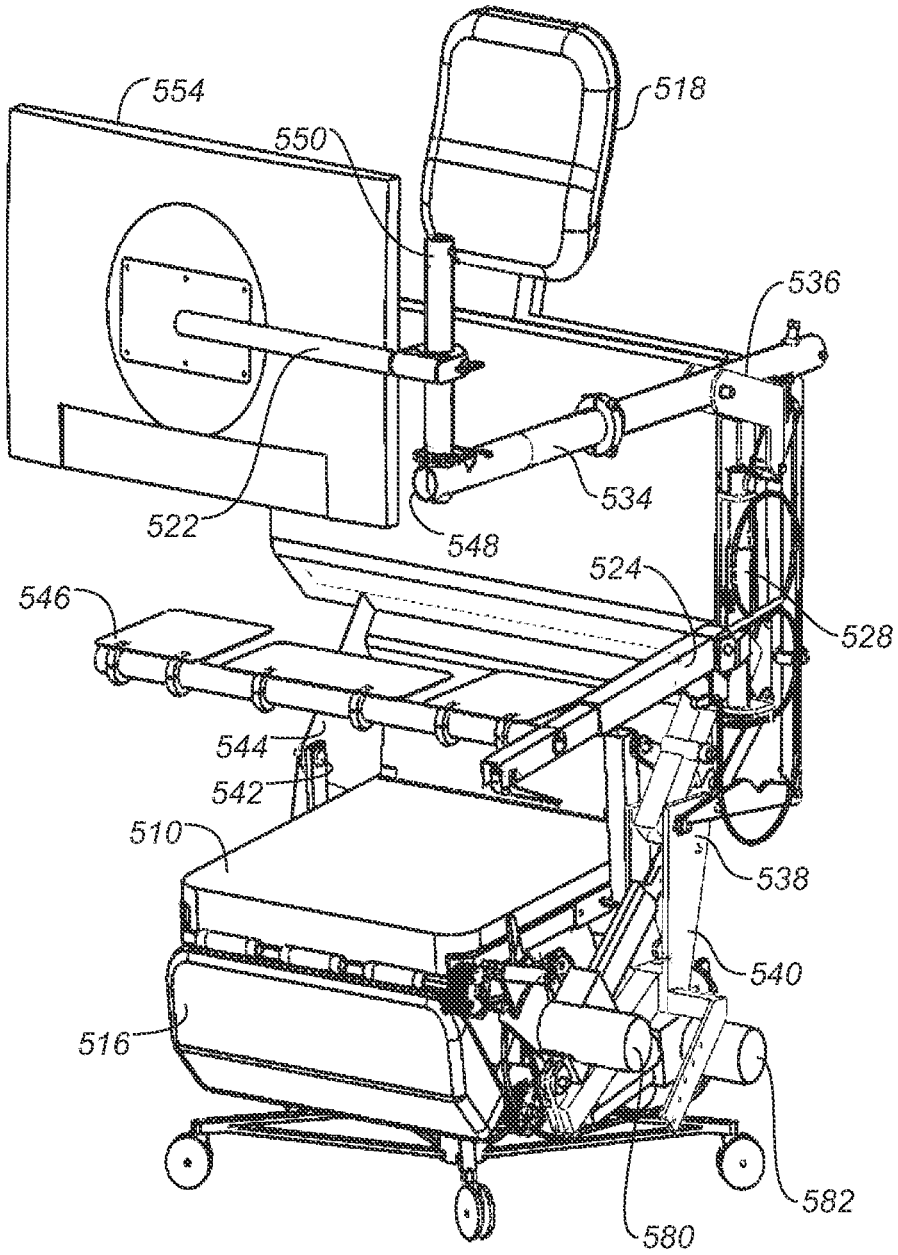
FIG. 26 is an upper front right perspective view thereof.
Figure 27:
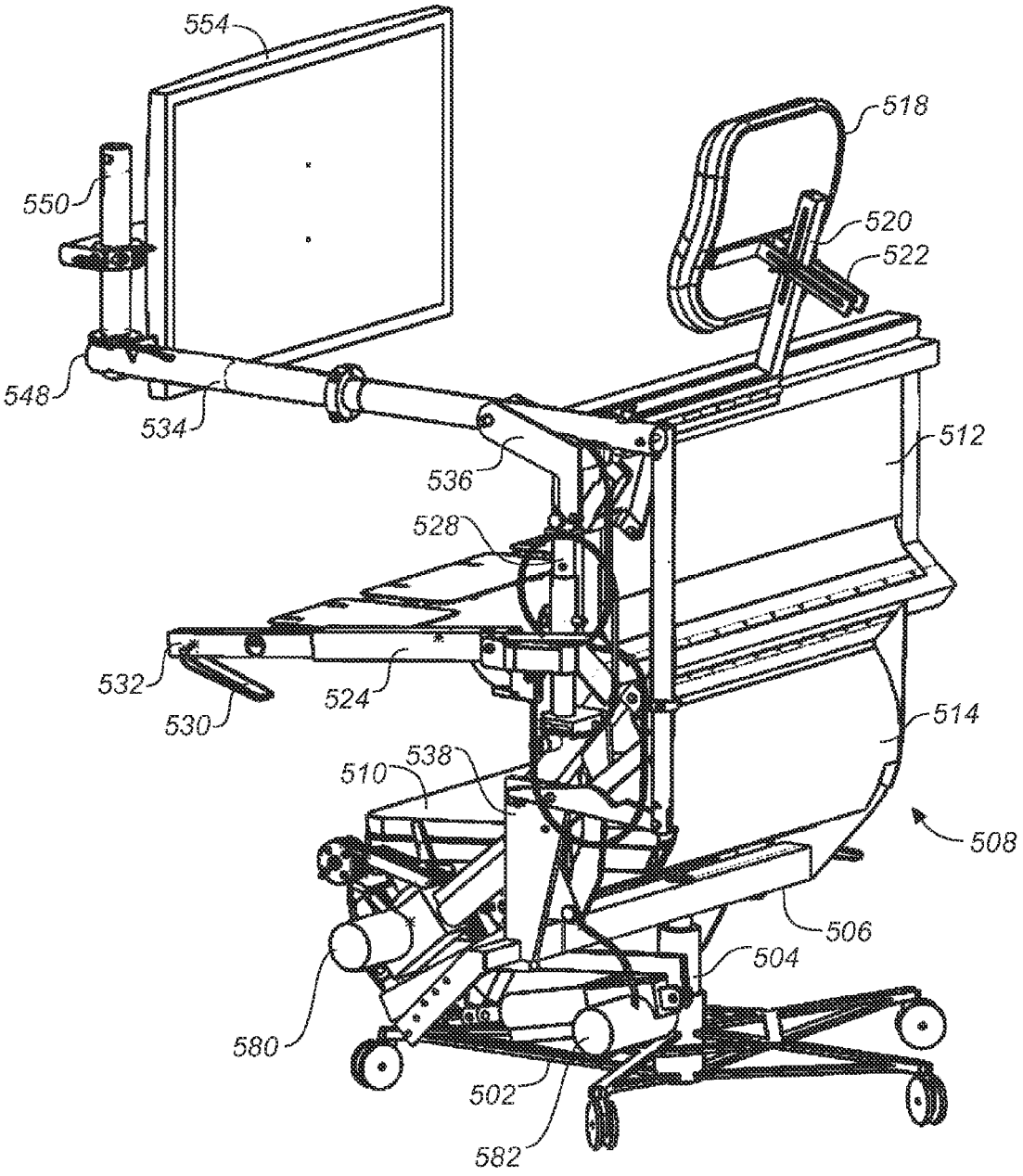
FIG. 27 is an upper rear right perspective view thereof.
Figure 28:
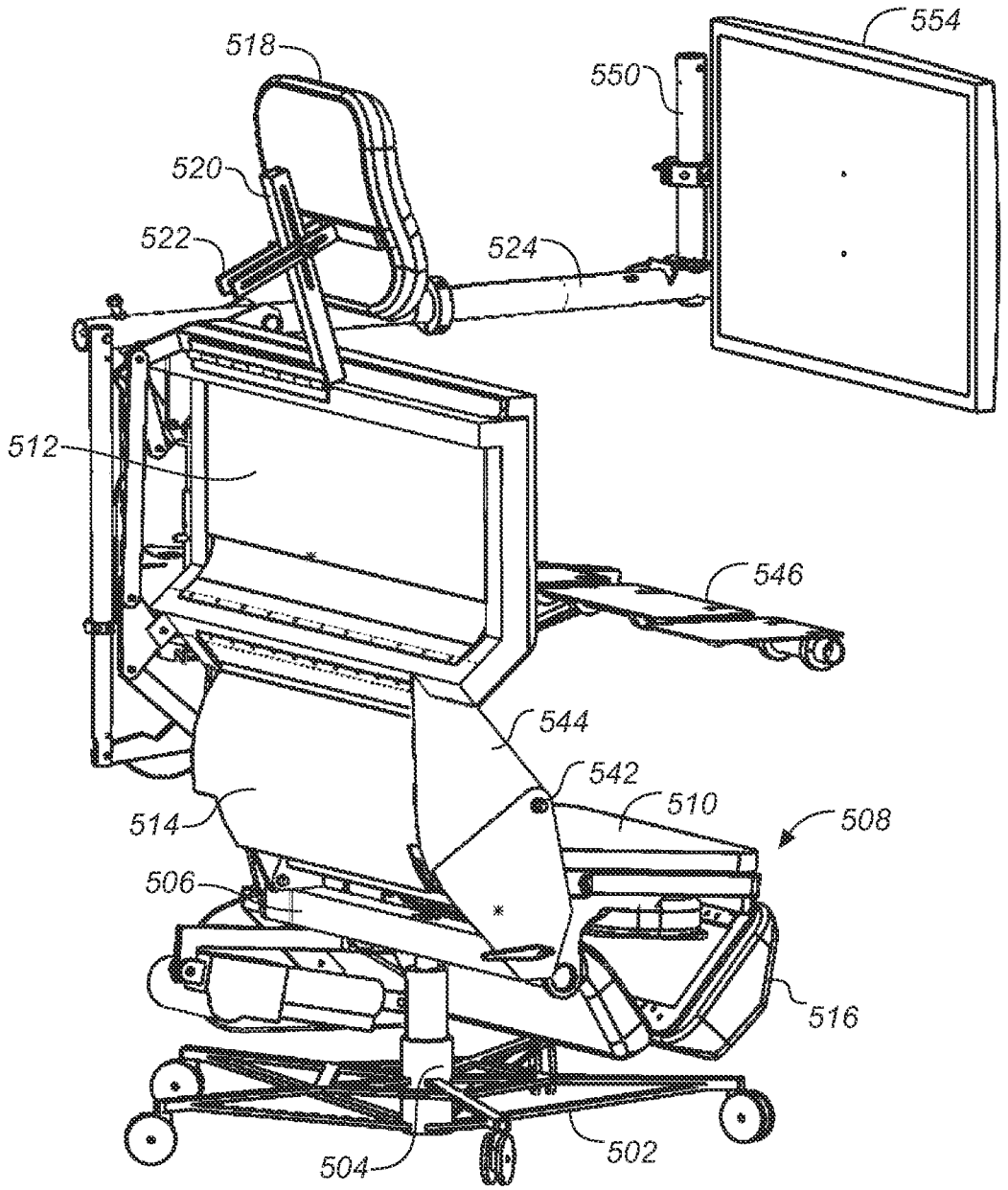
FIG. 28 is an upper left rear perspective view thereof.
Figure 29:
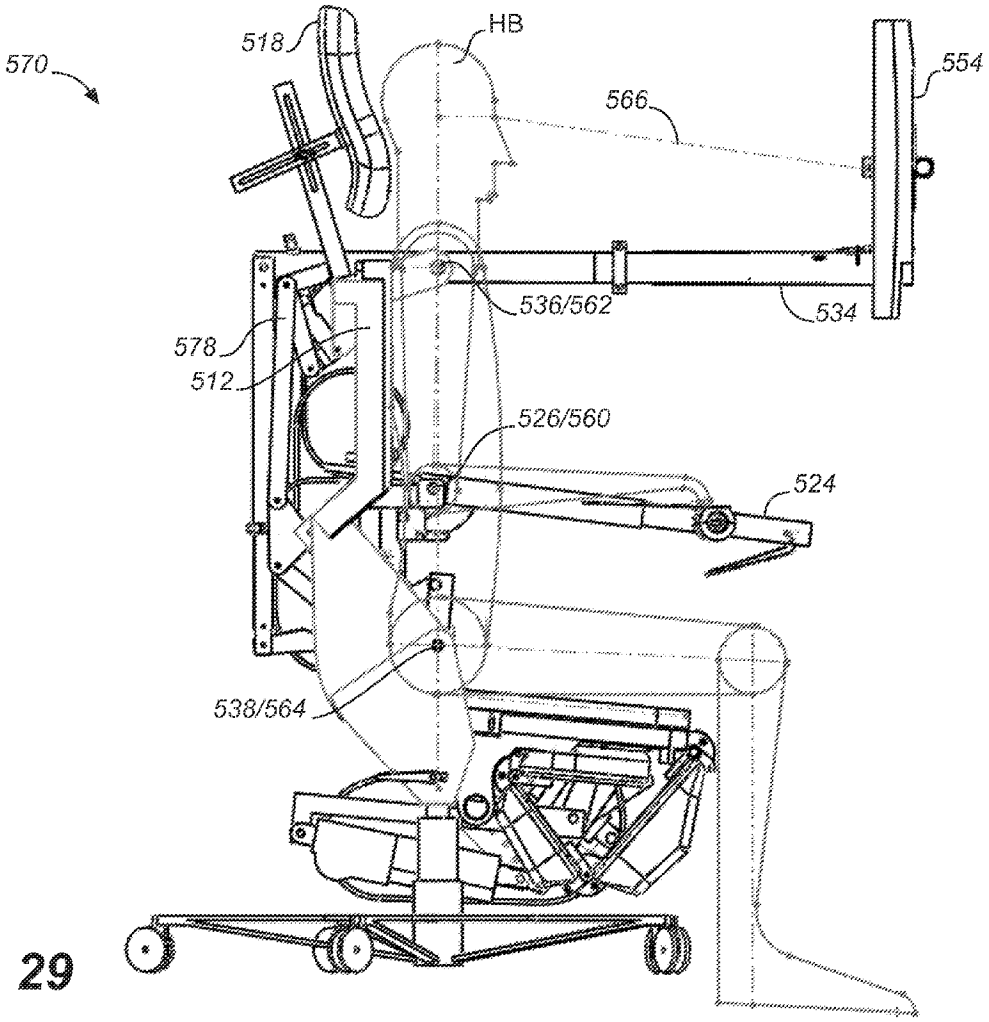
FIG. 29 is a left side view in elevation showing a user seated and in a sitting position in the second preferred embodiment or the inventive ergonomic productivity workstation.
Figure 30:
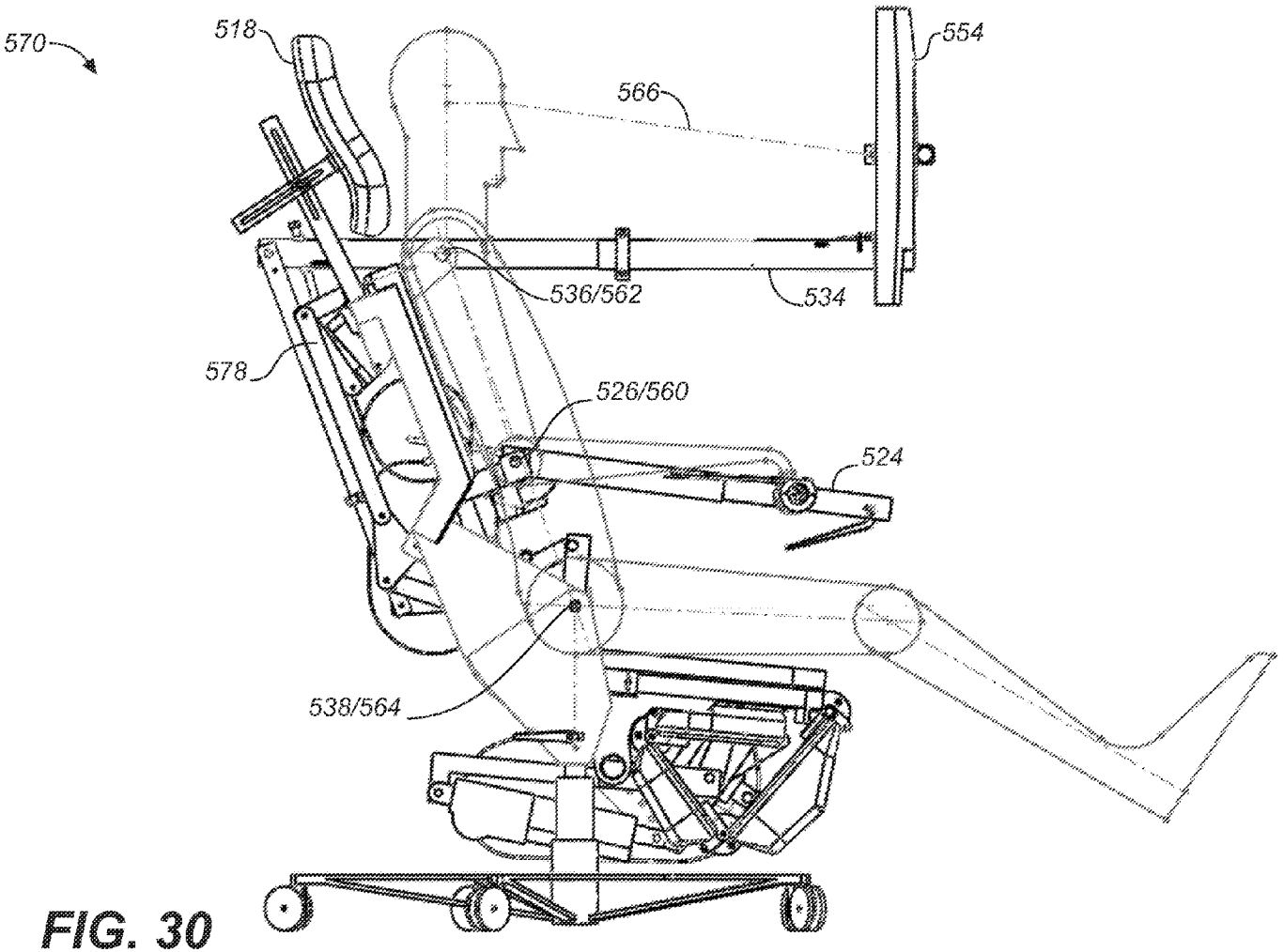
FIG. 30 is a left side view in elevation showing the backrest and user tilted back slightly in the sitting position.
Figure 31:
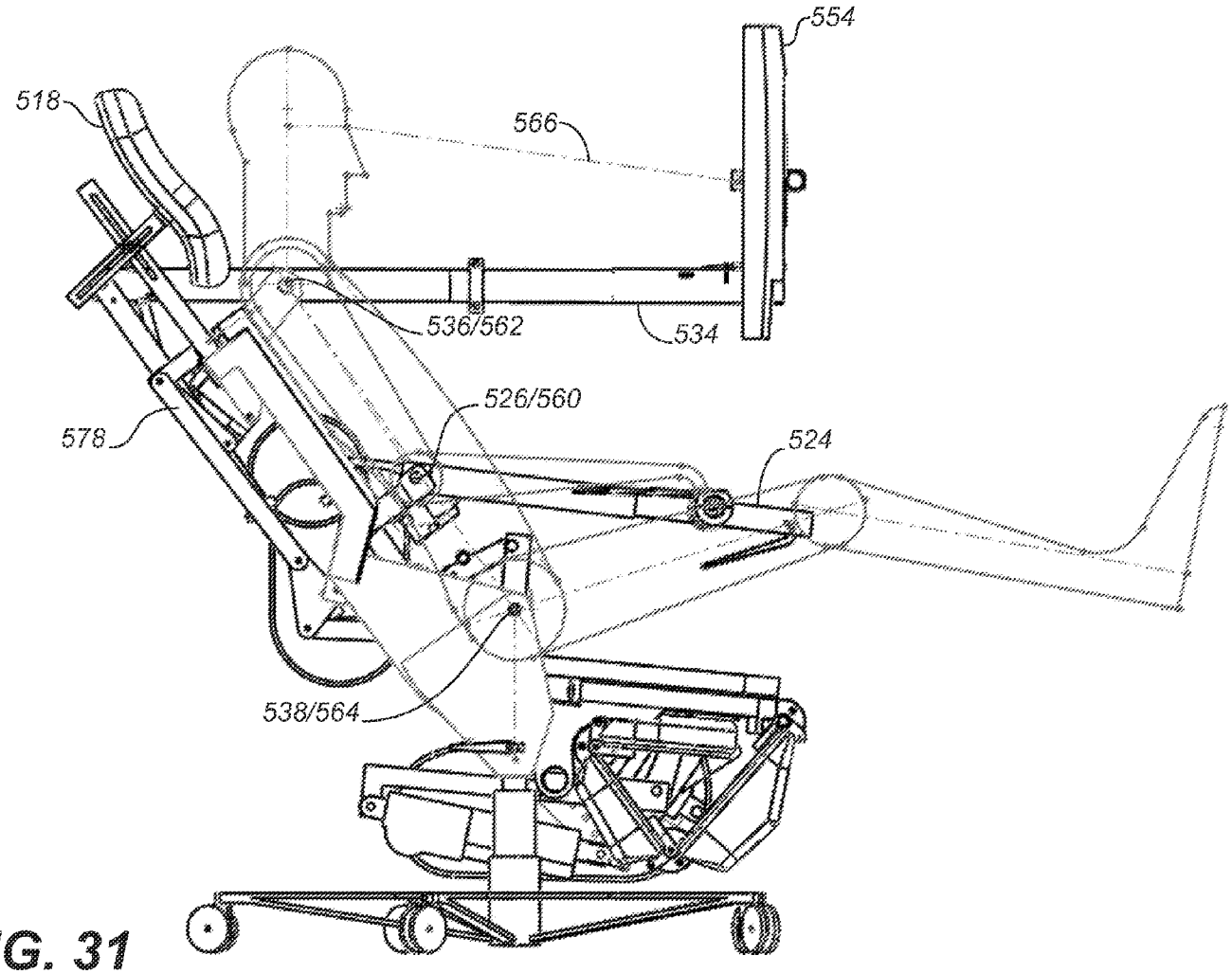
FIG. 31 is a left side view in elevation showing the backrest and the user tilted back at the extreme end of the sitting zone immediately before entering a posture and chair configuration characteristic of the transition zone.
Figure 32:
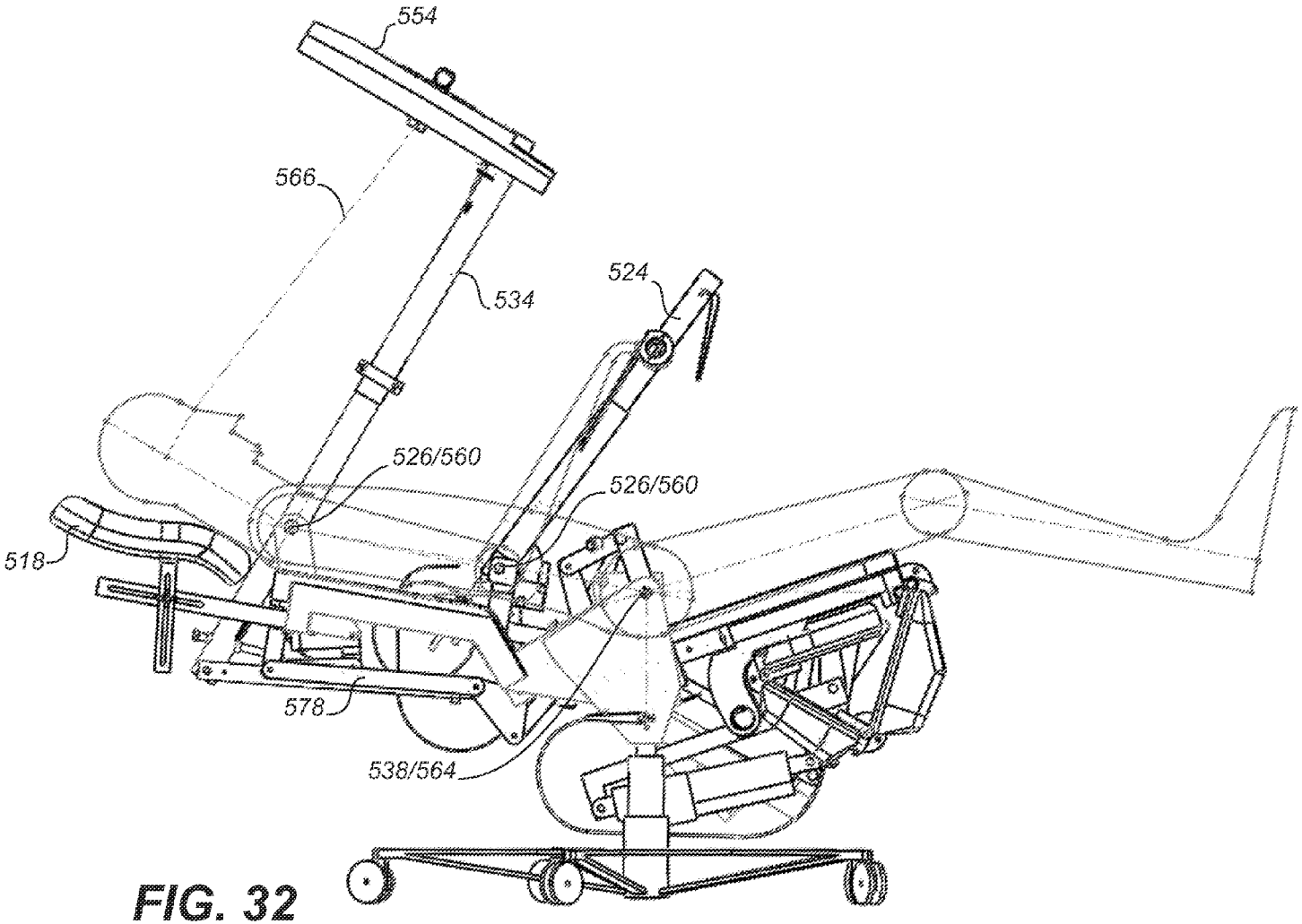
FIG. 32 is a left side view in elevation showing the user in a fully reclined position.
Figure 33A:
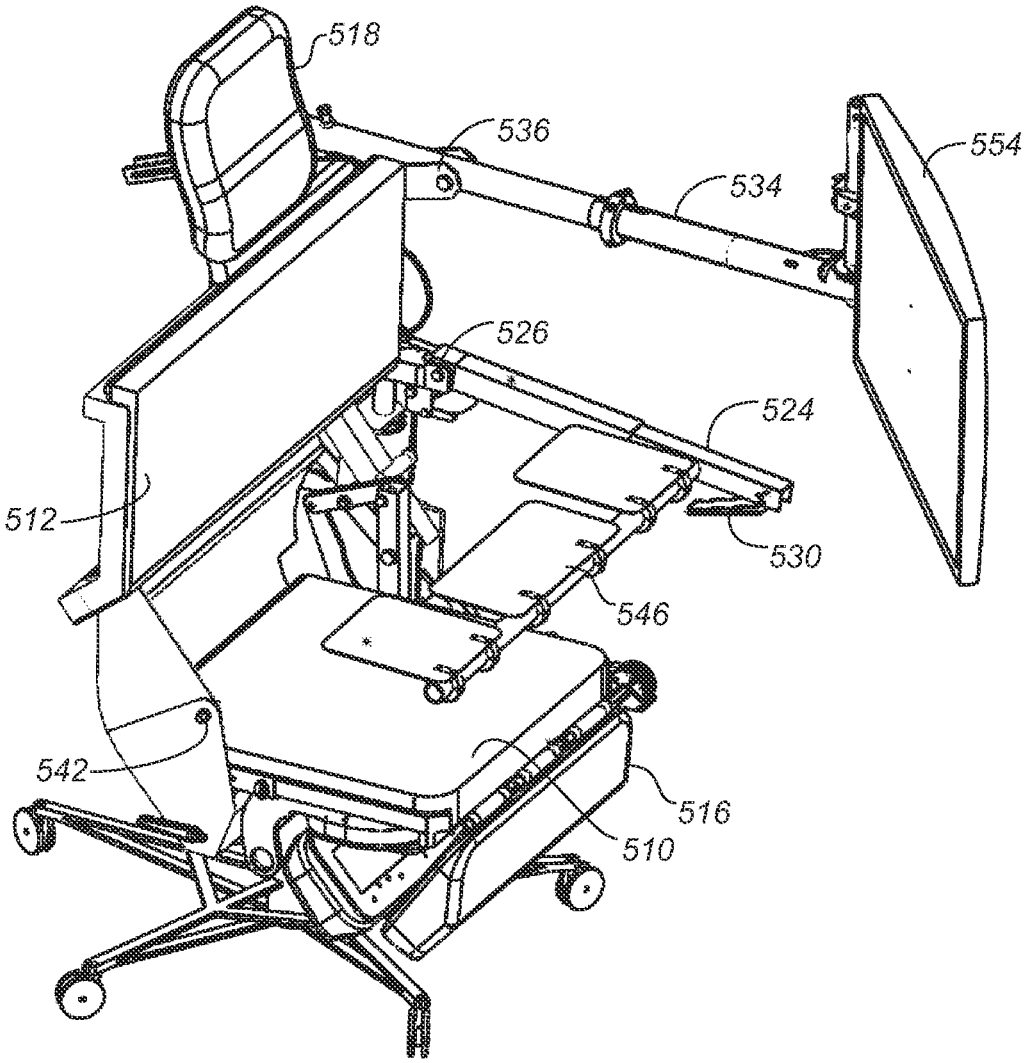
FIG. 33A is an upper left front perspective view showing the second preferred embodiment in the collaboration configuration.
Figure 33B:
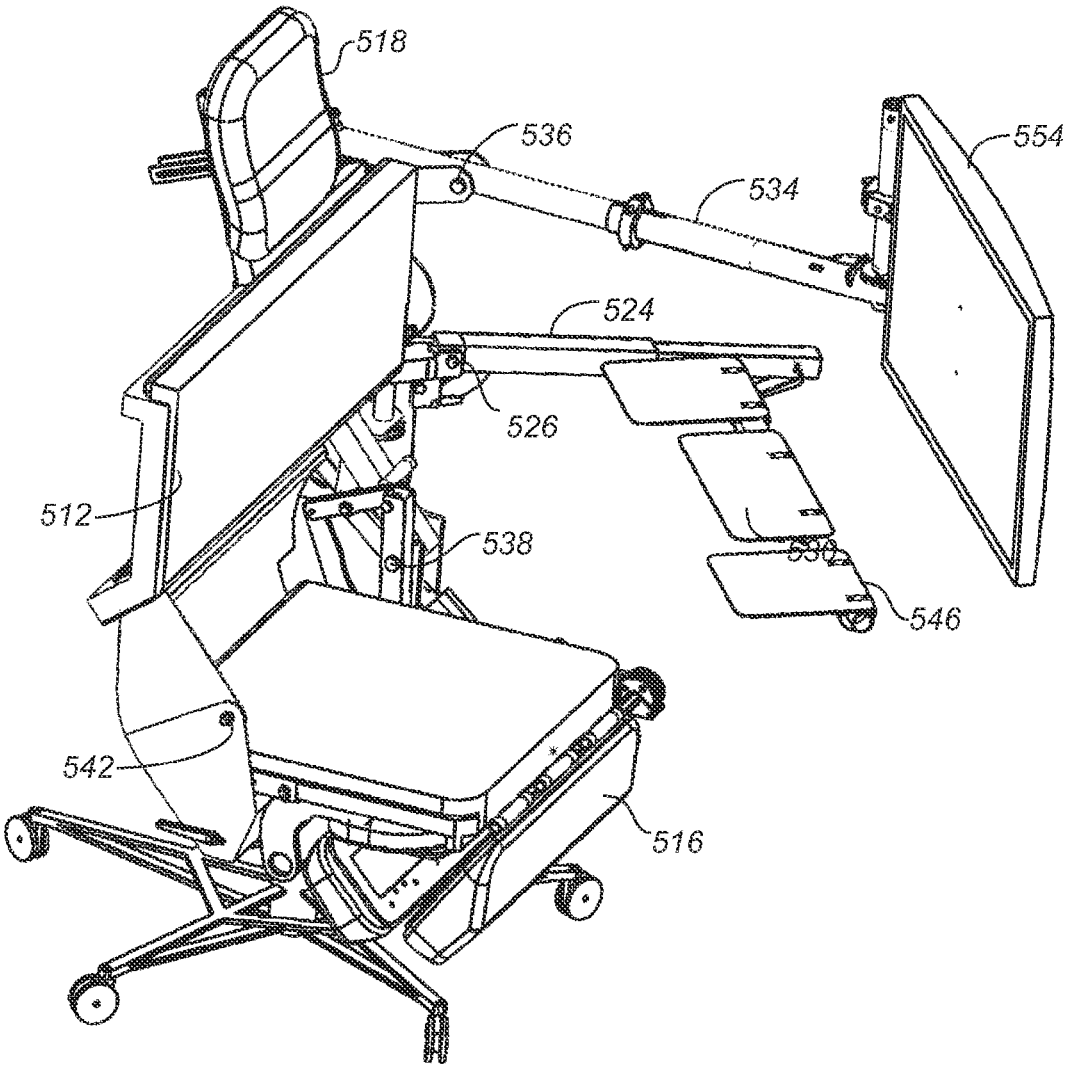
FIG. 33B is the same view showing the monitor and keyboard tray pivoted away so as to enable mounting and dismounting of the seat.

FIGS. 24A-24B are upper right rear and lower left front perspective views showing a preferred embodiment of a magnetic mouse 440 and mousing surface 442 employed in the present invention. This simple improvement renders a conventional wireless mouse useable on highly tilted surfaces that such as can be achieved by the input device trays in the present invention. This is achieved by embedding or otherwise placing one or more sufficiently powerful magnets 444, preferably neodymium magnets, on the underside 446 of the mouse 440, which cooperates with a ferromagnetic portion 448 comprising, part of the mousing surface 450. In another preferred embodiment, the magnets can be positioned in a second tray or other compartment that can be independently attached to the mouse, thereby enabling the user to retrofit and transform a conventional wireless mouse into a magnetic mouse. In still another embodiment, the mousing surface 450 can include a magnetic portion and the mouse 440 can include a ferromagnetic portion.

While the leg rest and seat bottom cooperate to place the user in optimal positions so as to minimize pressure on pressure points in the legs and so as to facilitate healthy circulation in the extremities, the motions and angles of the seat bottom and leg rest do not affect the motions of the monitor and keyboard trays; those remain operatively independent, FIGS. 25-40 show a second preferred embodiment 500 of the inventive ergonomic productivity workstation. As with the first preferred embodiment discussed above, the second preferred embodiment achieves a tightly coordinated and harmonized synchronous movement of the system seat, seat back, head rest, monitor, and input device try, and it does so through a close alignment of the mechanical axes of the workstation and the anatomical axes of the workstation user.

This expression of the inventive concept includes a rolling base 502 having a height adjustable vertical support post 504 on which a frame member 506 of a task chair 508 is mounted. The task chair includes a seat bottom 510 and a seat back 512, a lower lumbar pinch guard 514 disposed between the seat bottom and seat back, a three-panel fully extendable and fully retractable leg rest 516, and a head rest 518 supported by adjustable vertical and horizontal head rest supports 520, 522.

The system further includes a telescopically adjustable lower input device horizontal support arm 524 pivotally connected through a linkage assembly at its proximal end 526 to a vertical support 528 and having a control brake 530 at its distal end 532.

A second, upper, telescopically adjustable horizontal monitor arm 534 is pivotally connected at its proximal end 536 through a linkage assembly to the seat back 512 and seat frame 506 through the seat master pivot axis 538 disposed through a right seat side plate 540. The axis extends geometrically through a second axis point 542 in a left seat side plate 544.

Mounted on the lower horizontal support arm 524 is an input device rail and tray 546. Disposed upwardly from the distal end 548 of the upper horizontal support arm 534 is a vertical monitor post 550 to which is clamped a vertically and pivotally adjustable horizontal monitor rail 552 and a monitor 554 mounted thereon.

Looking now at FIGS. 29-32, it will be noted that the pivotal connection 526 of lower horizontal (input device) arm 524 is generally level with and aligned with the humeral-ulnar joint 560 of the user HB, the pivotal connection 536 of the upper horizontal arm 534 is generally level with and aligned with the effective rotation point 562 (at about the level of the gleno-humeral joint, i.e., the shoulder) of the user, and the master seat axis 538 is generally level with, and closely aligned with, the user's femoral-acetabular joint 564. With this mechanical/anatomical correspondence established, the system of linkages operatively coupled to the support arms and the seat back maintain the proper eye-to-monitor distance 566, with the desired eye depression angle, and with the input device tray 546 the proper distance and elevation at all times. This is shown for the user in the sitting position 570, FIG. 29; in the middle of the sitting zone range 572, FIG. 30; the extreme end of the sitting zone 574, FIG. 31; and in the reclining zone 576, FIG. 32.

As in the first preferred embodiment, the head rest linkage 578 does not bring the head rest 518 into engagement with the head for support until the seat back is sufficiently tilted (angled back to about 45 degrees at the end of the transition zone), though such an operation is not prohibited under the essential principle of operation of the workstation. Indeed, it may be desirable for some users to have head support earlier in the transition zone, and considerable range of adjustments or different settings are contemplated and within the scope of the invention.

Power to move the linkage systems may be provided by electric actuators, and in the preferred embodiment shown, two electric actuators are included: a first electric actuator 580 for the seat back and connected linkage and cam systems; and a second actuator 582 for the leg rest.

Referring next to FIGS. 36A-36C and 40 we see representative views showing details of the linkage and cam assemblies for maintaining the above-described parallelogram geometry and relationships of the various system elements as user moves through the range of operation zones.

Looking first at FIGS. 35-37, we see that on mounting the workstation the user pushes on the input device arm 524 and monitor 554 to swivel them away for ease of mounting/dismounting. In the event he or she wishes to work in collaborate mode (see, for instance, FIGS. 33A through 34B), he or she can simply push only the monitor away. The user will also set the preferred monitor-to-eye distance using the telescoping upper horizontal support 534 and vertical height with the adjustments available with the horizontal monitor rail 552 clamped to vertical support 550.

Mechanical features that contribute to the mobility of arm 524 include mounting brackets 594, 596, onto which vertical support tube 528 is pivotally mounted. The horizontal arm pivot pin 526 is co-located with and defines pivot axis, thus also 526 herein, The arm is held up by a pawl and ratchet assembly 590 including a ratchet wheel 600 and ratchet pawl 598. Pulling release lever 530 pulls cable 592, disengaging the pawl 598 from the ratchet wheel 600 and allowing the arm to be moved vertically. Simultaneously, pulling release lever 530 pulls link 602, which in turn pulls a brake lock 602 out of engagement by rotating it about a rotation point 606, allowing the arm 532 to telescopically slide inside tube 524, thus adjusting the keyboard distance.

FIGS. 38A-38C and FIG. 40 illustrate the operation of a cam and linkage system that coordinates and harmonizes the monitor arm elevation with the seat back tilting. FIG. 38A shows a cam follower 610 and cam arm 612 when the system is configured in the sitting zone of operation. Upper horizontal monitor arm 534 is linked to cam arm 612 through link 614. This view shows that the cam an is prevented from counterclockwise rotation by a contact pin 616. In this configuration, the cam follower does not engage cam arm 612.

Turning now to FIG. 38B, cam follower 610 comes into contact with cam arm 612 as the seat back it tilted into the transition zone. Follower 610 drives link 616 down around pivot point 618, thereby elevating horizontal monitor arm 534. As can be seen from the configuration of cam arm 610, the cam lobe shape will dictate that the monitor arm elevate as the seat back continues to tilt.

Looking now at FIG. 38C, when the seat back 512 is tilted into the extreme end of the transition zone the link 614 has pulled the monitor arm 534 clockwise (as viewed from the right) as the cam arm 612 has rotated under force applied by cam follower 610 operatively connected to the seat back. In short, as the seat back is tilted back, the cam follower traces up the cam arm lobe, thereby driving cam arm down in relation to pivot 618 and pulling monitor arm up around pivot point 536.

Figure 34B:
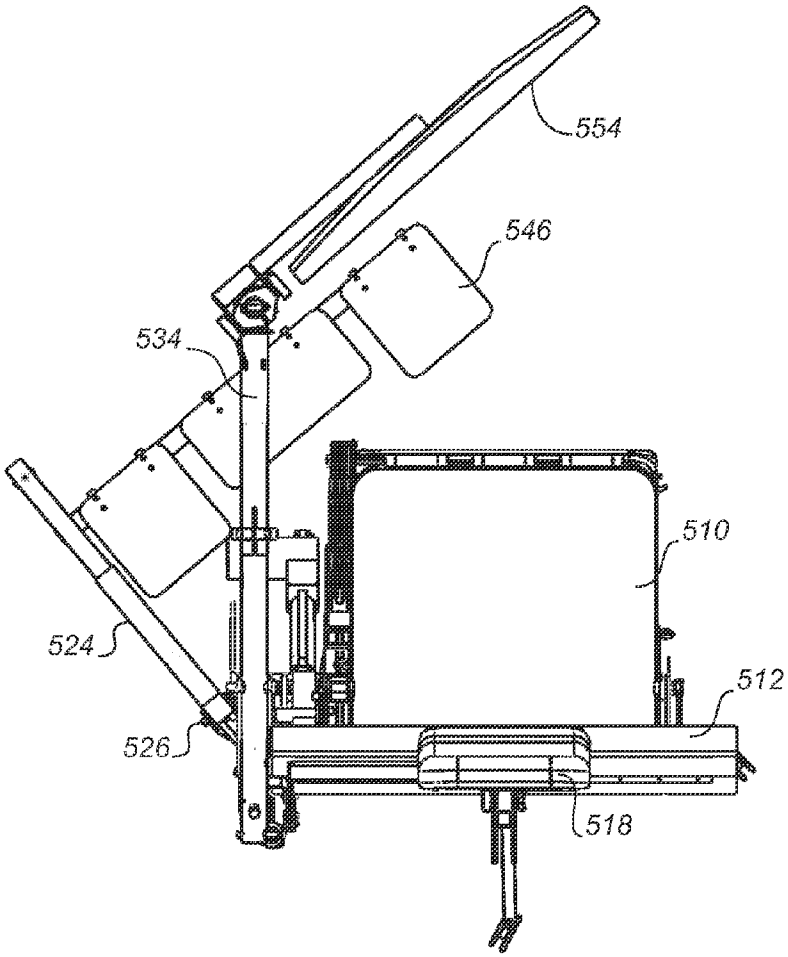
FIG. 34A is a top plan view showing the collaboration configuration.
Figure 34A:
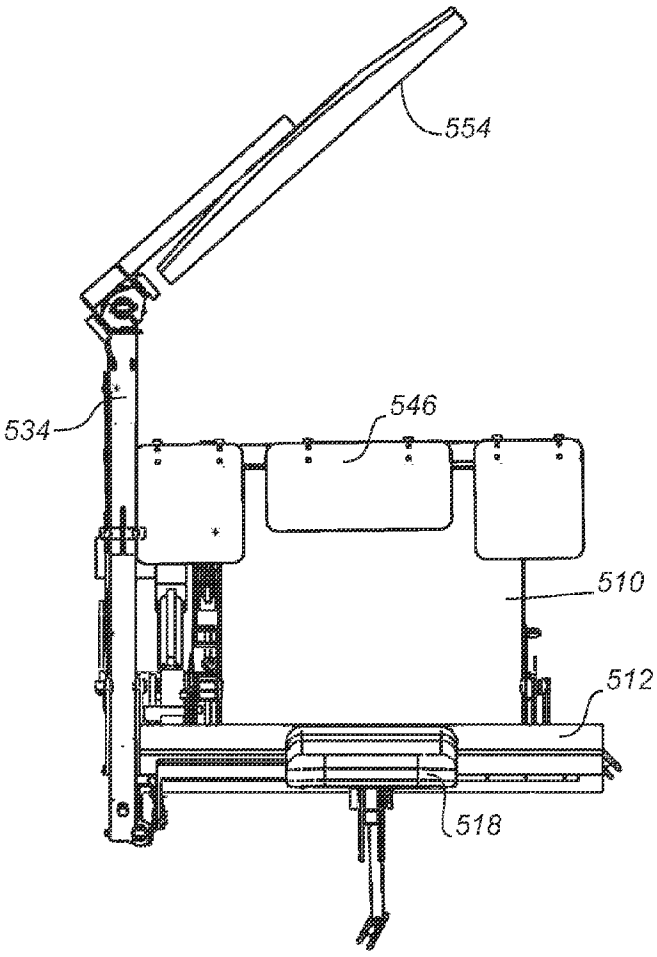

Finally, FIGS. 39 and 40 show the cable drives linking the monitor and input arms to the position illustrated in FIG. 34B. Looking first at FIG. 39, we see that a flexible cable loop 620 is routed around pulley 622 operatively coupled to vertical support post 550. This post is pivotally disposed in the distal cud 548 of upper horizontal monitor arm 534. The cable 624 is routed through and concealed within arm 534. A detent groove 626 in pulley 622 engages a tab on vertical support post 550, resulting in vertical support post 550 normally rotating with pulley 622. When a user chooses to manually rotate the monitor independently of the pulley to work in collaborate mode (FIG. 34A), the tab on vertical post 550 slips up and out of engagement with detent groove 626 so as to allow rotation, but may subsequently be gently rotated back into the detent groove 626, so as to allow re-engage with the cable assembly. [Note: In this view, the cable sheath is not shown.]

FIG. 40 shows a flexible cable loop 630 routed around pulley 632, which spins on the lower end of vertical post 528 so as to place the input device arm 524 into operative connection with pulley 622 and thus vertical monitor arm 550 through the detent 626.

It will be appreciated from the foregoing that in its most essential aspect, the present invention is an ergonomic workstation that includes A chair, comprising: a base for placement on a surface having a ground plane; an effective hip axis affixed to said base; a seat bottom that rotates about said effective hip axis; a seat back that rotates about said effective hip axis; an effective shoulder axis positionally fixed to said seat back; an effective elbow axis positionally fixed to said seat back; a monitor support having a monitor mount and configured such that said monitor mount rotates about said shoulder axis; and an input device tray support configured such that an input device tray mounted on said input device tray support rotates about said elbow axis.

Seen in another aspect, the inventive ergonomic workstation includes an adjustable task seat including a seat bottom, a seat back, a head rest, and a leg rest; a monitor support; and at least one input device support having an input device support. tray mounted thereon; wherein the seat back is operatively connected to the seat bottom, the head rest, the leg rest, the monitor support, and the input device support through mechanical linkages configured in such a manner that when the workstation is moved through a range of operative zones, including a sitting zone, a transition zone, and a reclined zone ("the operative zones"), the monitor support maintains a fixed distance to a given reference point on the seat back over a large range of both the transition and reclined zones.

In still another aspect, the inventive workstation is seen to be a workstation that includes a ground-engaging base; a seat back supported by and pivotally attached to the base at a hip axis so as to enable forward and rearward tilting of said seat back in relation to the base; a monitor support pivotally attached to said the back at a shoulder axis; and an input device support pivotally attached to the seat back at an elbow axis; wherein the mechanical connection of the seat back in relation to said base, the mechanical connection of the monitor support in relation to the seat back, and the mechanical connection of the input device support in relation to the seat back are configured so as to fix the shoulder axis and the elbow axis in relation to the seat back.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. As an example, the monitor arm in the second preferred embodiment could be movable by an electric actuator so as to replace the cam system. Such an alternative is considered to be within the scope of this disclosure and consonant with the spirit of the invention.

Therefore, the above description and illustrations should not be construed as limiting the scope of the invention, which is defined by the appended claims.

The invention claimed is:

1. A chair, comprising:

a base for placement on a surface having a ground plane;

a seat bottom that rotates about an effective hip axis positionally fixed in relation to said base;

a seat back that rotates about said effective hip axis;

a monitor support configured such that a monitor mounted On said monitor support rotates about an effective shoulder axis positionally fixed in relation to said seat back; and an input device tray support configured such that an input device, tray mounted on said input device tray support rotates about an effective elbow axis positionally fixed in relation to said seat back;

wherein said chair has a sitting range of motion, a reclining range of motion, and a transition range of motion between said sitting and reclining, ranges in which said input device tray and a monitor mounted on said monitor support move down and back toward said seat back and said seat bottom while maintaining a fixed angle relative to a ground plane as said seat back rotates back through said sitting range of motion.

2. The chair of claim 1, wherein said chair has a sitting range of motion in which said input device tray and said monitor mount are held at approximately fixed angles relative to the ground plane as said seat back rotates about said hip axis.

3. An ergonomic workstation, comprising:

a base for placement on a surface having a ground plane;

a hip axis affixed to said base;

a seat bottom that rotates about said hip axis;

a seat back that rotates about said hip axis;

an elbow axis fixed to said seat back: and an input device tray support configured such that an input device tray mounted on said input device tray support rotates about said elbow axis;

wherein said ergonomic workstation has a sitting range of motion, a reclining range of motion, and a transition range of motion between said sitting and reclining ranges in which said input device tray moves down and back toward said seat back and said seat bottom while maintaining a fixed angle relative to a ground plane as said seat back rotates back through said sitting range of motion; and wherein said workstation has a sitting range of motion, in which said input device tray is held at an approximately fixed angle relative to the ground plane as said seat back rotates about said hip axis.

* * * * *